US007271819B2

(12) United States Patent
Matsutani et al.

(10) Patent No.: US 7,271,819 B2
(45) Date of Patent: Sep. 18, 2007

(54) THERMAL PRINTER THAT EFFECTIVELY CONTROLS HEAT BUILDUP

(75) Inventors: Megumi Matsutani, Okazaki (JP); Takashi Horiuchi, Kariya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 372 days.

(21) Appl. No.: 11/092,604

(22) Filed: Mar. 29, 2005

(65) Prior Publication Data

US 2005/0219350 A1 Oct. 6, 2005

(30) Foreign Application Priority Data

Mar. 30, 2004 (JP) ..... 2004-097358
Mar. 30, 2004 (JP) ..... 2004-097360
Mar. 30, 2004 (JP) ..... 2004-097363
Mar. 30, 2004 (JP) ..... 2004-097364

(51) Int. Cl.
*B41J 2/00* (2006.01)

(52) U.S. Cl. ..... 347/196

(58) Field of Classification Search ..... 347/196, 347/194, 193, 191–192, 188–190, 182, 220, 347/176

See application file for complete search history.

(56) References Cited

U.S. PATENT DOCUMENTS 4,543,588 A 9/1985 Fukui
4,556,891 A * 12/1985 Matsushita et al. ..... 347/176
4,684,959 A 8/1987 Mori et al.
5,339,099 A 8/1994 Nureki et al.
5,534,890 A 7/1996 Krug et al.
5,633,670 A * 5/1997 Kwak ..... 347/193
6,141,028 A * 10/2000 Aruga ..... 347/193
6,494,629 B2 12/2002 Hayashi et al.
2001/0031165 A1 10/2001 Hayashi et al.
2007/0008399 A1 * 1/2007 Botten et al. ..... 347/220

FOREIGN PATENT DOCUMENTS

JP A 60-151074 8/1985
JP A 4-164658 6/1992
JP A 7-108701 4/1995
JP A 8-300713 11/1996
JP A 2001-191574 7/2001
JP A 2001-270144 10/2001

* cited by examiner

*Primary Examiner*—K. Feggins
(74) *Attorney, Agent, or Firm*—Oliff & Berridge, PLC

(57) ABSTRACT

A thermal head has heating elements and is movable relative to a printing medium. A pulse application portion applies a drive voltage pulse selectively to the heating elements. A voltage measurement portion measures a head voltage applied to the thermal head. A total-dot counting portion adds a number of dots which are printed from a reference time point, thereby obtaining a total dot count. An adjustment portion adjusts the total dot count based on a predetermined adjustment dot count corresponding to an ambient temperature. A heat-buildup-coefficient storing portion stores a heat buildup coefficient corresponding both to the ambient temperature and to an excess dot count. A pulse-width setting portion sets the width of the drive voltage pulse based on the head voltage and the heat buildup coefficient. A pulse-width correction portion corrects the width of the drive voltage pulse based on the head voltage measured by the voltage measurement portion.

57 Claims, 26 Drawing Sheets

61

| 611 AMBIENT TEMPERATURE | 612 TOTAL AMOUNT | 613 DISCHARGE AMOUNT |
|---|---|---|
| GREATER THAN OR EQUAL TO 30°C | 250000 DOTS | 1800 DOTS |
| GREATER THAN OR EQUAL TO 20°C AND LESS THAN 30°C | 300000 DOTS | 2000 DOTS |
| LESS THAN 20°C | 460000 DOTS | 2600 DOTS |

FIG.6

62

622

621

| EXCESS DOT COUNT | AMBIENT TEMPERATURE | | | | |
|---|---|---|---|---|---|
| | 40~32°C | 31~28°C | 27~22°C | 21~17°C | 16~10°C |
| LESS THAN 50000 | 1 | 1 | 1 | 1 | 1 |
| 50000~99999 | 1.04 | 1.04 | 1.04 | 1.04 | 1.04 |
| 100000~149999 | 1.07 | 1.07 | 1.07 | 1.07 | 1.07 |
| 150000~ | 1.12 | 1.12 | 1.12 | 1.12 | 1.12 |
| 200000~ | 1.17 | 1.17 | 1.17 | 1.17 | 1.17 |
| 250000~ | 1.21 | 1.21 | 1.21 | 1.21 | 1.21 |
| 300000~ | 1.28 | 1.28 | 1.28 | 1.28 | 1.28 |
| 350000~ | 1.35 | 1.35 | 1.35 | 1.35 | 1.35 |
| 400000~ | 1.4 | 1.4 | 1.4 | 1.4 | 1.4 |
| 450000~ | 1.47 | 1.47 | 1.47 | 1.47 | 1.47 |
| 500000~ | 1.49 | 1.49 | 1.49 | 1.49 | 1.49 |
| 550000~ | 1.51 | 1.51 | 1.51 | 1.51 | 1.51 |
| 600000~ | 1.53 | 1.53 | 1.53 | 1.53 | 1.53 |
| 650000~ | 1.56 | 1.56 | 1.56 | 1.56 | 1.53 |
| 700000~ | 1.58 | 1.58 | 1.58 | 1.58 | 1.53 |

FIG.7

63

| 631 VOLTAGE CENTER VALUE | 632 VOLTAGE (HEX DATA) | 633 C(V) (HEX DATA) |
|---|---|---|
| 5.11 | ~4B | 04D9 |
| 5.40 | 4C~ | 04C7 |
| 5.68 | 50~ | 04BF |
| 5.97 | 54~ | 04E3 |
| 6.25 | 58~ | 0549 |
| 6.54 | 5C~ | 05BF |
| 6.83 | 60~ | 0644 |
| 7.11 | 64~ | 06D0 |
| 7.40 | 68~ | 0762 |
| 7.68 | 6C~ | 07FB |
| 7.97 | 70~ | 0899 |
| 8.26 | 74~ | 093E |
| 8.54 | 78~ | 09EA |

FIG.8

64

641 642 643

| VOLTAGE | | CORRECTION COEFFICIENT α I (%) | |
|---|---|---|---|
| CENTER VALUE | HEX DATA | LAMINATED TAPE | RECEPTOR TAPE |
| 5.11 | ~4B | 100 | 100 |
| 5.4 | 4C~ | 100 | 100 |
| 5.68 | 50~ | 100 | 100 |
| 5.97 | 54~ | 100 | 100 |
| 6.25 | 58~ | 100 | 100 |
| 6.54 | 5C~ | 100 | 100 |
| 6.83 | 60~ | 100 | 100 |
| 7.11 | 64~ | 100 | 100 |
| 7.4 | 68~ | 100 | 100 |
| 7.68 | 6C~ | 100 | 100 |
| 7.97 | 70~ | 100 | 100 |
| 8.26 | 74~ | 100 | 100 |
| 8.54 | 78~ | 100 | 100 |
| 8.83 | 7C~ | 100 | 100 |
| 9.11 | 80~ | 99 | 99 |
| 9.4 | 84~ | 98 | 98 |
| 9.69 | 88~ | 96 | 97 |
| 9.97 | 8C~ | 95 | 96 |
| 10.26 | 90~ | 93 | 94 |
| 10.54 | 94~ | 92 | 93 |
| 10.83 | 98~ | 90 | 92 |
| 11.12 | 9C~ | 88 | 90 |
| 11.4 | A0~ | 87 | 89 |
| 11.69 | A4~ | 86 | 88 |

FIG.10

164

1641 1642 1643

| MAIN PULSE WIDTH | NUMBER OF LOOPS (n) | CORRECTION COEFFICIENT M |
|---|---|---|
| 250 μs | 1 | 1 |
| 500 μs | 2 | 1.01 |
| 750 μs | 3 | 1.03 |
| 1000 μs | 4 | 1.05 |
| 1250 μs | 5 | 1.1 |
| ▪ | ▪ | ▪ |
| ▪ | ▪ | ▪ |
| 5000 μs | 20 | 1.25 |
| | | |

FIG.17

264

| 2641 PREVIOUS TAPE TYPE | 2642 CURRENT TAPE TYPE | 2643 CORRECTION COEFFICIENT dc |
|---|---|---|
| LAMINATED | NON-LAMINATED | 0.9 |
| LAMINATED | TRANSFER | 1.2 |
| NON-LAMINATED | LAMINATED | 1.1 |
| NON-LAMINATED | TRANSFER | 1.3 |
| TRANSFER | LAMINATED | 0.8 |
| TRANSFER | NON-LAMINATED | 0.7 |

FIG.19

65

| | | | | |
|---|---|---|---|---|
| 651 | TAPE TYPE | LAMINATED | NON-LAMINATED (RECEPTOR) | TRANSFER |
| 652 | CONSTANT | 1 | 0.9 | 1.2 |

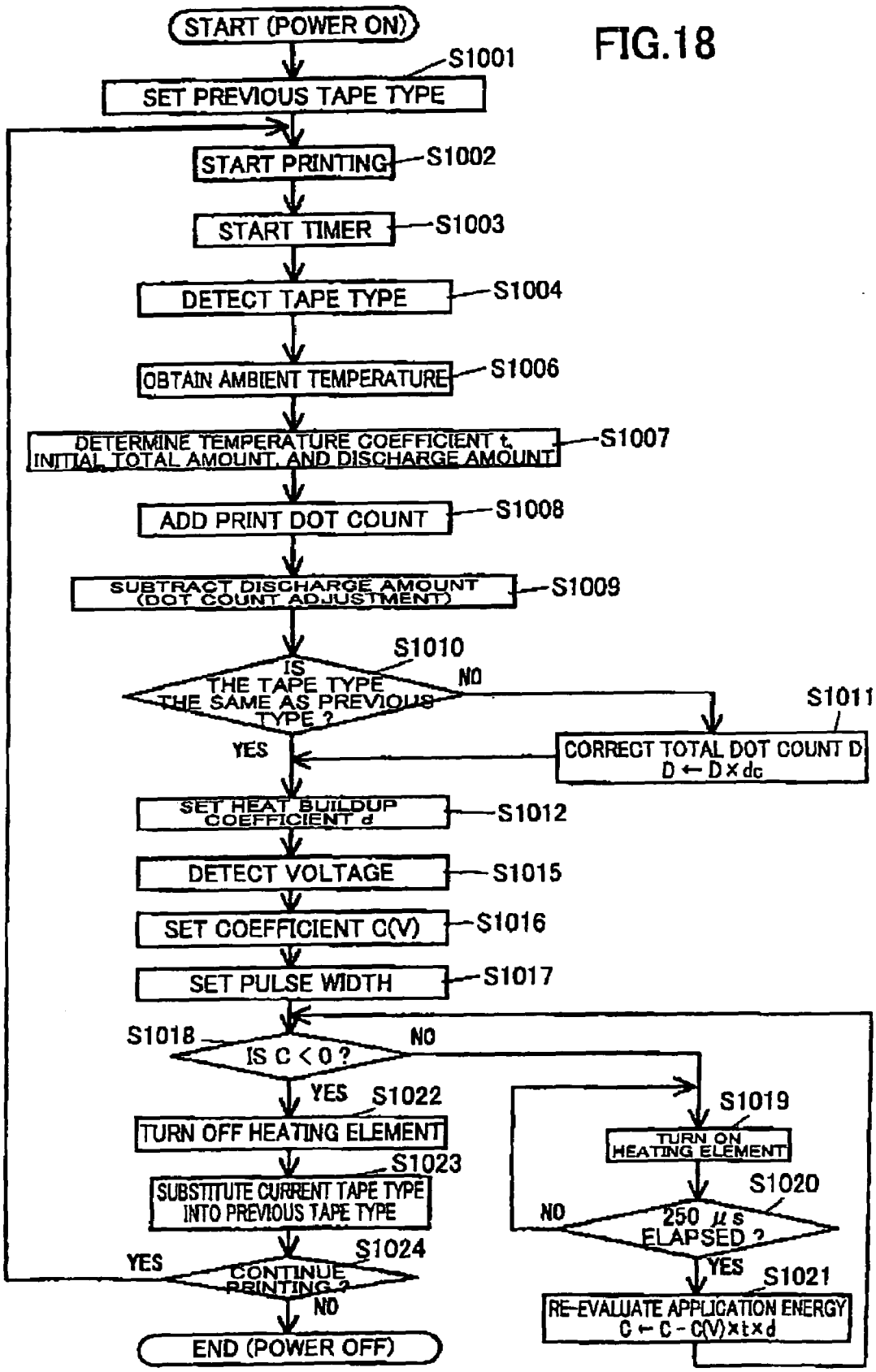
FIG.18
START (POWER ON)
S1001
SET PREVIOUS TAPE TYPE
START PRINTING
S1002
START TIMER
S1003
DETECT TAPE TYPE
S1004
OBTAIN AMBIENT TEMPERATURE
S1006
DETERMINE TEMPERATURE COEFFICIENT t, INITIAL TOTAL AMOUNT, AND DISCHARGE AMOUNT
S1007
ADD PRINT DOT COUNT
S1008
SUBTRACT DISCHARGE AMOUNT (DOT COUNT ADJUSTMENT)
S1009
S1010
IS THE TAPE TYPE THE SAME AS PREVIOUS TYPE ?
NO
S1011
CORRECT TOTAL DOT COUNT D
D ← D × dc
YES
SET HEAT BUILDUP COEFFICIENT d
S1012
DETECT VOLTAGE
S1015
SET COEFFICIENT C(V)
S1016
SET PULSE WIDTH
S1017
S1018
IS C < 0 ?
NO
YES
S1022
TURN OFF HEATING ELEMENT
S1023
SUBSTITUTE CURRENT TAPE TYPE INTO PREVIOUS TAPE TYPE
S1024
YES
CONTINUE PRINTING ?
NO
END (POWER OFF)
S1019
TURN ON HEATING ELEMENT
S1020
NO
250 μs ELAPSED ?
YES
S1021
RE-EVALUATE APPLICATION ENERGY
C ← C - C(V)×t×d

FIG.21

66

662

661

| EXCESS DOT COUNT | TAPE TYPE | | | | | | |
|---|---|---|---|---|---|---|---|
| | PREVIOUS | LAMINATED | LAMINATED | NON-LAMINATED | NON-LAMINATED | TRANSFER | TRANSFER |
| | CURRENT | NON-LAMINATED | TRANSFER | LAMINATED | TRANSFER | LAMINATED | NON-LAMINATED |
| LESS THAN 50000 | | 0 | 0 | 0 | 0 | 0 | 0 |
| 50000~99999 | | -5000 | 7500 | 5000 | 12500 | -7500 | -12500 |
| 100000~149999 | | -10000 | 15000 | 10000 | 25000 | -15000 | -25000 |
| 150000~ | | -15000 | 22500 | 15000 | 37500 | -22500 | -37500 |
| 200000~ | | -20000 | 30000 | 20000 | 50000 | -30000 | -50000 |
| 250000~ | | -25000 | 37500 | 25000 | 62500 | -37500 | -62500 |
| 300000~ | | -30000 | 45000 | 30000 | 75000 | -45000 | -75000 |
| 350000~ | | -35000 | 52500 | 35000 | 87500 | -52500 | -87500 |
| 400000~ | | -40000 | 60000 | 40000 | 100000 | -60000 | -100000 |
| 450000~ | | -45000 | 67500 | 45000 | 112500 | -67500 | -112500 |
| 500000~ | | -50000 | 75000 | 50000 | 125000 | -75000 | -125000 |
| 550000~ | | -55000 | 82500 | 55000 | 137500 | -82500 | -137500 |
| 600000~ | | -60000 | 90000 | 60000 | 150000 | -90000 | -150000 |
| 650000~ | | -65000 | 97500 | 65000 | 162500 | -97500 | -162500 |
| 700000~ | | -70000 | 105000 | 70000 | 175000 | -105000 | -175000 |

FIG.23

67

672

671

| EXCESS DOT COUNT | TAPE TYPE | | |
|---|---|---|---|
| | LAMINATED | NON-LAMINATED | TRANSFER |
| LESS THAN 50000 | 0 | 0 | 0 |
| 50000~99999 | 10000 | 15000 | 2500 |
| 100000~149999 | 20000 | 30000 | 5000 |
| 150000~ | 30000 | 45000 | 7500 |
| 200000~ | 40000 | 60000 | 10000 |
| 250000~ | 50000 | 75000 | 12500 |
| 300000~ | 60000 | 90000 | 15000 |
| 350000~ | 70000 | 105000 | 17500 |
| 400000~ | 80000 | 120000 | 20000 |
| 450000~ | 90000 | 135000 | 22500 |
| 500000~ | 100000 | 150000 | 25000 |
| 550000~ | 110000 | 165000 | 27500 |
| 600000~ | 120000 | 180000 | 30000 |
| 650000~ | 130000 | 195000 | 32500 |
| 700000~ | 140000 | 210000 | 35000 |

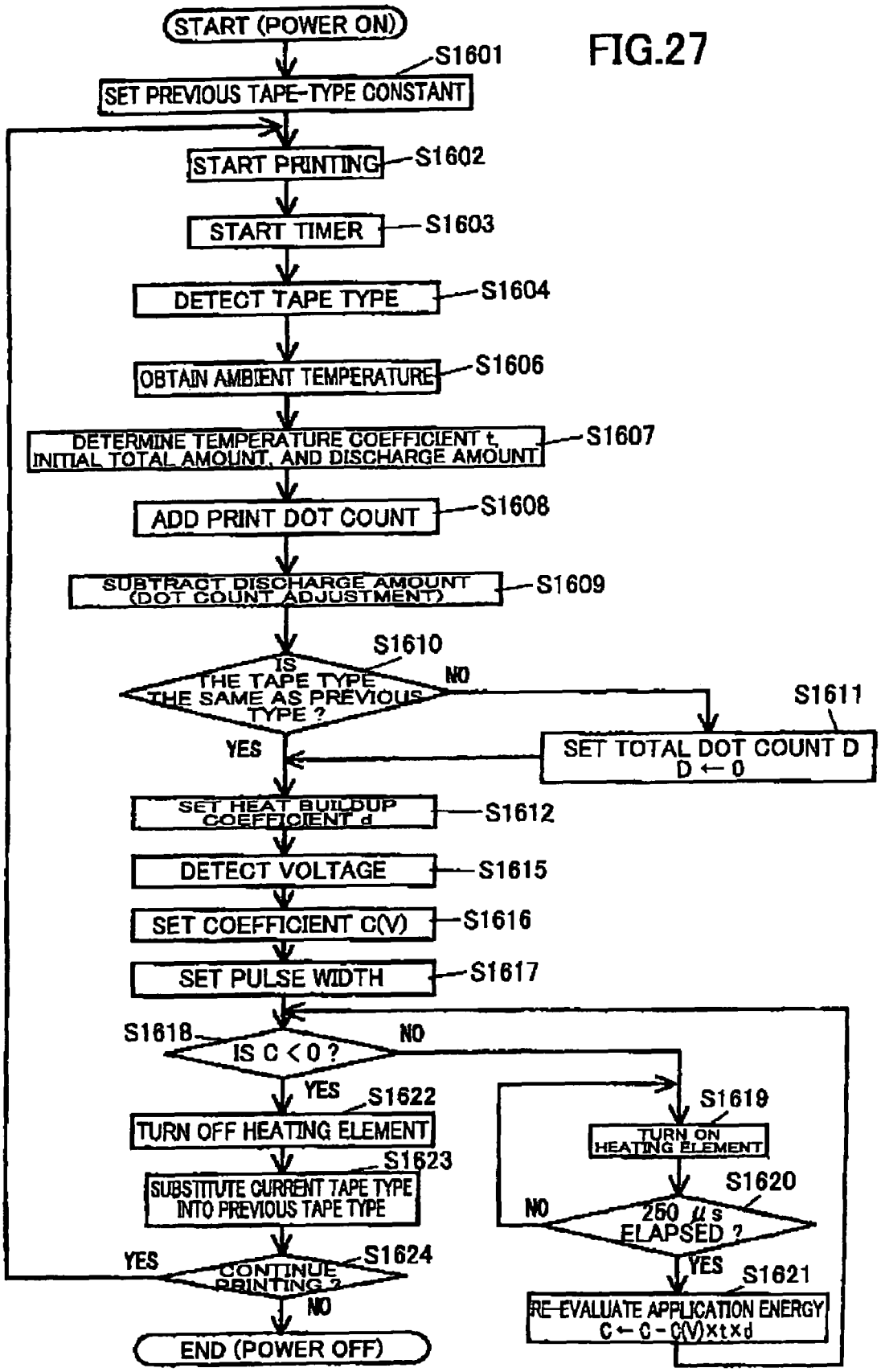
FIG.27
START (POWER ON)
S1601
SET PREVIOUS TAPE-TYPE CONSTANT
START PRINTING
S1602
START TIMER
S1603
DETECT TAPE TYPE
S1604
OBTAIN AMBIENT TEMPERATURE
S1606
DETERMINE TEMPERATURE COEFFICIENT t, INITIAL TOTAL AMOUNT, AND DISCHARGE AMOUNT
S1607
ADD PRINT DOT COUNT
S1608
SUBTRACT DISCHARGE AMOUNT (DOT COUNT ADJUSTMENT)
S1609
S1610
IS THE TAPE TYPE THE SAME AS PREVIOUS TYPE ?
NO
YES
S1611
SET TOTAL DOT COUNT D
D ← 0
SET HEAT BUILDUP COEFFICIENT d
S1612
DETECT VOLTAGE
S1615
SET COEFFICIENT C(V)
S1616
SET PULSE WIDTH
S1617
S1618
IS C < 0 ?
NO
YES
S1622
TURN OFF HEATING ELEMENT
S1623
SUBSTITUTE CURRENT TAPE TYPE INTO PREVIOUS TAPE TYPE
S1624
YES
CONTINUE PRINTING ?
NO
END (POWER OFF)
S1619
TURN ON HEATING ELEMENT
S1620
NO
250 μs ELAPSED ?
YES
S1621
RE-EVALUATE APPLICATION ENERGY
C ← C - C(V)×t×d

THERMAL PRINTER THAT EFFECTIVELY CONTROLS HEAT BUILDUP

BACKGROUND

The disclosure relates to a thermal printer, and more particularly to a thermal printer that controls heat buildup in a thermal head thereof.

A thermal printer generally has a plurality of heating elements which are arrayed in at least one row on a thermal head. Drive pulses are selectively applied to the heating elements to generate heat for printing. The heat accumulates or builds up in the thermal head as printing proceeds, and print characteristics or print performance of the thermal printer can be adversely affected by this heat buildup in the thermal head. For example, printing high-density patterns continuously under hot conditions can lead to problems such as fattened or illegible letters (or patterns) due to the heat buildup. Some thermal printers have been proposed to overcome such problem.

For example, as disclosed in Japanese patent-application publication No. 2001-270144, a thermal printer calculates heat buildup data that indicates a heat buildup state in each heat buildup layer (a glaze layer, a ceramic plate, and an aluminum plate) of its thermal head, and multiplies the heat buildup data by predetermined coefficients, thereby obtaining heat buildup correction data. The thermal printer then obtains heat generation data based on the heat buildup correction data, and controls driving of heating elements based on the heat generation data. The aluminum plate is provided with a head temperature sensor that measures temperature of the thermal head. A coefficient to be used to obtain the heat buildup correction data for the aluminum plate is determined by an equation that includes a head voltage as a parameter.

Another thermal printer applies, in addition to main drive pulses, sub-pulses (subsidiary pulses) having a short ON time in order to compensate for any energy insufficiency at the start of printing and to prevent print blurring. For example, Japanese patent-application publication No. 7-108701 discloses a thermal printer that applies two types of sub-pulse to the thermal head based on a dot print state at the current dot and at the dot before the current dot. The thermal printer also adjusts the ON time by changing the width of the main pulses.

It is known that a pulse width applied to the heating elements are controlled in consideration of load fluctuations, when a voltage of a power source is not constant (such as when a stabilized power source like a DC/DC converter is not used). This control method is called unstable control. In the unstable control, when a dot count (a number of dots) to be printed is high, a current is also high and thus a voltage drop is large. On the other hand, when the dot count to be printed is low, the current is also low and thus the voltage drop is small. For that reason, there arises a time difference for a temperature rise of the heating elements between the high voltage state and the low voltage state. A thermal printer disclosed in Japanese patent-application publication No. 8-300713 reads out the voltage every time $\Delta t$, determines an OFF time for application pulses based on the read voltage, and repeats ON and OFF of the pulses based on the OFF time. In this way, the thermal printer provides a stable heat generation of the thermal head.

A thermal printer disclosed in Japanese patent-application publication No. 2001-191574 calculates a heat buildup level for each heating element based on a number of drive pulses which have been applied over a plurality of times. The thermal printer applies, to each heating element, a number of drive pulses that corresponds to the heat buildup level. In this way, size and density of a dot pattern to be recorded by each heating element is made uniform.

SUMMARY

However, with the above-described thermal printers, it is difficult to appropriately determine an amount of the heat buildup and to set the width of the pulses applied to the heating elements in consideration of a voltage difference or a situation in which the tape-type has changed.

In view of the foregoing, it is an object of the disclosure to provide a thermal printer that performs effective heat buildup control even when a power source having a comparatively low voltage is used or when the voltage of the power source is not constant.

It is another object of the disclosure to provide a thermal printer that performs effective heat buildup control even after a change of printing-medium type, thereby maintaining a high print quality.

In order to attain the above and other objects, the disclosure provides a thermal printer. The thermal printer includes a thermal head, a pulse application portion, a voltage measurement portion, a total-dot counting portion, an adjustment portion, a heat-buildup-coefficient storing portion, a pulse-width setting portion, and a pulse-width correction portion. The thermal head has a plurality of heating elements and is movable relative to a printing medium for printing dots on the printing medium. The pulse application portion applies a drive voltage pulse selectively to the heating elements. The drive voltage pulse has a width. The voltage measurement portion measures a head voltage applied to the thermal head. The total-dot counting portion adds a number of dots which are printed from a reference time point, thereby obtaining a total dot count. The adjustment portion adjusts the total dot count based on a predetermined adjustment dot count corresponding to an ambient temperature. The heat-buildup-coefficient storing portion stores a heat buildup coefficient corresponding both to the ambient temperature and to an excess dot count. The excess dot count is a difference between the total dot count after adjustment by the adjustment portion and a predetermined reference dot count. The pulse-width setting portion sets the width of the drive voltage pulse based on the head voltage and the heat buildup coefficient. The pulse-width correction portion corrects the width of the drive voltage pulse based on the head voltage measured by the voltage measurement portion.

The disclosure also provides a thermal printer. The thermal printer includes a thermal head, a pulse application portion, a voltage measurement portion, a printing-medium detection portion, a total-dot counting portion, an adjustment portion, a heat-buildup-coefficient storing portion, a pulse-width setting portion, and a pulse-width correction portion. The thermal head has a plurality of heating elements and is movable relative to a printing medium for printing dots on the printing medium. The pulse application portion applies a drive voltage pulse selectively to the heating elements. The drive voltage pulse has a width. The voltage measurement portion measures a head voltage applied to the thermal head. The printing-medium detection portion detects a printing-medium type. The total-dot counting portion adds a number of dots which are printed from a reference time point, thereby obtaining a total dot count. The adjustment portion adjusts the total dot count based on a predetermined adjustment dot count corresponding to an ambient temperature. The heat-buildup-coefficient stores portion storing a heat buildup coefficient corresponding both to the ambient temperature and to an excess dot count. The excess dot count is a difference between the total dot count after adjustment by the adjustment portion and a predetermined reference dot count. The pulse-width setting portion sets the width of the drive voltage pulse based on the head voltage and the heat buildup coefficient. The pulse-width correction portion corrects the width of the drive voltage pulse based on the printing-medium type detected by the printing-medium detection portion.

The disclosure also provides a thermal printer. The thermal printer includes a thermal head, a pulse application portion, a power source, a voltage measurement portion, and a pulse-width setting portion. The thermal head has a plurality of heating elements and is movable relative to a printing medium for printing dots on the printing medium. The pulse application portion applies a drive voltage pulse selectively to the heating elements. The drive voltage pulse has a width. The power source supplies the thermal head with electrical power. The voltage measurement portion measures the voltage of the power source at predetermined time intervals. The pulse-width setting portion sets the width of the drive voltage pulse based on a parameter corresponding to the voltage measured by the voltage measurement portion. The voltage measurement portion performs an initial measurement after the pulse application portion has started applying the drive voltage pulse.

The disclosure also provides a thermal printer. The thermal printer includes a thermal head, a pulse application portion, a printing-medium detection portion, a printing-medium storage portion, a total-dot counting portion, an adjustment portion, a pulse-width setting portion, and a pulse-width correction portion. The thermal head has a plurality of heating elements and is movable relative to a printing medium for printing dots on the printing medium. The pulse application portion applies a drive voltage pulse selectively to the heating elements. The drive voltage pulse has a width. The printing-medium detection portion detects a printing-medium type. The printing-medium storage portion stores the printing-medium type detected by the printing-medium detection portion. The printing-medium monitor portion monitors a current printing-medium type detected by the printing-medium detection portion and a previous printing-medium type that was detected previously and is stored in the printing-medium storage portion. The total-dot counting portion adds a number of dots which are printed from a reference time point, thereby obtaining a total dot count. The adjustment portion adjusts the total dot count based on a predetermined adjustment dot count corresponding to an ambient temperature. The pulse-width setting portion sets the width of the drive voltage pulse based on a difference between the total dot count after adjustment by the adjustment portion and a predetermined reference dot count. The pulse-width correction portion corrects the width of the drive voltage pulse, when the printing-medium monitor portion has determined that the current printing-medium type is different from the previous printing-medium type.

The disclosure also provides a thermal printer. The thermal printer includes a thermal head, a heat-buildup-coefficient memory, a pulse application portion, a voltage measurement portion, and a controller. The thermal head has a plurality of heating elements and is movable relative to a printing medium for printing dots on the printing medium. The heat-buildup-coefficient memory stores a heat buildup coefficient. The pulse application portion applies a drive voltage pulse selectively to the heating elements. The drive voltage pulse has a width. The voltage measurement portion measures a head voltage applied to the thermal head. The controller adds a number of dots which are printed from a reference time point for obtaining a total dot count, adjusts the total dot count based on a predetermined adjustment dot count corresponding to an ambient temperature, sets the width of the drive voltage pulse based on the head voltage and the heat buildup coefficient, and corrects the width of the drive voltage pulse based on the head voltage measured by the voltage measurement portion. The heat buildup coefficient corresponds both to the ambient temperature and to an excess dot count that is a difference between the total dot count after adjustment and a predetermined reference dot count.

The disclosure also provides a thermal printer. The thermal printer includes a thermal head, a heat-buildup-coefficient memory, a pulse application portion, a voltage measurement portion, a printing-medium detector, and a controller. The thermal head has a plurality of heating elements and is movable relative to a printing medium for printing dots on the printing medium. The heat-buildup-coefficient memory stores a heat buildup coefficient. The pulse application portion applies a drive voltage pulse selectively to the heating elements. The drive voltage pulse has a width. The voltage measurement portion measures a head voltage applied to the thermal head. The printing-medium detector detects a printing-medium type. The controller adds a number of dots which are printed from a reference time point for obtaining a total dot count, adjusts the total dot count based on a predetermined adjustment dot count corresponding to an ambient temperature, sets the width of the drive voltage pulse based on the head voltage and the heat buildup coefficient, and corrects the width of the drive voltage pulse based on the printing-medium type detected by the printing-medium detector. The heat buildup coefficient corresponds both to the ambient temperature and to an excess dot count that is a difference between the total dot count after adjustment and a predetermined reference dot count.

The disclosure also provides a thermal printer. The thermal printer includes a thermal head, a pulse application portion, a power source, a voltage measurement portion, and a controller. The thermal head has a plurality of heating elements and is movable relative to a printing medium for printing dots on the printing medium. The pulse application portion applies a drive voltage pulse selectively to the heating elements. The drive voltage pulse has a width. The power source supplies the thermal head with electrical power. The power source has a voltage. The voltage measurement portion measures a voltage of the power source at predetermined time intervals. The controller sets the width of the drive voltage pulse based on a parameter corresponding to the voltage measured by the voltage measurement portion. The controller controls the voltage measurement portion to perform an initial measurement after the pulse application portion has started applying the drive voltage pulse.

The disclosure also provides a thermal printer. The thermal printer includes a thermal head, a pulse application portion, a printing-medium detector, a printing-medium memory, and a controller. The thermal head has a plurality of heating elements and is movable relative to a printing medium for printing dots on the printing medium. The pulse application portion applies a drive voltage pulse selectively to the heating elements. The drive voltage pulse has a width. The printing-medium detector detects a printing-medium type. The printing-medium memory stores the printing-medium type detected by the printing-medium detector. The controller monitors a current printing-medium type detected by the printing-medium detector and a previous printing-medium type that was detected previously and is stored in the printing-medium memory, adds a number of dots which are printed from a reference time point for obtaining a total dot count, adjusts the total dot count based on a predetermined adjustment dot count corresponding to an ambient temperature, sets the width of the drive voltage pulse based on a difference between the total dot count after adjustment and a predetermined reference dot count, and corrects the width of the drive voltage pulse upon determining that the current printing-medium type is different from the previous printing-medium type.

The disclosure also provides a method of controlling heat buildup in a thermal printer. The thermal printer includes a thermal head and a heat-buildup-coefficient storage portion. The thermal head has a plurality of heating elements and is movable relative to a printing medium for printing dots on the printing medium. The method includes applying a drive voltage pulse selectively to the heating elements, the drive voltage pulse having a pulse width, measuring a head voltage applied to the thermal head, adding a number of dots which are printed from a reference time point for obtaining a total dot count, adjusting the total dot count based on a predetermined adjustment dot count corresponding to an ambient temperature, setting the pulse width of the drive voltage pulse based on the head voltage and a heat buildup coefficient stored in the heat-buildup-coefficient storage portion, and correcting the pulse width of the drive voltage pulse based on the head voltage measured in the step of measuring the head voltage. The heat buildup coefficient corresponds both to the ambient temperature and to an excess dot count. The excess dot count is a difference between the total dot count after adjustment in the step of adjusting the total dot count and a predetermined reference dot count.

The disclosure also provides a method of controlling heat buildup in a thermal printer. The thermal printer includes a thermal head and a heat-buildup-coefficient storage portion. The thermal head has a plurality of heating elements and is movable relative to a printing medium for printing dots on the printing medium, The method includes applying a drive voltage pulse selectively to the heating elements, the drive voltage pulse having a pulse width, measuring a head voltage applied to the thermal head, detecting a printing-medium type, adding a number of dots which are printed from a reference time point for obtaining a total dot count, adjusting the total dot count based on a predetermined adjustment dot count corresponding to an ambient temperature, setting the pulse width of the drive voltage pulse based on the head voltage and a heat buildup coefficient stored in the heat-buildup-coefficient storage portion, and correcting the pulse width of the drive voltage pulse based on the printing-medium type detected in the step of detecting the printing-medium type. The heat buildup coefficient corresponds both to the ambient temperature and to an excess dot count. The excess dot count is a difference between the total dot count after adjustment in the step of adjusting the total dot count and a predetermined reference dot count.

The disclosure also provides a method of controlling heat buildup in a thermal printer. The thermal printer includes a thermal head and a power source. The thermal head has a plurality of heating elements and is movable relative to a printing medium for printing dots on the printing medium. The power source has a voltage and supplies the thermal head with electrical power. The method includes applying a drive voltage pulse selectively to the heating elements, the drive voltage pulse having a pulse width, measuring the voltage of the power source at predetermined time intervals, and setting the pulse width of the drive voltage pulse based on a parameter corresponding to the voltage measured in the step of measuring the voltage. The step of measuring the voltage includes performing an initial measurement after a start of applying the drive voltage pulse.

The disclosure also provides a method of controlling heat buildup in a thermal printer. The thermal printer includes a thermal head. The thermal head has a plurality of heating elements and is movable relative to a printing medium for printing dots on the printing medium. The method includes applying a drive voltage pulse selectively to the heating elements, the drive voltage pulse having a pulse width, detecting a printing-medium type, storing the printing-medium type detected in the step of detecting the printing-medium type, monitoring a current printing-medium type detected in the step of detecting the printing-medium type and a previous printing-medium type that was detected previously and is stored in the step of storing the printing-medium type, adding a number of dots which are printed from a reference time point for obtaining a total dot count, adjusting the total dot count based on a predetermined adjustment dot count corresponding to an ambient temperature, setting the pulse width of the drive voltage pulse based on a difference between the total dot count after adjustment in the step of adjusting the total dot count and a predetermined reference dot count, and correcting the pulse width of the drive voltage pulse, upon determining, in the step of monitoring the printing-medium type, that the current printing-medium type is different from the previous printing-medium type.

BRIEF DESCRIPTION OF THE DRAWINGS

The above and other objects, features and advantages of the disclosure will become more apparent from reading the following description of the preferred embodiments taken in connection with the accompanying drawings in which:

FIG. 6 is an explanatory diagram showing data configuration of a heat buildup coefficient table;

FIG. 7 is an explanatory diagram showing data configuration of a voltage change coefficient table;

FIG. 8 is an explanatory diagram showing data configuration of a correction coefficient table for correcting the heat buildup coefficient;

FIG. 10 is an explanatory diagram showing data configuration of a correction coefficient table for correcting the heat buildup coefficient;

FIG. 17 is an explanatory diagram showing data configuration of a correction coefficient table;

FIG. 18 is a flowchart showing the steps of heat buildup control processing to be executed by the tape printing device according to a fourth embodiment of the disclosure;

FIG. 19 is an explanatory diagram showing data configuration of a tape-type constant table stored in a parameter storage area of the tape printing device;

FIG. 21 is an explanatory diagram showing data configuration of a dot-count correction value table stored in the parameter storage area;

FIG. 23 is an explanatory diagram showing data configuration of a dot-count correction constant table stored in the parameter storage area;

FIG. 27 is a flowchart showing the steps of heat buildup control processing to be executed by the tape printing device according to a tenth embodiment of the disclosure.

DETAILED DESCRIPTION OF THE PREFERRED EMBODIMENTS

Figure 1A:
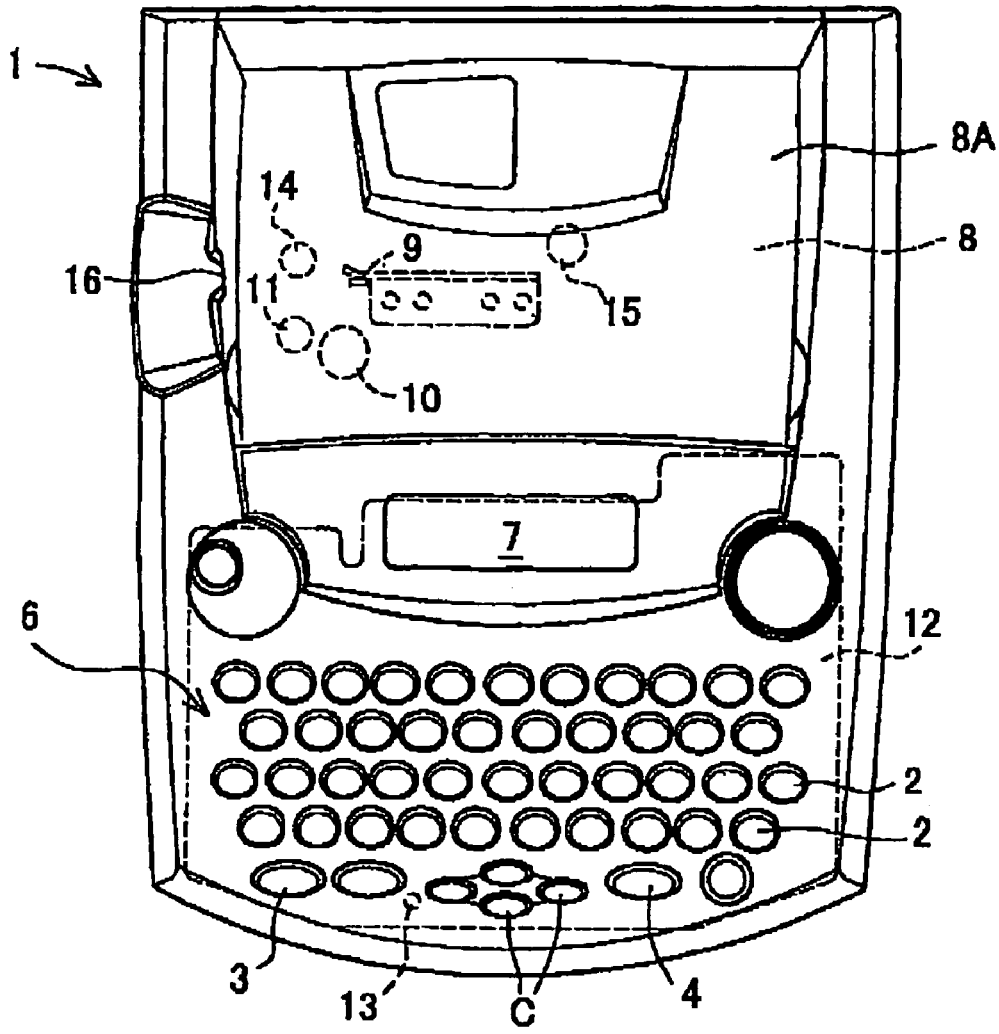
FIG. 1A is a plan view showing a tape printing device according to embodiments of the disclosure.

A thermal printer according to embodiments of the disclosure will be described while referring to the accompanying drawings wherein like parts and components are designated by the same reference numerals to avoid duplicating description.

First, an overall configuration of a tape printing device 1 according to first to tenth embodiments will be described while referring to FIGS. 1A to 3.

Figure 1B:
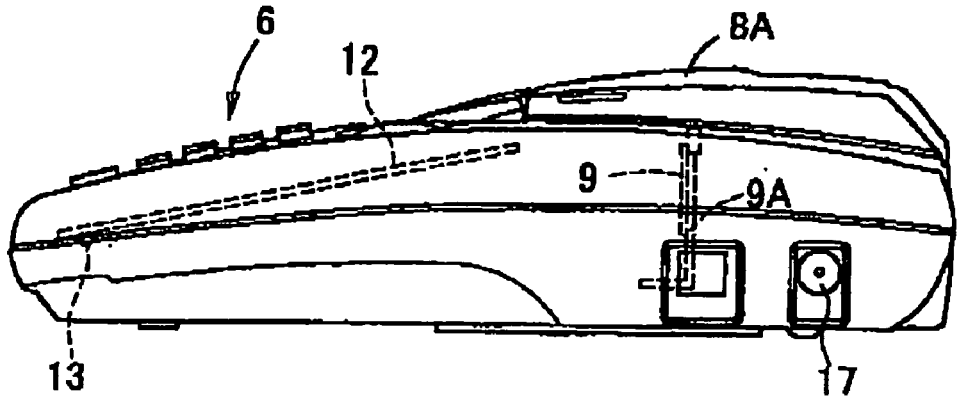
FIG. 1B is a side view from the right side showing the tape printing device shown in FIG. 1A.

As shown in FIGS. 1A and 1B, the tape printing device 1 is provided with a keyboard 6 that has character input keys 2 for creating text that forms document data, a print key 3 that instructs the printing of the text, and a return key 4 that instructs the execution and/or selection of a carriage-return instruction or various types of processing. Above is a liquid-crystal display (hereinafter abbreviated to "LCD") 7 that displays characters such as alphanumerics over a plurality of lines, cursor keys C for causing a cursor to move up, down, left, and right, and a cassette housing portion 8 that holds a tape cassette 35 (FIG. 3) which will be described later, covered with a housing cover 8A. On the lower side of the keyboard 6 is disposed a control board 12 configured of control circuit, and a thermistor 13 (FIG. 4) for detecting the ambient temperature is attached to the lower surface of the leading edge of the control board 12. A label discharge aperture 16 through which the printed tape is discharged is formed in the left side surface of the cassette housing portion 8, and an adapter insertion aperture 17 for the attachment of a power source adapter is provided in the right side surface of the cassette housing portion 8. Note that since the thermistor 13 is provided at a distance from the thermal head 9, the thermistor 13 is not affected by the heat-generating actions of the thermal head 9.

Within the cassette housing portion 8 is also disposed the thermal head 9 (FIG. 4) which will be described later, a platen roller 10 confronting the thermal head 9, a tape feed roller 11 on the downstream side of the platen roller 10, and a tape drive roller shaft 14 confronting the tape feed roller 11, as well as an ink ribbon take-up shaft 15 around which is wound an ink ribbon housed within the tape cassette 35. The ink ribbon take-up shaft 15 is driven in rotation through a suitable drive mechanism from a tape feed motor 30 (FIG. 4) that is configured of a stepping motor or the like, as will be described later. The ink ribbon take-up shaft 15 is inserted into an ink ribbon take-up reel 44 (FIG. 3) that takes up an ink ribbon 43 after the ink ribbon 43 has been used for printing, to drive the ink ribbon take-up reel 44 in rotation in synchronization with the print speed. The tape drive roller shaft 14 is driven in rotation through a suitable drive mechanism from the tape feed motor 30, to rotate a tape drive roller 53 (FIG. 3), as will be described later.

Figure 1C:
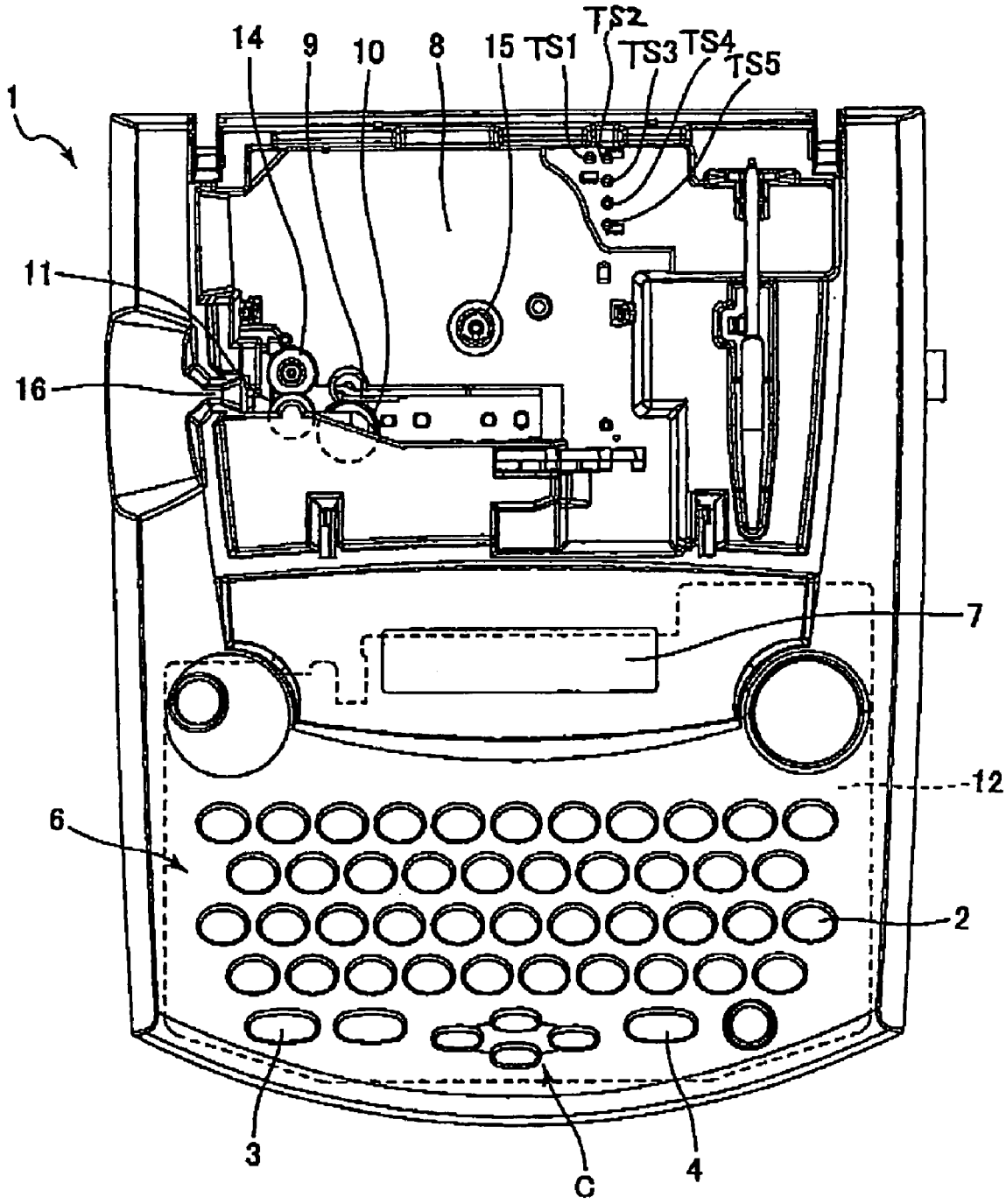
FIG. 1C is a plan view showing the tape printing device shown in FIG. 1A with a housing cover removed.

As shown in FIG. 1C, when the tape cassette 35 has been installed in the cassette housing portion 8, tape-type detection sensors TS1, TS2, TS3, TS4, and TS5, each configured of a push-button type of microswitch or the like, are provided in a location confronting a tape specification portion 40 (FIG. 3) of the tape cassette 35, to specify the type of tape that is the printing medium housed in the tape cassette 35. Each of the tape-type detection sensors TS1 to TS5 is a known mechanical switch configured of components such as a plunger and a microswitch. The presence or absence of through-holes formed in the tape specification portion 40 to correspond to the tape-type detection sensors TS1 to TS5 are detected, and the type of tape housed in the tape cassette 35 can be detected from the resultant on/off-signals. Note that in the present embodiment, the plungers of the tape-type detection sensors TS1 to TS5 protrude constantly from the base surface of the cassette housing portion 8, turning off the corresponding microswitches. When the through-holes of the tape specification portion 40 are in locations that confront the tape-type detection sensors TS1 to TS5, each microswitch is in the off state with the plunger not pressed down, and an off-signal is output therefrom. When one of the through-holes of the tape specification portion 40 is not at the location that confronts the corresponding tape-type detection sensor TS1 to TS5, on the other hand, the plunger is pressed down and thus the microswitch is in the on state, and an on-signal is output. The cassette housing portion 8 can be opened and closed by the housing cover 8A that can pivot about an axis at the rear of the tape printing device 1, enabling changing of the tape cassette 35 when in the open state.

The type of tape is specified by "tape type" and "tape width". The tape type could be a receptor (non-laminated) tape in which the surface of the print tape is not covered by a protective film, or a laminated tape in which the surface of the print tape is protected by transparent film, or a transfer tape for iron transfers done by using pressure to form letters by applying the heat of an iron. Similarly, the tape width is one of 6 mm, 9 mm, 12 mm, 18 mm, 24 mm, and so on. The energy required for printing differs with the tape type, such that the energy required for printing one dot is approximately 1.3 mJ for receptor tape, approximately 1.1 mJ for laminated tape, or approximately 0.7 mJ for transfer tape. These differences in print energy are due to the higher energy that is necessary for exposing the ink portion on the surface of receptor tape, required by the adhesiveness (abrasion resistance and solidity) of the ink to the tape surface. In addition, transfer tape necessitates primary and secondary transfers, so the necessary energy is made smaller to ensure that there is no reverse transfer due to excess energy (which would cause the processing layer of the tape surface to separate from the ribbon side during the peeling of the ribbon).

In the present embodiment, the signals of the tape-type detection sensors TS1 to TS5 indicate which of the sensor holes are present, as will be describe later. Thus, if the tape type is laminated tape and the tape width is 24 mm, the sensor TS1 sends an on-signal to indicate that the corresponding sensor hole is not detected, the sensor TS2 sends an on-signal to indicate that the corresponding sensor hole is not detected, the sensor TS3 sends an on-signal to indicate that the corresponding sensor hole is not detected, the sensor TS4 sends an off-signal to indicate that the corresponding sensor hole is detected, and the sensor TS5 sends an on-signal to indicate that the corresponding sensor hole is not detected. For the other tape types too, the relationships between the on/off-signals of the tape identification sensors TS1 to TS5 and the presence of the through-holes formed in the tape specification portion 40 are such that an on-signal means that the sensor hole is not detected and an off-signal means that the sensor hole is detected, in a similar manner. Thus, further description thereof is omitted.

Figure 2A:
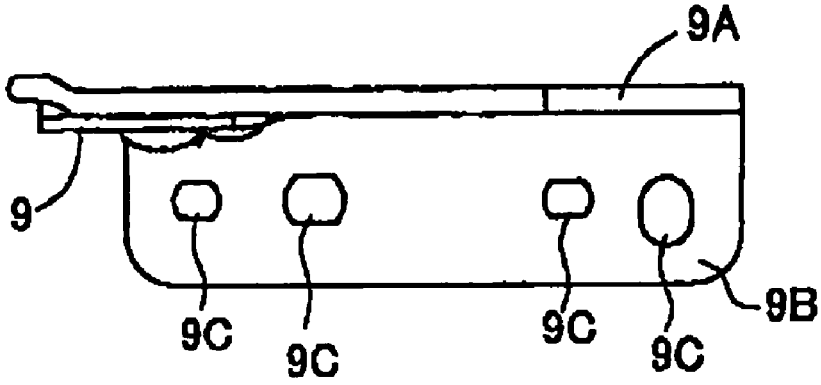
FIG. 2A is a plan view showing a thermal head of the tape printing device shown in FIG. 1A.
Figure 2B:
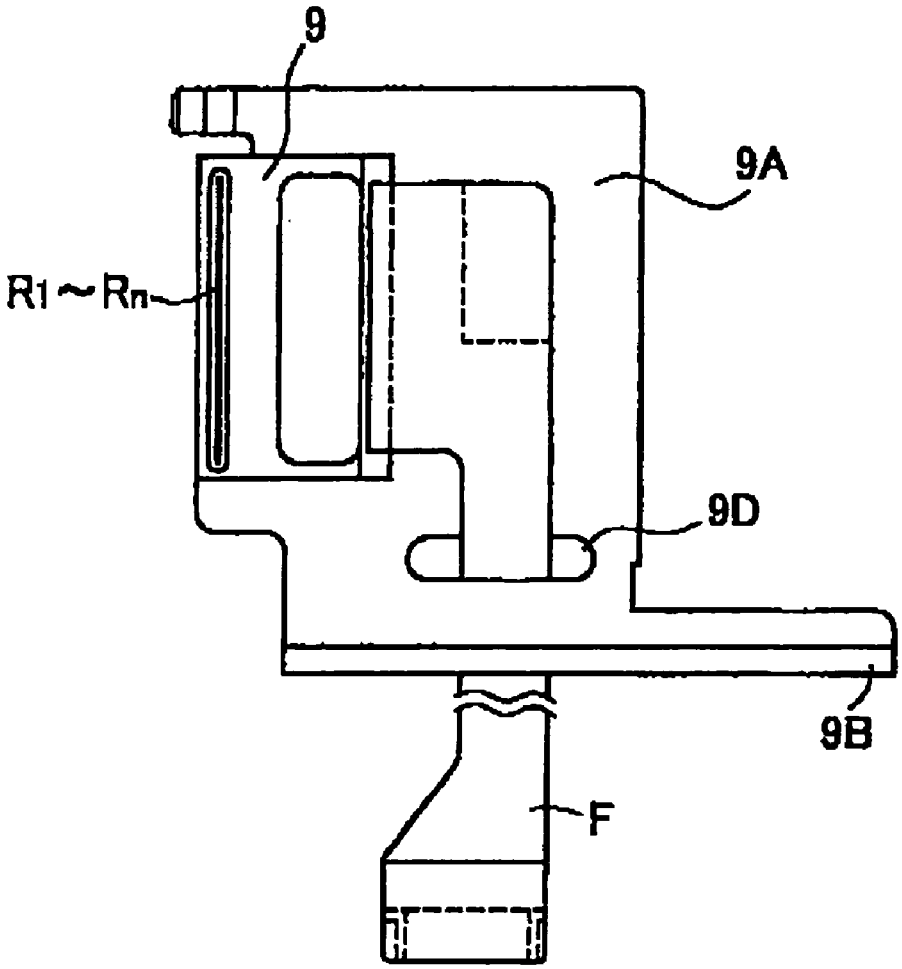
FIG. 2B is a front view showing the thermal head of FIG. 2A.

As shown in FIGS. 2A and 2B, the thermal head 9 is a thick-film head formed in a flat-plate shape of a long, substantially rectangular form. A predetermined number (128 in the present embodiment) of heating elements (heat generating elements) R1 to Rn (where n is a predetermined number) are formed on a left edge portion of the front surface of the thermal head 9, arrayed in a line along the edge of that left edge portion. One end of a flexible cable F is connected to a connector (not shown) provided on a control board and the other end thereof is connected electrically by means such as soldering to a right edge portion of the front surface of the thermal head 9. The thermal head 9 is affixed by adhesive to a left edge portion of the front surface of a substantially rectangular thermal radiation plate 9A that is formed of a plated steel plate or stainless steel plate, with the direction in which the heating elements R1 to Rn are arrayed being parallel to the left edge portion of the thermal radiation plate 9A. An upper right corner portion of the flexible cable F is affixed to the front surface of the thermal radiation plate 9A by means such as double-sided tape. One end of the flexible cable F is inserted into a horizontal, substantially rectangular through-hole 9D that is formed in a lower edge portion of the thermal radiation plate 9A and is pulled therethrough to the rear. A protruding portion 9B is formed to protrude by a predetermined width in a substantially orthogonal direction forward from a lower edge portion of the thermal radiation plate 9A, and four through-holes 9C are formed therethrough. The thermal radiation plate 9A is attached to the lower side of the cassette housing portion 8 by means such as screw stoppers through the through-holes 9C, such that the direction in which the heating elements R1 to Rn are arrayed is substantially orthogonal to the direction in which a label tape 36 (FIG. 3) is conveyed within an aperture portion 52 (FIG. 3) of the tape cassette 35.

Figures 3, 5:
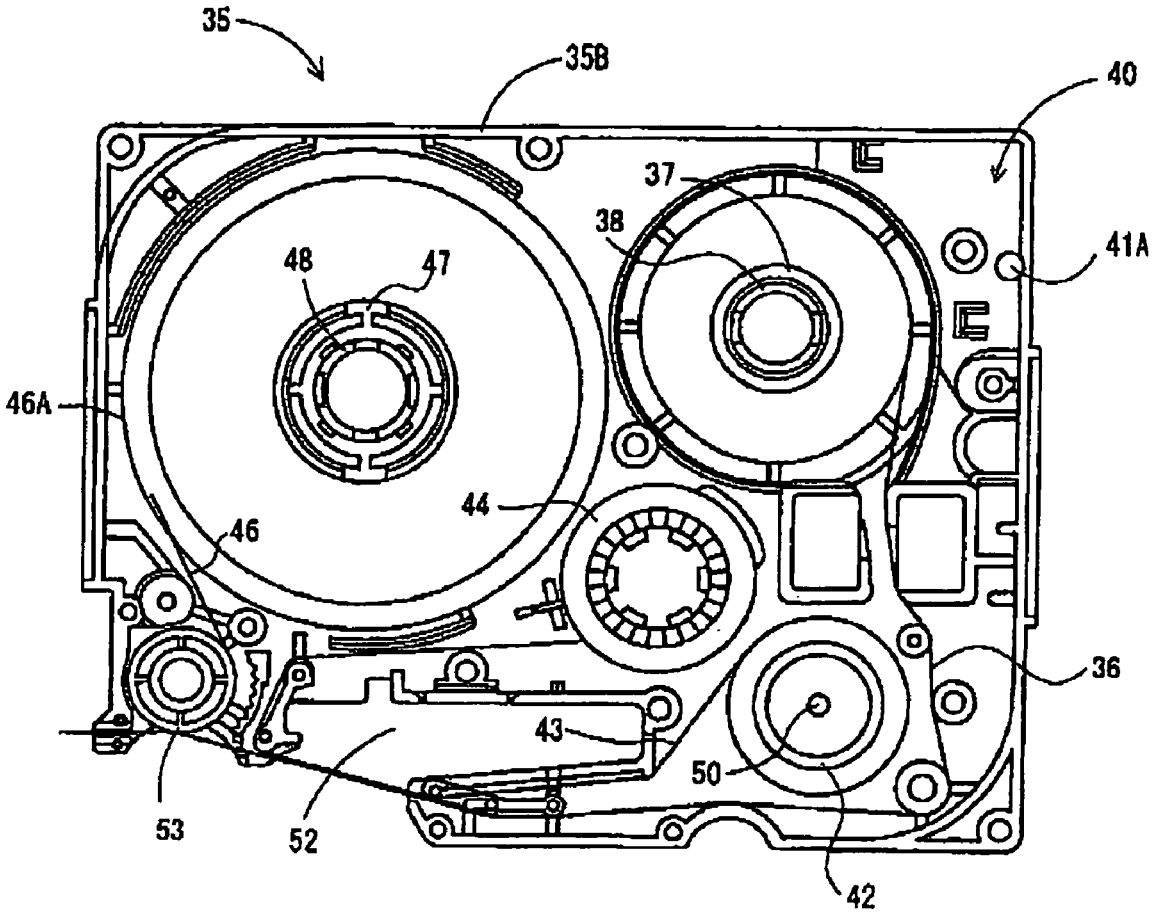
FIG. 3 is a plan view showing a tape cassette installed in the tape printing device of FIG. 1A with its cover removed.
FIG. 5 is an explanatory diagram showing data configuration of a dot count parameter table.

Next, as shown in FIG. 3, each of the print tape (label tape) 36 formed of transparent tape or the like, the ink ribbon 43 for implementing the printing onto the print tape 36, and double-sided adhesive tape 46 that is affixed to the rear of the print tape 36 that has not yet been printed is wound onto a tape spool 37, a reel 42, and a tape spool 47 which are rotatably fitted over a cassette boss 38, a reel boss 50, and a cassette boss 48 installed vertically on a base surface of the main cassette body 35B, and the ink ribbon take-up reel 44 that takes up the used ink ribbon 43 is also provided.

The unused part of the ink ribbon 43 that is wound onto the reel 42 and is drawn out from the reel 42 is laid over the print tape 36, is passed through the aperture portion 52 together with the print tape 36, and is passed between the thermal head 9 and the platen roller 10. The ink ribbon 43 is subsequently peeled off from the print tape 36, reaches the ink ribbon take-up reel 44 that is driven in rotation by the ink ribbon take-up shaft 15, and is wound up by the ink ribbon take-up reel 44.

The double-sided adhesive tape 46 is laid on removable paper and is wound in that state onto the tape spool 47 with the removable paper on the outer side, for storage. The double-sided adhesive tape 46 that is drawn out from the tape spool 47 passes between the tape drive roller 53 and the tape feed roller 11, and the side thereof that is not overlaid by the removable paper is affixed to the print tape 36. A spacer 46A is inserted into both upper and lower edge portions of the double-sided adhesive tape 46.

This ensures that the print tape 36 that was wound onto the tape spool 37 and has been drawn out from the tape spool 37 passes through the aperture portion 52 into which the thermal head 9 of the tape cassette 35 is inserted. The print tape 36 onto which the double-sided adhesive tape 46 has been pasted is subsequently provided in a freely rotatable manner in a lower portion of one side of the tape cassette 35 (the lower left side in FIG. 3), passes through between the tape drive roller 53 that is driven in rotation by the tape feed motor 30 and the tape feed roller 11 that confronts the tape drive roller 53, and is fed out from the tape cassette 35 to be discharged from the label discharge aperture 16 of the tape printing device 1. In that case, the double-sided adhesive tape 46 is pressed against the label tape 36 by the tape drive roller 53 and the tape feed roller 11.

When the tape cassette 35 is mounted in the cassette housing portion 8, the tape specification portion 40 is disposed in a corner portion of the base portion of the main cassette body 35B (the top right corner portion in FIG. 3) confronting the tape-type detection sensors TS1 to TS5, with a through-hole 41A formed therein and into which the tape-type detection sensor TS4 is inserted being at a location confronting the tape-type detection sensor TS4. This ensures that the tape-type detection sensor TS4 outputs an off-signal and each of the tape-type detection sensors TS1, TS2, TS3, and TS5 outputs an on-signal, enabling the device to detect that the tape type housed in the tape cassette 35 is a predetermined laminated tape of a tape width of 24 mm.

Figure 4:
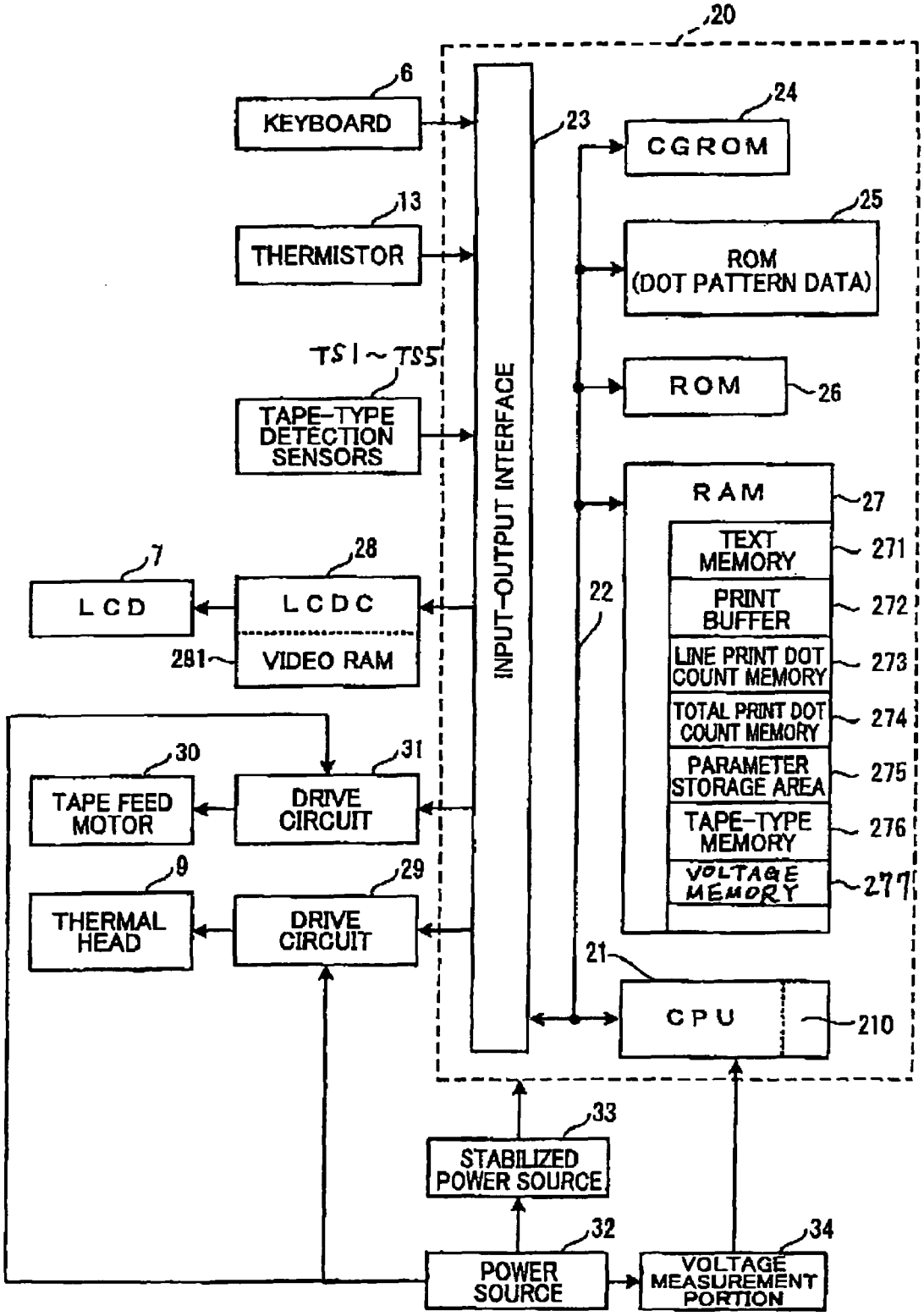
FIG. 4 is a block diagram showing a control configuration of the tape printing device.

Next, a control (electrical) configuration of the tape printing device 1 will be described while referring to FIG. 4. As shown in FIG. 4, the control configuration of the tape printing device 1 is mainly configured of a control circuit 20 that is formed on the control board 12. The control circuit 20 includes a CPU 21 that controls the various components, and an input-output interface 23, the CGROM (character generator ROM) 24, ROMs 25 and 26, and a RAM 27 that are connected to the CPU 21 by a data bus 22. A timer 210 is provided within the CPU 21.

Dot pattern data for displaying each of a large number of characters is stored in the CGROM 24 in correspondence to code data.

Dot pattern data for printing is classified for each of various fonts (such as Gothic or Japanese Mincho fonts), for a large number of characters for printing characters such as alphabetics or symbols, and the corresponding print character sizing and code data for six versions (16, 24, 32, 48, 64, and 96 dot sizes) for each font are stored within the ROM (dot pattern data memory) 25. Graphic pattern data for printing graphic images, including grayscale representation, is also stored therein.

Various programs are stored in the ROM 26, such as a display drive control program that controls an LCDC (LCD controller) 28 in accordance with code data for characters such as alphanumerics that have been input from the keyboard 6, a print drive control program that reads data out of a print buffer 272 and drives the thermal head 9 and the tape feed motor 30, a pulse count determination program that determines the number of pulses corresponding to the amount of energy for forming each print dot, and a drive control program for the heating elements R1 to Rn of the thermal head 9, which will be described later. In addition, various programs necessary for the control of the tape printing device 1 are stored therein. The CPU 21 is designed to perform various calculations based on the various programs stored in the ROM 26.

Furthermore, areas such as a text memory 271, the print buffer 272, a line print dot count memory 273, a total print dot count memory 274, a parameter storage area 275, a tape-type memory 276, and a voltage measurement value memory (voltage memory) 277 are provided in the RAM 27, and document data that has been input from the keyboard 6 is stored in the text memory 271. Data such as dot patterns for printing a plurality of characters and symbols and numbers of application pulses that indicate the amount of energy for forming each dot is stored as dot pattern data in the print buffer 272. The thermal head 9 prints dots in accordance with the dot pattern data stored in the print buffer 272. The print dot count for one line (128 dots in the present embodiment) to be printed by the thermal head 9 is stored in the line print dot count memory 273. The total print dot count from start-up to be printed by the thermal head 9 is stored in the total print dot count memory 274. Various different parameter tables are stored in the parameter storage area 275, as will be described later. The tape types detected by the tape-type detection sensors for the previous time and the current time are stored in the tape-type memory 276. The voltage measurement value detected by the voltage measurement portion 34 for the previous time and the current time are stored in the voltage measurement value memory 277.

The keyboard 6, the thermistor 13, the LCDC 28 having a video RAM 281 for outputting display data to the LCD 7, a drive circuit 29 for driving the thermal head 9, and a drive circuit 31 for driving the tape feed motor 30 are each connected to the input-output interface 23. Thus, when characters or the like have been input by the character keys of the keyboard 6, the text (document data) is sequentially stored in the text memory 271 and also dot patterns corresponding to the characters that have been input through the keyboard 6 are displayed on the LCD 7, based on a dot pattern generation control program and a display drive control program. The thermal head 9 is driven through the drive circuit 29 to print the dot pattern data stored in the print buffer 272, and the tape feed motor 30 implements control through the drive circuit 31 over the feeding of the tape, in synchronization therewith. The thermal head 9 prints characters or the like on the tape, by driving the heating elements R1 to Rn through the drive circuit 29 to selectively generate heat in correspondence to one line of print dots.

A power source 32 supplies the control circuit 20, the drive circuit 29, and the drive circuit 31 with electrical power. The voltage of the power source 32 is measured at predetermined intervals by a voltage measurement portion 34. The power source 32 is connected to a stabilized power source 33 that outputs a constant voltage.

In addition, the power source 32 is connected to the drive circuit 29 of the thermal head 9 and the drive circuit 31 of the tape feed motor 30, and the electrical power of the power source 32 is supplied thereto directly. The stabilized power source 33, on the other hand, is connected to the control circuit 20 and supplies a constant (stabilized) voltage obtained from the electrical power of the power source 32 to the control circuit 20, including the LCD 7. Note that the power source 32 could also be a battery power source or a DC power source from an AC adapter to which a commercial power supply is input, where the AC input is rectified and stepped down to form a DC output.

The voltage measurement portion 34 is connected to the CPU 21 of the control circuit 20 to measure the voltage of the power source 32 and to output the measurement result to the CPU 21.

Next, parameter tables stored in the parameter storage area 275 will be described while referring to FIGS. 5 to 8. Note that parameters in the parameter tables are originally stored in the ROM 26, and are loaded onto the parameter storage area 275 in the RAM 27.

As shown in FIG. 5, the dot count parameter table 61 includes an ambient temperature 611 indicating the temperature measured through the thermistor 13, a total amount 612 corresponding to the ambient temperature 611, and a discharge amount 613. The total amount 612 is the maximum total number of dots that can be printed continuously, determined in accordance with factors such as the ambient temperature. The total amount 612 represents a heat buildup temperature that guarantees there is no likelihood of faults such as fattening of the dots printed by the heating elements R1 to Rn of the thermal head 9 during continuous printing, as will be described later. The discharge amount 613 is the number of dots to subtract from the total print dot count every predetermined time period (approximately every second in the present embodiment), as will be described later. The discharge amount 613 is a number of print dots that is determined by factors such as (1) the properties, shape, and dimensions of the thermal head 9, (2) the properties, shape, and dimensions of the thermal radiation plate 9A, (3) the properties and thickness of the adhesive between the thermal head 9 and the thermal radiation plate 9A, (4) the method of connection between the thermal radiation plate 9A and the tape printing device 1, (5) the properties, shape, and dimensions of the mechanical frame, and (6) the ambient temperature. The discharge amount 613 represents the amount of natural thermal radiation through components such as the thermal radiation plate 9A of the thermal head 9, as will be described later.

Three different ambient temperature ranges are stored beforehand for the ambient temperature 611 of the dot count parameter table 61: "greater than or equal to 30° C.", "greater than or equal to 20° C. and less than 30° C.", and "less than 20° C.". The total amounts 612 corresponding to the ambient temperatures 611 are stored previously, as "250000 dots" for the ambient temperature 611 of "greater than or equal to 30° C.", "300000 dots" for the ambient temperature 611 of "greater than or equal to 20° C. but less than 30° C.", and "460000 dots" for the ambient temperature 611 of "less than 20° C.". Similarly, the discharge amounts 613 corresponding to the ambient temperatures 611 are stored beforehand, as "1800 dots" for the ambient temperature 611 of "greater than or equal to 30° C.", "2000 dots" for the ambient temperature 611 of "greater than or equal to 20° C. but less than 30° C.", and "2600 dots" for the ambient temperature 611 of "less than 20° C.". Note that the total amount 612 and discharge amount 613 corresponding to each ambient temperature 611 are parameters that can be modified to any numerical value to correspond to any change such as a change in the amount of natural thermal radiation of the thermal head 9 caused by a design change in shape of the thermal radiation plate 9A.

As shown in FIG. 6, the heat buildup coefficient table 62 stores an excess dot count 621 and a heat buildup coefficient d that is determined in correspondence with an ambient temperature 622 measured by the thermistor 13. The excess dot count 621 is a portion of the current total dot count in excess of the total amount 612 (the reference value). In other words, the excess dot count 621 is a difference between the current total dot count and the total amount 612 which was obtained from the dot count parameter table 61 (FIG. 5). The reference value for obtaining the excess dot count 621 uses the value of the "total amount" determined by the dot count parameter table 61. The ambient temperature 622 is divided into five ranges: "40 to 32° C.", "31 to 28° C.", "27 to 22° C.", "21 to 17° C.", and "16 to 10° C.". Each heat buildup coefficient d is determined in correspondence with the range and the excess dot count 621. The heat buildup coefficient d is used in the re-evaluation of the application energy for the heating elements during heat buildup control processing that will be described later, and is used for determining the value to be subtracted for correcting the application energy in correspondence to the accumulated temperature of the thermal head 9.

For the same excess dot count 621, the value of the heat buildup coefficient d increases as the ambient temperature 622 rises, and for the same ambient temperature 622, the value of the heat buildup coefficient d increases as the excess dot count rises. Therefore, in a heat buildup state in which the ambient temperature 622 rises and the excess dot count 621 also rises, the value of the heat buildup coefficient d increases and thus adjustment is performed to shorten an ON time (a duration in which a voltage is applied) and ensure that heat buildup print fattening does not occur.

Note that the heat buildup coefficient d is subjected to such correction both when the temperature is rising (during unsteady-state operation) and when the temperature is saturated (during steady-state operation).

As shown in FIG. 7, the voltage change coefficient table 63 is for determining a voltage change coefficient C(V) 633. The voltage change coefficient C(V) 633 is a constant to be used to change the width of pulses in accordance with the voltage. The voltage change coefficient C(V) 633 is used to determine the energy to be applied to each heating element. The voltage change coefficient table 63 includes a voltage center value 631, a voltage range 632 (hexadecimal data) corresponding thereto, and the voltage change coefficient C(V) 633 corresponding to the voltage range 632. In FIG. 7, the value of the voltage change coefficient C(V) is given as hexadecimal data. As a voltage value is higher, the ON time required for heating becomes shorter, and thus the voltage change coefficient C(V) 633 increases as the voltage value 631 or 632 increases. Since the control is applied such that the heating elements are turned off when the subtraction of the value of C(V) from the reference value reaches zero, the applied energy is adjusted such that the application time of the drive pulses becomes shorter as the voltage increases.

As shown in FIG. 8, the correction coefficient table 64 is a table for determining a coefficient d1. The coefficient d1 corrects or modifies the heat buildup coefficient d in accordance with the voltage value and the tape type that has been installed. The correction coefficient table 64 includes a voltage center value 641, a voltage range 642 (hexadecimal data) corresponding thereto, and a correction coefficient d1 643 expressed as a percentage. Since the ON time becomes shorter as the voltage increases, the correction coefficient d1 becomes smaller than 100% and also the difference in print energy required by the tape-type difference affects the heat buildup status. Thus the receptor tape that is a type of tape with a large energy requirement uses the correction coefficient d1 that is larger and the ON time that is shorter, for the same voltage value.

Figure 9:
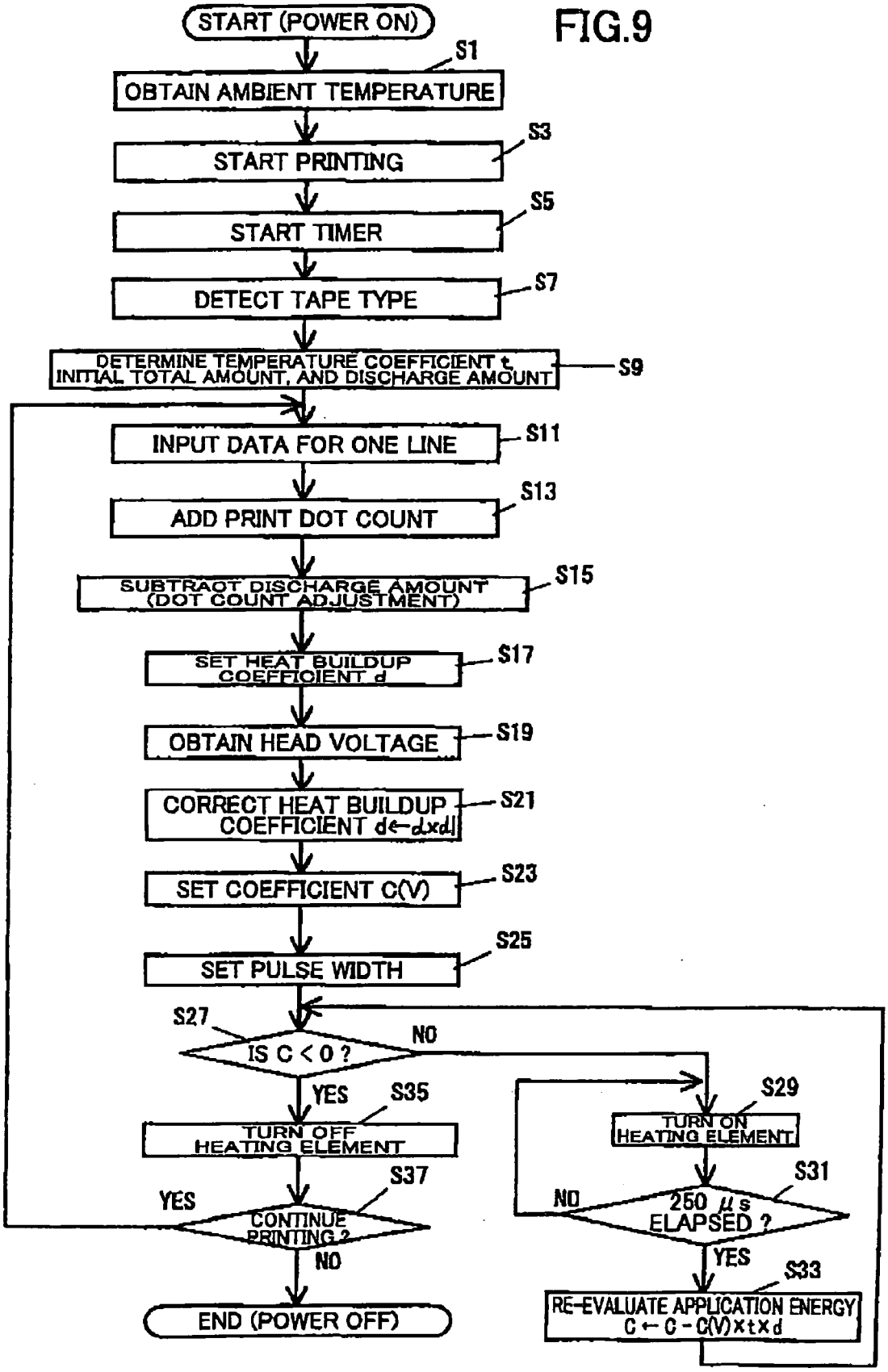
FIG. 9 is a flowchart showing the steps of heat buildup control processing to be executed by the tape printing device according to a first embodiment of the disclosure.

A tape printing operation to be executed by the tape printing device 1 according to a first embodiment will be described while referring to the flowchart shown in FIG. 9.

First, when the power is turned on and the processing of the tape printing device 1 starts, in S1 the CPU 21 obtains the ambient temperature from the thermistor 13. In S3 printing starts in accordance with a direction from a user. In S5 the timer 210 starts counting together with the start of printing. In S7 the CPU 21 detects the tape type of the tape cassette 35 that is installed in the tape printing device 1 based on signals from the tape-type detection sensors, and stores the tape type in the tape-type memory 276.

In S9 the CPU 21 determines the temperature coefficient t, the initial total amount (reference dot count), and the discharge amount, based on the ambient temperature obtained in S1. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. The total amount and discharge amount corresponding to the ambient temperature are determined in accordance with the dot count parameter table 61 that is stored in the parameter storage area 275. The total amount and the discharge amount are stored in the total print dot count memory 274 of the RAM 27.

In S11 the CPU 21 inputs data for one line of data to be printed, and stores the corresponding dot count for that one line portion in the line print dot count memory 273 that is part of the RAM 27. In S13 the CPU 21 adds the dot count for one line portion, which was stored in the line print dot count memory 273 in S11, to the total amount determined in S9, to calculate the total dot count D. In S15 a value equal to the discharge amount determined in S9 multiplied by the time elapsed since the start of printing is subtracted from the total dot count D to adjust the dot count. Here, the start of printing means a time point at which the user pushed a print-start button of the tape printing device 1. The processing of S13 and S15 calculates the total dot count D by adding the number of dots to be printed from now onward to the total amount determined in S9, then subtracting a value obtained by multiplying the discharge amount determined in S9 by the elapsed time since the start of printing (total dot count=total amount+print dot count−(discharge amount× elapsed time)). In this way, the heat buildup status of the thermal head 9 can be expressed as a number of dots by adding the print dot count then performing adjustment, by converting the amount of thermal radiation into a dot count and subtracting that value from the total dot count. As shown in the flowchart of FIG. 9, the print dot count is added in S13 each time data for one line is inputted. Thus, when a plurality of lines is printed, the print dot count is added successively each time the processing goes through S13. The same goes for other embodiments described later.

In S17 the CPU 21 sets the heat buildup coefficient d, based on an excess dot count and the ambient temperature that was obtained in S1. The excess dot count is the difference between the current total dot count D that was adjusted in S15 and a reference dot count (the initial value of the total amount that was set in S9). The heat buildup coefficient d is determined in accordance with the heat buildup coefficient table 62 stored in the parameter storage area 275. During the first round of processing, the difference between the current total dot count D and the reference dot count is less than 50000, so the heat buildup coefficient d is set to 1 regardless of the ambient temperature.

In S19 the CPU 21 obtains the voltage applied to the thermal head 9 from the voltage measurement portion 34. In S21 the CPU 21 sets the correction coefficient d1 based on the thus-obtained voltage and the tape type obtained in S7. If the tape type is receptor tape and thus the voltage value is 6.0, for example, the correction coefficient d1 is 100%.

In S23 the CPU 21 sets the voltage change coefficient C(V) based on the voltage obtained in S19. The voltage change coefficient C(V) is determined in accordance with the voltage change coefficient table 63 stored in the parameter storage area 275 and is used during the setting of the application energy (pulse width) as will be described later.

In S25 the CPU 21 sets the pulse width (ON time) to be applied to each heating element, by substituting a predetermined value into an application control coefficient C. A predetermined fixed value is substituted into the application control coefficient C. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S27 the CPU 21 determines whether the application control coefficient C has become less than zero. If the application control coefficient C is greater than or equal to 0 (S27: NO), in S29 drive pulses are applied to turn the heating elements on. In S31 the CPU 21 determines whether 250 microseconds have elapsed. The application of the drive pulses continues (S29) until 250 microseconds have elapsed (S31: NO).

When 250 microseconds have elapsed (S31: YES), in S33 the CPU 21 re-calculates the application control coefficient C to determine whether the application of drive pulses should continue, and determines the amount of energy that should be applied subsequently. The re-evaluation of the application energy is in accordance with a formula $C \leftarrow C - C(V) \times t \times d$. The voltage change coefficient C(V) increases as the voltage increases, the temperature coefficient t increases as the ambient temperature increases, and the value of the heat buildup coefficient d increases as the excess dot count and ambient temperature increase. Thus the value derived by multiplying all these elements becomes larger as the ambient temperature increases and heat buildup of the thermal head 9 progresses because of continued printing, and the value also increases as the application time of the main pulses becomes longer. Since the value obtained by subtracting the multiplication result from the application control coefficient C is taken as the new value of C, the result is that the application control coefficient C will become smaller when heat buildup progresses.

In other words, since the application control coefficient C approaches zero faster, the ON time of each heating element is shortened, and the occurrence of print fattening can be avoided. If the voltage is low, the correction coefficient d1 is close to 100% and thus the heat buildup control is greater and print fattening is avoided. However, if the voltage is high, the correction coefficient d1 becomes less than 100% and thus there is no blurring due to excessive heat buildup control. In addition, since the correction coefficient d1 decreases slowly even when the voltage becomes higher with receptor tape that requires a high print energy, the heat buildup control can be increased and the pulse width shortened for tapes in which heat buildup can easily progress.

Subsequently, the process returns to S27, and the CPU 21 again determines whether the application control coefficient C after the calculation of S33 has become less than zero. When the application control coefficient C becomes less than zero (S27: YES), in S35 the heating elements are turned off for a predetermined time to cool the thermal head 9. In S37 the CPU 21 then determines whether printing is continued and, if printing is continued (S37: YES), the process returns to S11 and the next one line of data is input. If printing is not continued (S37: NO), the processing ends.

As described above, since the tape printing device 1 of the present embodiment uses the correction coefficient d1 that is determined by the currently installed tape type and the voltage applied to the thermal head 9, heat buildup information can be obtained as appropriate even when printing on tapes that have different print energy requirements. In addition, the heat buildup status can be determined accurately and print fattening avoided, even when printing under conditions of long ON times, such as under the low voltage condition.

When an alkaline battery is used as a power source and if the heat buildup is calculated without considering a voltage difference of the power sources, printing is often performed at a comparatively low voltage and thus the ON time tends to be longer. This would increases an amount of heat buildup more than when a different type of power source such as an AC adapter is used, making it more likely that print fattening will occur. However, such problem can be avoided according to the tape printing device 1 of the present embodiment.

A correction coefficient table used in a tape printing operation according to a second embodiment will be described while referring to FIG. 10.

As shown in FIG. 10, the correction coefficient table 164 is a table for determining a correction coefficient M for correcting the heat buildup coefficient d by using sub-pulses. The correction coefficient table 164 is configured of a main pulse width 1641, a number of loops 1642 for main pulses, and the correction coefficient M 1643. Since the main pulse width 1641 is determined in the present embodiment by re-evaluating the applied energy every 250 microseconds and determining the time during which pulses are to be applied to the heating elements, the correction coefficient M 1643 is determined in correspondence to the number of loops 1642 for the period. The correction coefficient M increases as the number of loops increases. Thus, when the time of application of the main pulses becomes longer and heat buildup progresses, the time of application of the sub-pulses is shortened so that print fattening does not occur. The correction coefficient M 1643 is a parameter that is preset but can be modified in accordance with the type of the thermal head 9 and other environmental factors. With the present embodiment, the correction coefficient M 1643 becomes greater as the main pulse width 1641 becomes larger, but the correction coefficient M 1643 may also be a fixed value such as 1.25, for example.

Figure 11:
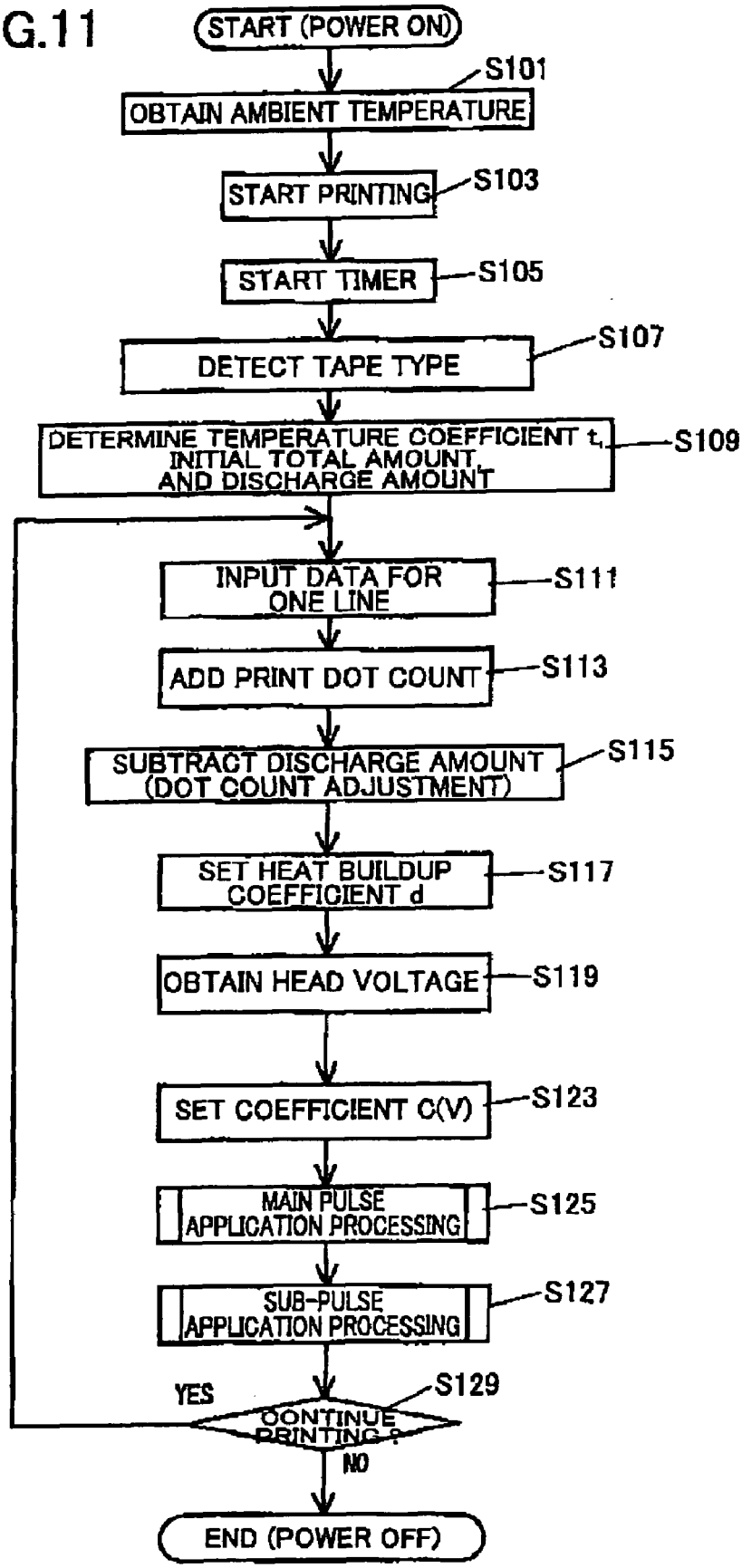
FIG. 11 is a flowchart showing the steps of heat buildup control processing to be executed by the tape printing device according to a second embodiment of the disclosure.
Figure 12:
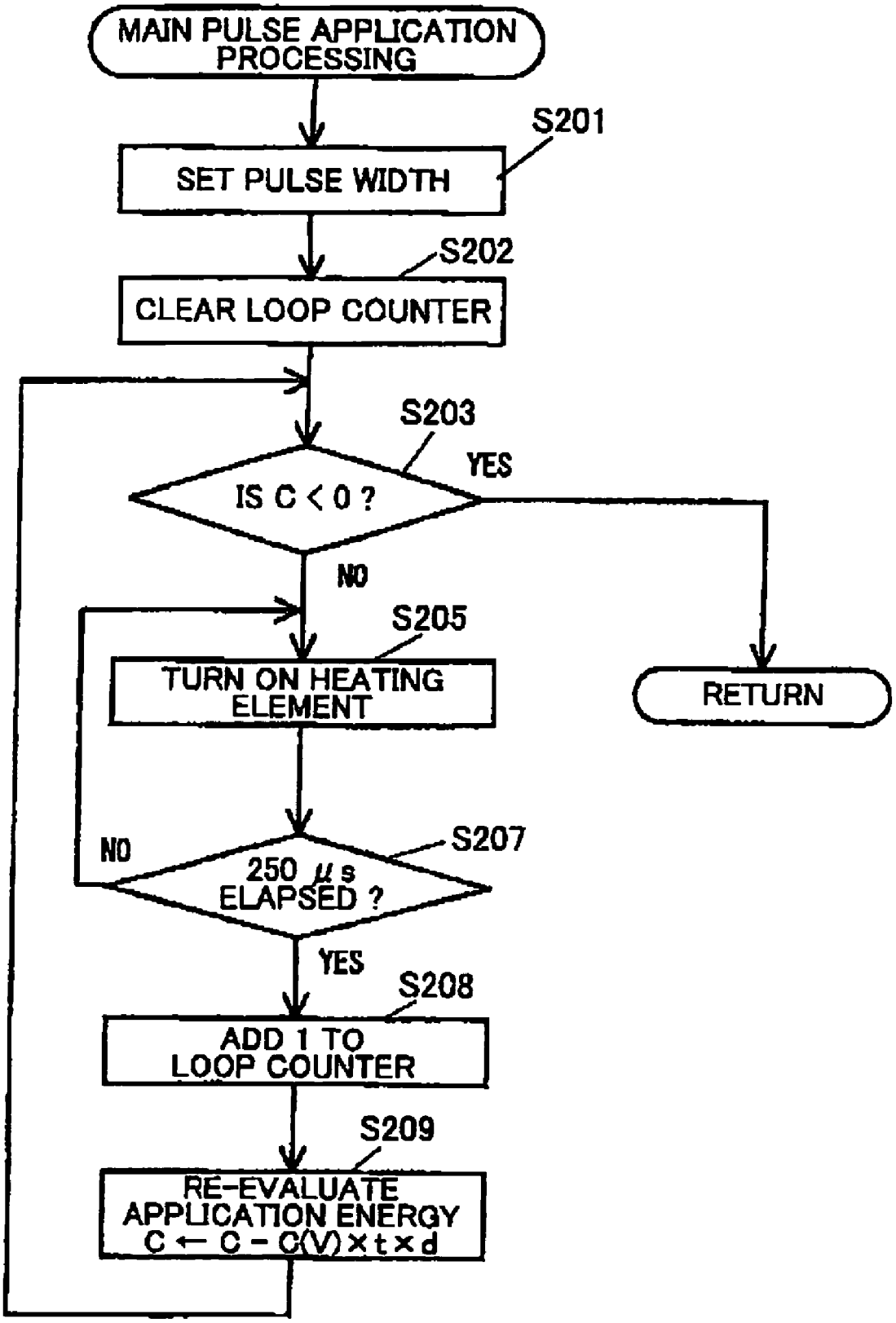
FIG. 12 is a flowchart showing the steps of main pulse application processing subroutine that is executed in the heat buildup control processing of FIG. 11.
Figure 13:
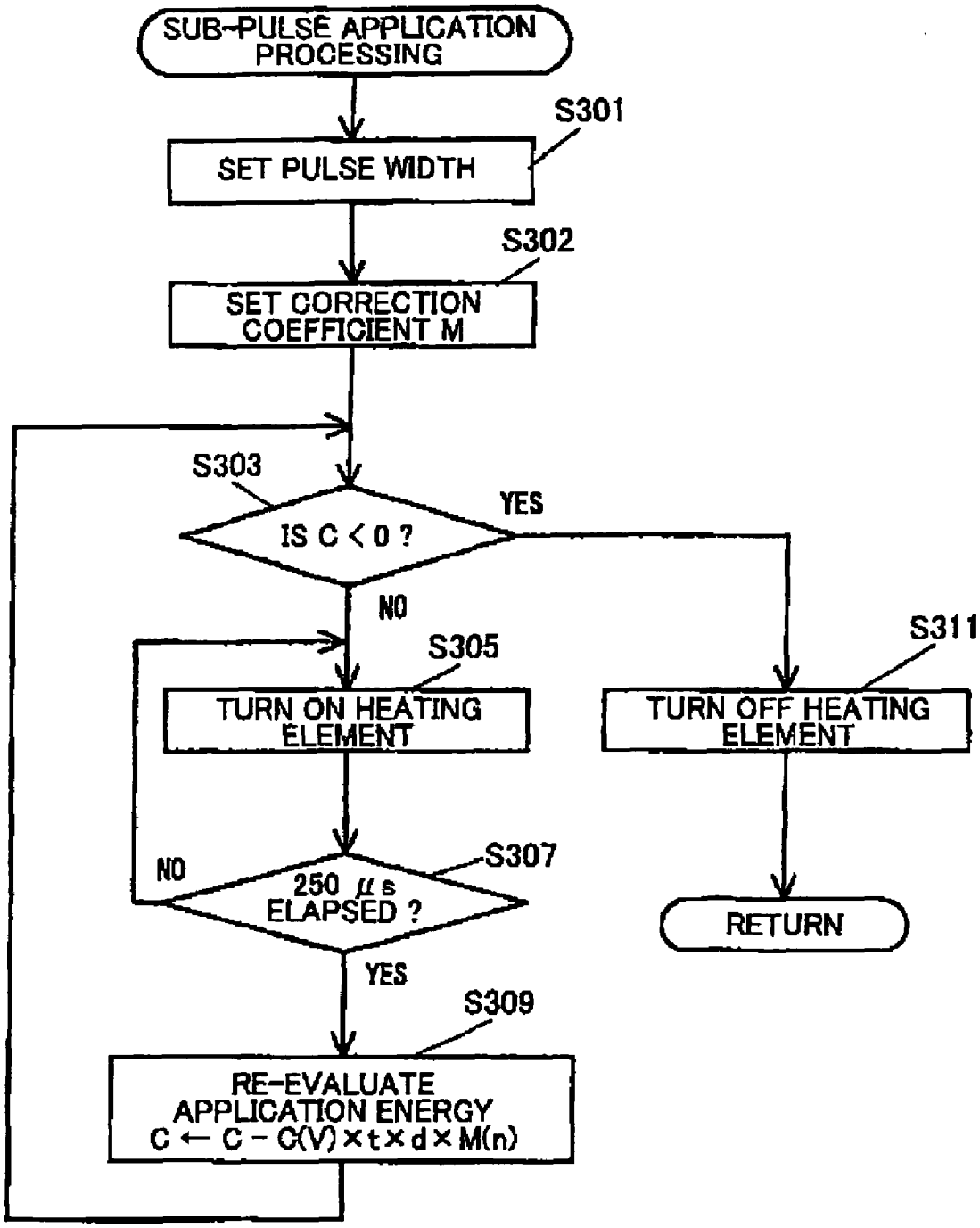
FIG. 13 is a flowchart showing the steps of sub-pulse application processing subroutine that is executed in the heat buildup control processing of FIG. 11.

The tape printing operation of the tape printing device 1 according to the second embodiment will be described while referring to the flowcharts of FIGS. 11 to 13.

When the power is turned on and the processing of the tape printing device 1 starts, in S101 the CPU 21 obtains the ambient temperature from the thermistor 13. In S103 printing starts in accordance with a direction from the user. In S105 the timer 210 starts counting together with the start of printing. In S107 the CPU 21 detects the tape type of the tape cassette 35 that is installed in the tape printing device 1, based on signals from the tape-type detection sensors.

In S109 the CPU 21 determines the temperature coefficient t, the initial total amount (reference dot count), and the discharge amount, based on the ambient temperature obtained in S101. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. The total amount and discharge amount corresponding to the ambient temperature are determined in accordance with the dot count parameter table 61 (FIG. 5) that is stored in the parameter storage area 275. The total amount and the discharge amount are stored in the total print dot count memory 274 of the RAM 27.

In S111 the CPU 21 inputs data for one line of data to be printed, and stores the corresponding dot count for the one line portion in the line print dot count memory 273 that is part of the RAM 27. In S113 the CPU 21 adds the dot count for one line portion, which was stored in the line print dot count memory 273 in S111, to the total amount determined in S109, to calculate the total dot count D. In S115 a value equal to the discharge amount determined in S109 multiplied by the time elapsed since the start of printing is subtracted from the total dot count D calculated in S113, to adjust the dot count. The processing of S113 and S115 calculates the total dot count D by adding the number of dots to be printed from now onward to the total amount determined in S109, then subtracting a value obtained by multiplying the discharge amount determined in S109 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the print dot count.

In S117 the CPU 21 sets the heat buildup coefficient d, based on an excess dot count, which is the difference between the current total dot count D that was adjusted in S115 and a reference dot count (the initial value of the total amount that was set in S109), and the ambient temperature that was obtained in S101. The heat buildup coefficient d is determined in accordance with the heat buildup coefficient table 62 (FIG. 6) stored in the parameter storage area 275. During the first round of processing, the difference between the current total dot count D and the reference dot count is less than 50000, so the heat buildup coefficient d is set to 1 regardless of the ambient temperature.

In S119 the CPU 21 obtains the voltage to be applied to the thermal head 9 from the voltage measurement portion 34. In S123 the CPU 21 sets the voltage change coefficient C(V) based on the thus-obtained voltage. The voltage change coefficient C(V) is determined in accordance with the voltage change coefficient table 63 stored in the parameter storage area 275. The voltage change coefficient C(V) is used during the main pulse application processing and the sub-pulse application processing as will be described later.

In S125 the CPU 21 executes the main pulse application processing that sets the main pulses to be applied to the heating elements. Details of the main pulse application processing will be given later, while referring to FIG. 12. When the pulse application processing ends in S127, the sub-pulse application processing that sets the sub-pulses is executed. Details of the sub-pulse application processing will be given later, while referring to FIG. 13. When the sub-pulse application processing ends, in S129 the CPU 21 determines whether printing is continued and, if printing is continued (S129: YES), the process returns to S11 and the next one line of data is input. If printing is not continued (S129; NO), the processing ends.

The main pulse application processing to be executed in S125 of FIG. 11 will be described while referring to FIG. 12. In S201 the CPU 21 sets the pulse width (ON time) to be applied to each heating element, by substituting a predetermined value into an application control coefficient C. The value that is substituted into the application control coefficient C is a predetermined fixed value that corresponds to the thermal head 9 and the tape type that was obtained in S107. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S202 the CPU 21 clears a loop counter L. The loop counter L is designed to count the number of executions for the re-evaluation of energy application every 250 microseconds, as will be described later. In S203 the CPU 21 determines whether the application control coefficient C has become less than zero. If the application control coefficient C is greater than or equal to 0 (S203: NO), in S205 drive pulses are applied to turn the heating elements on. In S207 the CPU 21 determines whether 250 microseconds have elapsed. The application of the drive pulses continues (S205) until 250 microseconds have elapsed (S207: NO).

When 250 microseconds have elapsed (S207; YES), in S208 the CPU 21 adds 1 to the loop counter L. In S209 the CPU 21 re-calculates the application control coefficient C to determine whether the application of drive pulses should continue, and determines the amount of energy that should be applied subsequently. The re-evaluation of the application energy is in accordance with a formula C←C−C (V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. When the application control coefficient C becomes less than zero in S203, the main pulse application processing ends and the process proceeds to the sub-pulse application processing. Hence the ON time can be shortened when heat buildup is progressing and thus the occurrence of print fattening can be avoided.

Subsequently, the process returns to S203, and the CPU 21 again determines whether the application control coefficient C after the calculation of S209 has become less than zero. When the application control coefficient C becomes less than zero (S203: YES), the process returns to the main routine for heat buildup control shown in FIG. 11.

The sub-pulse application processing to be executed in S127 of FIG. 11 will be described in greater detail while referring to FIG. 13. Note that sub-pulses are applied to the heating elements when the previous line is not printed, in order to assist the main pulse. In S301 the CPU 21 sets the pulse width (ON time) to be applied to each heating element, by substituting a predetermined value into the application control coefficient C. This is a predetermined fixed value corresponding to the thermal head 9 and the tape type that was obtained in S107. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. Note that the application control coefficient C is used both in the main pulse control and in the sub-pulse control. For the sub-pulse control, a value smaller than that used for the main pulse control is used. For example, a value of 22000 is substituted into the application control coefficient C for the sub-pulse control in S301.

In S302 the CPU 21 reads the value of the loop counter L and sets the correction coefficient M from the correction coefficient table 164. For example, if the applied energy re-evaluation processing every 250 microseconds has been performed three times by the main pulse application processing, the correction coefficient M is 1.03.

In S303 the CPU 21 determines whether the application control coefficient C has become less than zero. If the application control coefficient C is greater than or equal to 0 (S303: NO), in S305 drive pulses are applied to turn the heating elements on. In S307 the CPU 21 determines whether 250 microseconds have elapsed. The application of the drive pulses continues (S305) until 250 microseconds have elapsed (S307: NO).

When 250 microseconds have elapsed (S307: YES), in S309 the CPU 21 re-calculates the application control coefficient C to determine whether the application of drive pulses should continue, and determines the amount of energy that should be applied subsequently. The re-evaluation of the application energy is in accordance with a formula C←C−C(V)×t×d×M(n). The voltage change coefficient C(V) increases as the voltage increases, the temperature coefficient t increases as the ambient temperature increases, the value of the heat buildup coefficient d increases as the excess dot count and ambient temperature increase, and the value of the correction coefficient M increases as the width of the main pulses increases. Thus the value derived by multiplying all these elements becomes larger as the ambient temperature increases and heat buildup of the thermal head 9 progresses because of continued printing, and the value also increases as the application time of the main pulses becomes longer. Since the value obtained by subtracting the multiplication result from the application control coefficient C is taken as the new value of C, the result is that the application control coefficient C will become smaller when heat buildup progresses and also the ON time of the main pulses is longer. When the application control coefficient C becomes less than zero in S303, the application of sub-pulses to the heating elements ends. This means that the ON time becomes shorter and the occurrence of print fattening can be avoided when heat buildup progresses and also when the ON time of the main pulses is long enough that auxiliary heating is not necessary.

Subsequently, the process returns to S303, and the CPU 21 again determines whether the application control coefficient C after the calculation of S309 has become less than zero. When the application control coefficient C becomes less than zero (S303: YES), in S311 the heating elements are turned off for a predetermined time to cool the thermal head 9. The flow returns to the main routine for heat buildup control shown in FIG. 11.

As described above, the tape printing device 1 of the present embodiment corrects the value of the heat buildup coefficient d for the sub-pulses by the correction coefficient M that becomes greater as the pulse width of the main pulses becomes larger, to determine the width of the sub-pulses and thus implement auxiliary heating of the heating elements. Accordingly, when auxiliary heating to avoid print blurring is unnecessary as the heat buildup progresses and ON time of the main pulses is sufficiently long, the width of the sub-pulses can be shortened to reduce the ON time thereof. Thus, print fattening due to excessive auxiliary heating under history control can be avoided, even when printing a pattern in which all of the heating elements are used intermittently, such as a bar code.

Figure 14A:
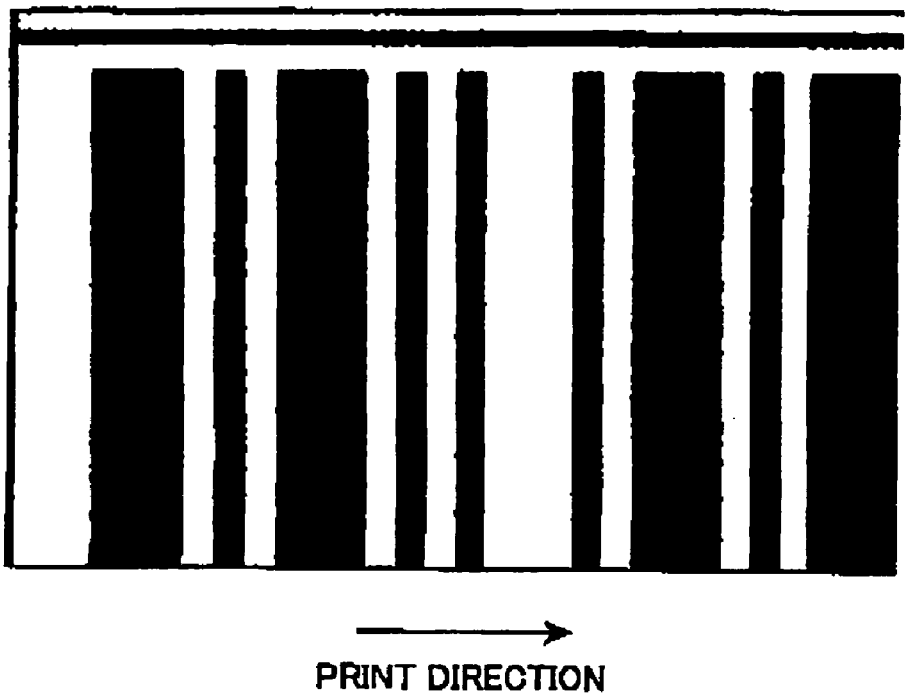
FIG. 14A is an explanatory diagram showing a sample of bar-code printing where the print has been performed appropriately.
Figure 14B:
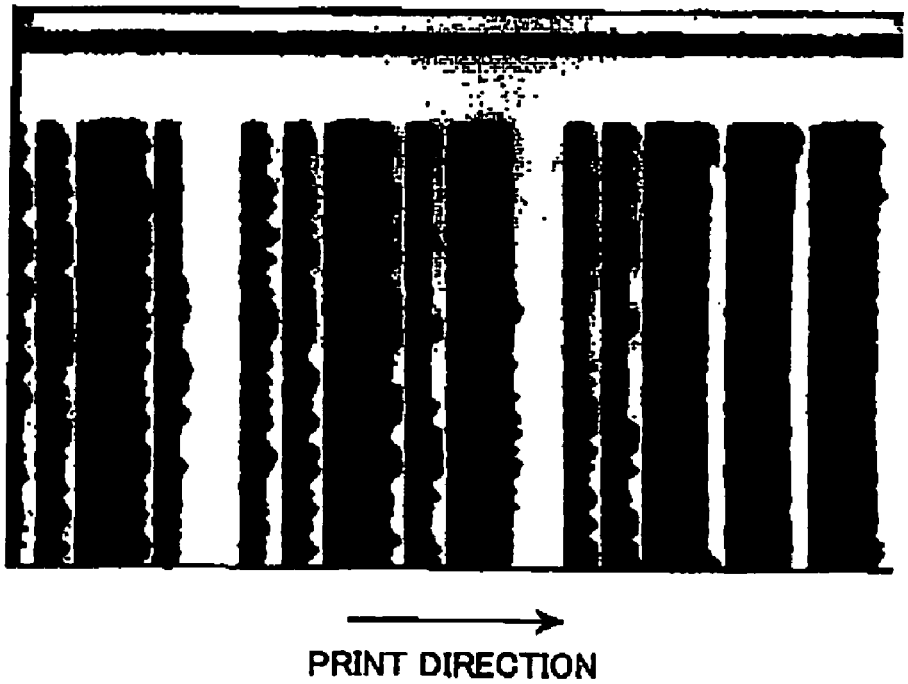
FIG. 14B is an explanatory diagram showing another sample of bar-code printing where the print has become fattened.

The thermal printer disclosed in Japanese patent-application publication No. 7-108701 adjusts only the width of the main pulses and does not adjust the width of the sub-pulses. This is because the sub-pulses are shorter than the main pulses and thus it is considered the sub-pulses will not be affected much by the heat buildup. However, with print patterns such as bar codes where all the heating elements are used intermittently, a history control is performed by using sub-pulses to provide auxiliary heating for dots that were not printed in the previous line, and thus print fattening is more likely to occur than in ordinary printing. FIG. 14B shows a sample of bar-code printing performed by the thermal printer disclosed in Japanese patent-application publication No. 7-108701. Printing has become fattened due to excessive auxiliary heating by the sub-pulses. On the other hand, FIG. 14A shows a sample of bar-code printing performed by the thermal printer according to the present embodiment. Printing has been performed appropriately without print fattening.

Figure 15:
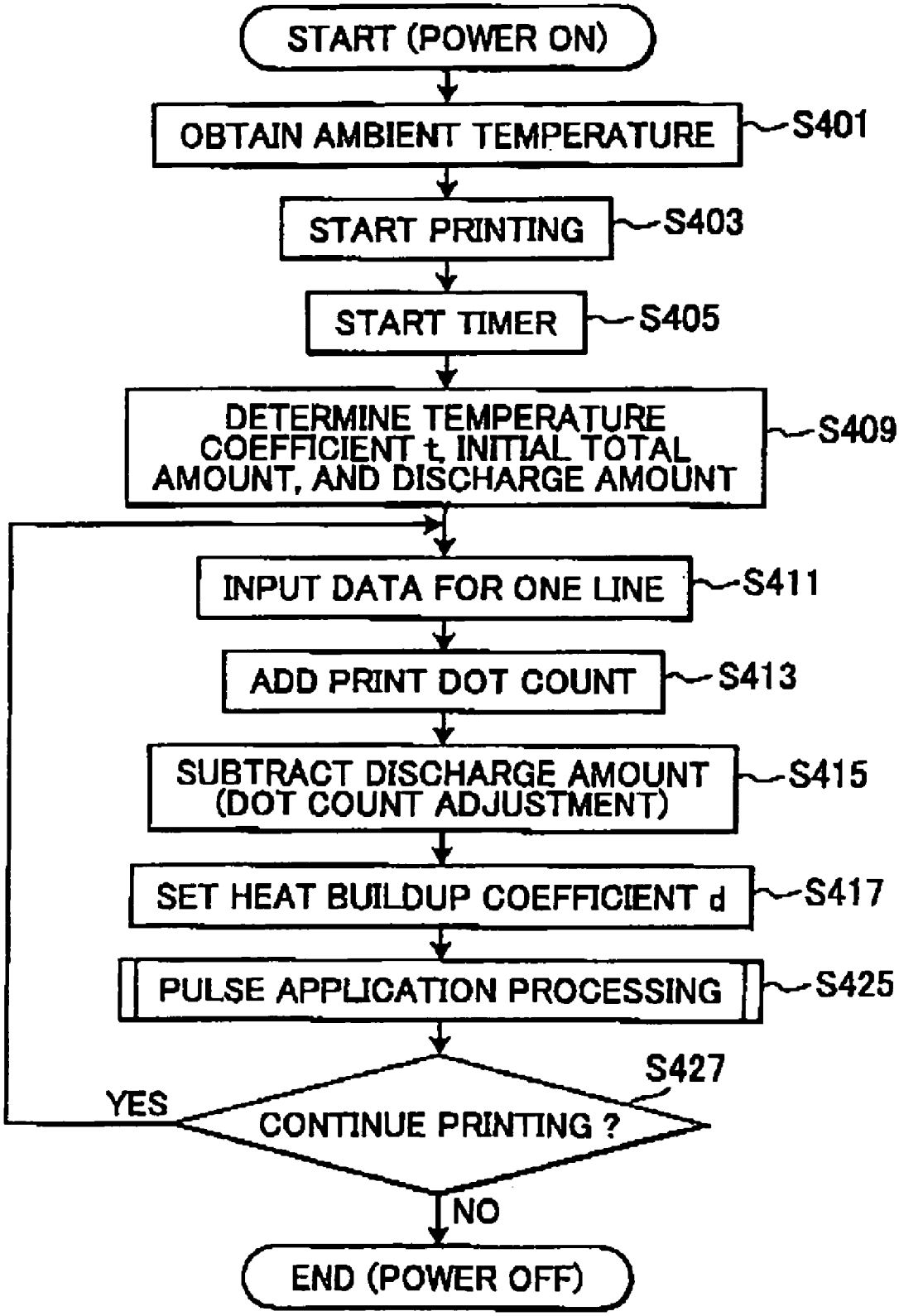
FIG. 15 is a flowchart showing the steps of heat buildup control processing to be executed by the tape printing device according to a third embodiment of the disclosure.
Figure 16:
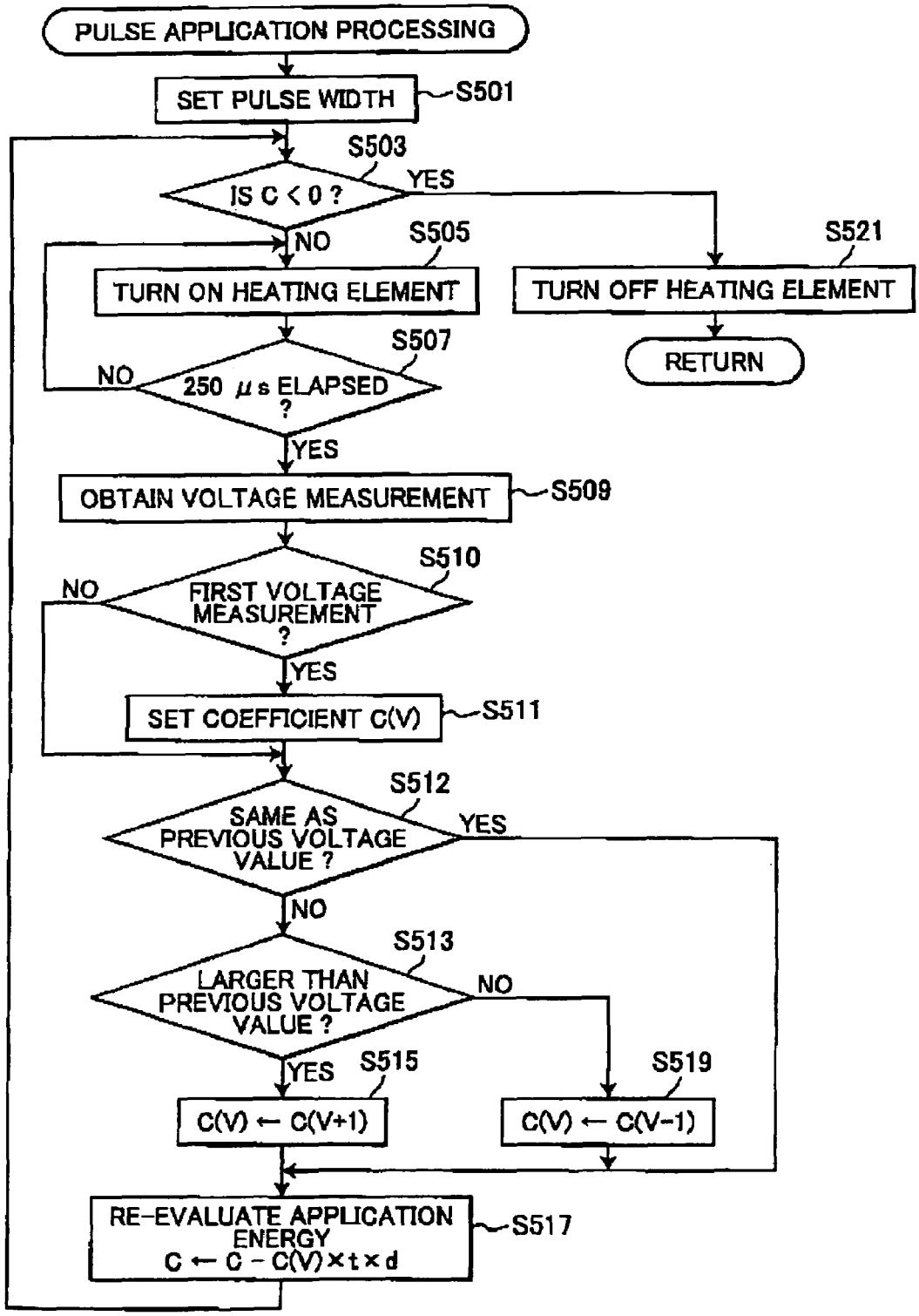
FIG. 16 is a flowchart showing the steps of pulse application processing subroutine that is executed in the heat buildup control processing of FIG. 15.

A tape printing operation of the tape printing device 1 according to a third embodiment will be described while referring to the flowcharts of FIGS. 15 and 16.

When the power is turned on and the processing of the tape printing device 1 starts, in S401 the CPU 21 obtains the ambient temperature from the thermistor 13. In S403 printing starts in accordance with a direction from the user. In S405 the timer 210 starts counting together with the start of printing.

In S409 the CPU 21 determines the temperature coefficient t, the initial total amount (reference dot count), and the discharge amount, based on the ambient temperature obtained in S401. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S411 the CPU 21 inputs data for one line of data to be printed, and stores the corresponding dot count for the one line portion in the line print dot count memory 273 that is part of the RAM 27. In S413 the CPU 21 adds the dot count for one line portion, which was stored in the line print dot count memory 273 in S411, to the total amount determined in S409, to calculate the total dot count D. In S415 a value equal to the discharge amount determined in S409 multiplied by the time elapsed since the start of printing is subtracted from the total dot count D calculated in S413, to adjust the dot count. The processing of S413 and S415 calculates the total dot count D by adding the number of dots to be printed from now onward to the total amount determined in S409, then subtracting a value obtained by multiplying the discharge amount determined in S409 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the print dot count.

In S417 the CPU 21 sets the heat buildup coefficient d based on an excess dot count and the ambient temperature that was obtained in S406. The excess dot count is the difference between the current total dot count D that was adjusted in S415 and a reference dot count (the initial value of the total amount that was set in S409). The heat buildup coefficient d is determined in accordance with the heat buildup coefficient table 62 (FIG. 6) stored in the parameter storage area 275. During the first round of processing, the difference between the current total dot count D and the reference dot count is less than 50000, so the heat buildup coefficient d is set to 1 regardless of the ambient temperature.

In S425 the CPU 21 executes a pulse application processing that sets pulses to be applied to the heating elements. Details of the pulse application processing will be given later while referring to FIG. 16. After the pulse application processing ends, in S427 the CPU 21 determines whether printing is continued and, if printing is continued (S427: YES), the process returns to S411 and the next one line of data is input. If printing is not continued (S427: NO), the processing ends.

The pulse application processing executed in S425 of FIG. 15 will be described in greater detail while referring to FIG. 16. In S501 the CPU 21 sets the pulse width (ON time) to be applied to each heating element, by substituting a predetermined value into an application control coefficient C. The value that is substituted into the application control coefficient C is a predetermined fixed value that corresponds to the thermal head 9 and the tape type that was obtained beforehand. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S503 the CPU 21 determines whether the application control coefficient C has become less than zero. If the application control coefficient C is greater than or equal to 0 (S503: NO), in S505 drive pulses are applied to turn the heating elements on. In S507 the CPU 21 determines whether 250 microseconds have elapsed. The application of the drive pulses continues (S505) until 250 microseconds have elapsed (S507: NO).

When 250 microseconds have elapsed (S507: YES), in S509 the CPU 21 obtains the voltage applied to the thermal head 9 from the voltage measurement portion 34 as an AD value. In S510 the CPU 21 determines whether the voltage was obtained for the first time. If it is not the first time (that is, the second time or more) that the voltage was obtained (S510: NO), the processing directly goes to S512. If the voltage was obtained for the first time (S510: YES), in S511 the CPU 21 sets the voltage change coefficient C(V) based on the voltage obtained in S509. The voltage change coefficient C(V) is determined in accordance with the voltage change coefficient table 63 stored in the parameter storage area 275.

In S512 the CPU 21 compares the voltage measurement value obtained in S509 (the current voltage measurement value) with the previous voltage measurement value (AD value) stored in the voltage measurement value memory 277, to determine whether the both values are equal. If the current voltage measurement value is equal to the previous voltage value (S512: YES), the CPU 21 uses the previous voltage change coefficient C(V) without any change so the process proceeds to S517.

If the current voltage measurement value is not equal to the previous voltage measurement value (S512; NO), in S513 the CPU 21 determines whether the current voltage measurement value is greater than the previous voltage measurement value. If the current voltage measurement value is greater than the previous voltage measurement value (S513: YES), in S515 the CPU 21 increments the voltage value (AD value) of the current voltage change coefficient C(V) by 1 and substitutes C(V+1) into C(V). If the current voltage measurement value is less than the previous voltage measurement value (S513: NO), in S519 the CPU 21 decrements the voltage value (AD value) of the current voltage change coefficient C(V) by 1 and substitutes C(V−1) into C(V). In S517 the CPU 21 re-calculates the application control coefficient C to determine whether the application of drive pulses should continue and determines the amount of energy that should be applied subsequently. The re-evaluation of the application energy is in accordance with a formula C←C−C(V)×t×d. Then, the process returns to S503.

The above processing is repeated to determine the application pulse width every 250 microseconds and, when the application control coefficient C becomes less than zero (S503: YES), the heating elements are turned off for a predetermined time (S521) to cool the thermal head 9. The flow returns to the main routine for heat buildup control shown in FIG. 15.

As described above, the tape printing device 1 of the present embodiment reads out the voltage value after the voltage application to the heating elements has started, and determines the voltage change coefficient C(V) that is a parameter for evaluating the application energy based on the voltage value. Since the no-load voltage which is likely to be comparatively high in the pre-printing state is not used when determining the parameter, the occurrence of blurring due to insufficient application energy can be prevented because the ON time is shortened by a high voltage value. In addition, the voltage AD value that was obtained by the voltage measurement portion 34 is not utilized directly. Instead, the application pulse width is determined by comparing the previous voltage value with the current voltage value. A voltage AD value that is the same as the previous one is used if the previous and current voltage values are the same. A voltage AD value incremented by 1 is used if the current voltage value is higher than the previous voltage value. A voltage AD value decremented by 1 is used if the current voltage value is lower than the previous voltage value. Accordingly, the application control coefficient C(V) can be set continuously or linearly for the control of the application pulse width. In other words, it is unnecessary to read the voltage a plurality of times and to calculate an average value thereof, in order to avoid noise in the read-out voltage.

In addition, under the unstable control, there is a large difference in the voltage between a loaded condition (in which the heating elements are powered) and a no-load condition (in which the heating elements are not powered). Therefore, if the voltage is read before the heating elements are powered (no-load condition), the read voltage will be high and the pulse width is determined based on the high voltage, which shortens the ON time. As a result, the supplied energy will be insufficient, leading to print blurring. In the present embodiment, however, the voltage is read after the heating elements are powered (loaded condition), the read voltage will be appropriate and the pulse width is determined based on the appropriate voltage. Thus, the supplied energy will be appropriate, leading to high print quality.

If a voltage is read out successively as in the thermal printer disclosed in Japanese patent-application publication No. 8-300713, it takes time to convert voltage analog values into digital values (A/D conversion) for a plurality of voltage values. It takes even more time if the voltage is read out a plurality of times and an average value is calculated in consideration of noise. There is also a limit in the number of read-out times when the read-out has to be performed in a short time period.

Next, a correction coefficient table used in a fourth embodiment will be described while referring to FIG. 17. As shown in FIG. 17, a correction coefficient table 264 is a table for determining a coefficient dc for correcting the heat buildup information when the tape type has changed. The correction coefficient table 264 shown in FIG. 17 includes a previous tape type 2641, a current tape type 2642, and a correction coefficient dc 2643 corresponding to combinations of the previous tape type 2641 and the current tape type 2642. Since any difference in the print energy to be required for a certain tape type has an effect on the heat buildup status, the print energy is held appropriately even when the tape type has been changed. The correction coefficient dc is greater than 1 if the change is from a tape type with a large energy requirement to a tape type with a small energy requirement. On the other hand, the correction coefficient dc is less than 1 if the change is from a tape type with a small energy requirement to a tape type with a large energy requirement.

A tape printing operation according to the fourth embodiment will be described while referring to the flowchart shown in FIG. 18.

When the power is turned on and the processing of the tape printing device 1 starts, in S1001 the CPU 21 sets an initial value for the previous tape type and stores the value in the tape-type memory 276. The tape type detected in S1004 will eventually be substituted as the previous tape type in each repeat of the routine, as will be described later, but since this is initialization processing immediately after power-on, laminated tape is set as the initial value in S1001, because the laminated tape is considered to be the most frequently used type of tape.

In S1002 printing starts in accordance with a direction from the user. In S1003 the timer 210 starts counting together with the start of printing. In S1004 the CPU 21 detects the type of tape within the tape cassette 35 that is installed in the tape printing device 1 based on signals from the tape-type detection sensors, and stores the tape type in the tape-type memory 276.

In S1006 the CPU 21 obtains the ambient temperature from the thermistor 13. In S1007 the CPU 21 determines a temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1008 the CPU 21 adds the number of dots to be printed from now onward to the total amount determined in S1007, to calculate a total dot count D. Since the dot count for one line portion is stored in the line print dot count memory 273 of the RAM 27, the value is used. In S1009 the CPU 21 subtracts a value equal to the discharge amount determined in S1007 multiplied by the time elapsed since the start of printing from the total dot count D calculated in S1008, to adjust the dot count. The processing of S100B and S1009 obtains the total dot count D by adding the number of dots to be printed from now onward to the total amount determined in S1007, then subtracting a value obtained by multiplying the discharge amount determined in S1007 by the elapsed time since the start of printing (total dot count=total amount+print dot count−(discharge amount× elapsed time)). Thus the heat buildup status of the thermal head 9 can be expressed as a number of dots by adding the print dot count then performing adjustment by converting the amount of thermal radiation into a dot count and subtracting the value from the total dot count.

In S1010 the CPU 21 determines whether the tape type that has been detected this time (the current time) is the same as the previous tape type that was stored in the tape-type memory 276, If the current tape type is the same as the previous tape type (S1010. YES), there is no change to the required print energy and thus no correction is necessary and the process proceeds to S1012.

In S1011 if the current tape type differs from the previous tape type (S1010: NO), the CPU 21 corrects the total dot count D that was adjusted in S1009, in accordance with the correction coefficient table 264. The correction is done with a formula D=D×dc. If the previous tape type was laminated tape and the current tape type is non-laminated (receptor) tape, for example, the correction coefficient dc is 0.9, and the total dot count after the correction is 0.9 times the total dot count D obtained in S1009. The correction coefficient dc depends on the energy requirement of the tape type, so that if the change is from a tape type with a large energy requirement to a tape type with a small energy requirement, the coefficient will become larger. On the other hand, if the change is from a tape type with a small energy requirement to a tape type with a large energy requirement, the coefficient is smaller. Since the change of tape type in this example is from a laminated tape that is a type of tape with a small energy requirement to a receptor tape that is a type of tape with a large energy requirement. Therefore, the total dot count D which is heat buildup information becomes smaller, and thus print blurring due to excessive heat buildup control can be prevented from occurring.

In S1012 the CPU 21 sets the heat buildup coefficient d, based on an excess dot count and the ambient temperature that was obtained in S1006. The excess dot count is the difference between the current total dot count D that was corrected in S1011 and a reference dot count (the initial value of the total amount that was set in S1007). The heat buildup coefficient d is determined in accordance with the heat buildup coefficient table 62 stored in the parameter storage area 275. During the first round of processing, the difference between the current total dot count D and the reference dot count is less than 50000, so the heat buildup coefficient d is set to 1 regardless of the ambient temperature.

In S1015 the CPU 21 detects the voltage, and in S1016 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1017 the CPU 21 sets the pulse width (ON time) to be applied to each heating element, by substituting a predetermined value into an application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1018 the CPU 21 determines whether the application control coefficient C has become less than zero. If the application control coefficient C is greater than or equal to zero (S1018: NO), in S1019 drive pulses are applied to turn the heating elements on. In S1020 the CPU 21 determines whether 250 microseconds have elapsed. The application of the drive pulses continues (S1019) until 250 microseconds have elapsed (S1020: NO). When 250 microseconds have elapsed (S1020: YES), in S1021 the CPU 21 re-calculates the application control coefficient C to determine whether the application of drive pulses should continue, and determines the amount of energy that should be applied subsequently. The re-evaluation of the application energy is in accordance with a formula C←C−C(V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1018, and the CPU 21 again determines whether the application control coefficient C after the calculation of S1021 has become less than zero. When the application control coefficient C becomes less than zero (S1018: YES), in S1022 the heating elements are turned off for a predetermined time to cool the thermal head 9. In S1023 the CPU 21 substitutes the current tape type into the previous tape type to prepare for the next round of the processing routine. In S1024 the CPU 21 determines whether printing is continued and the process returns to S1002 if printing is continued (S1024: YES) or ends the processing if printing is not continued (S1024: NO).

In the tape printing device 1 according to the fourth embodiment described above, the previously detected tape type is stored, and the CPU 21 determines whether the tape type that is detected the current time is the same. If the tape type is different from the previous tape type, the CPU 21 corrects the total dot count and reflects the tape-type change in the heat buildup information, so that the magnitude of the heat buildup is reflected appropriately by the magnitude of the print energy corresponding to the tape type. Thus the CPU 21 can execute heat buildup control which enables an appropriate maintenance of print quality even when the tape type has been changed.

Figure 20:
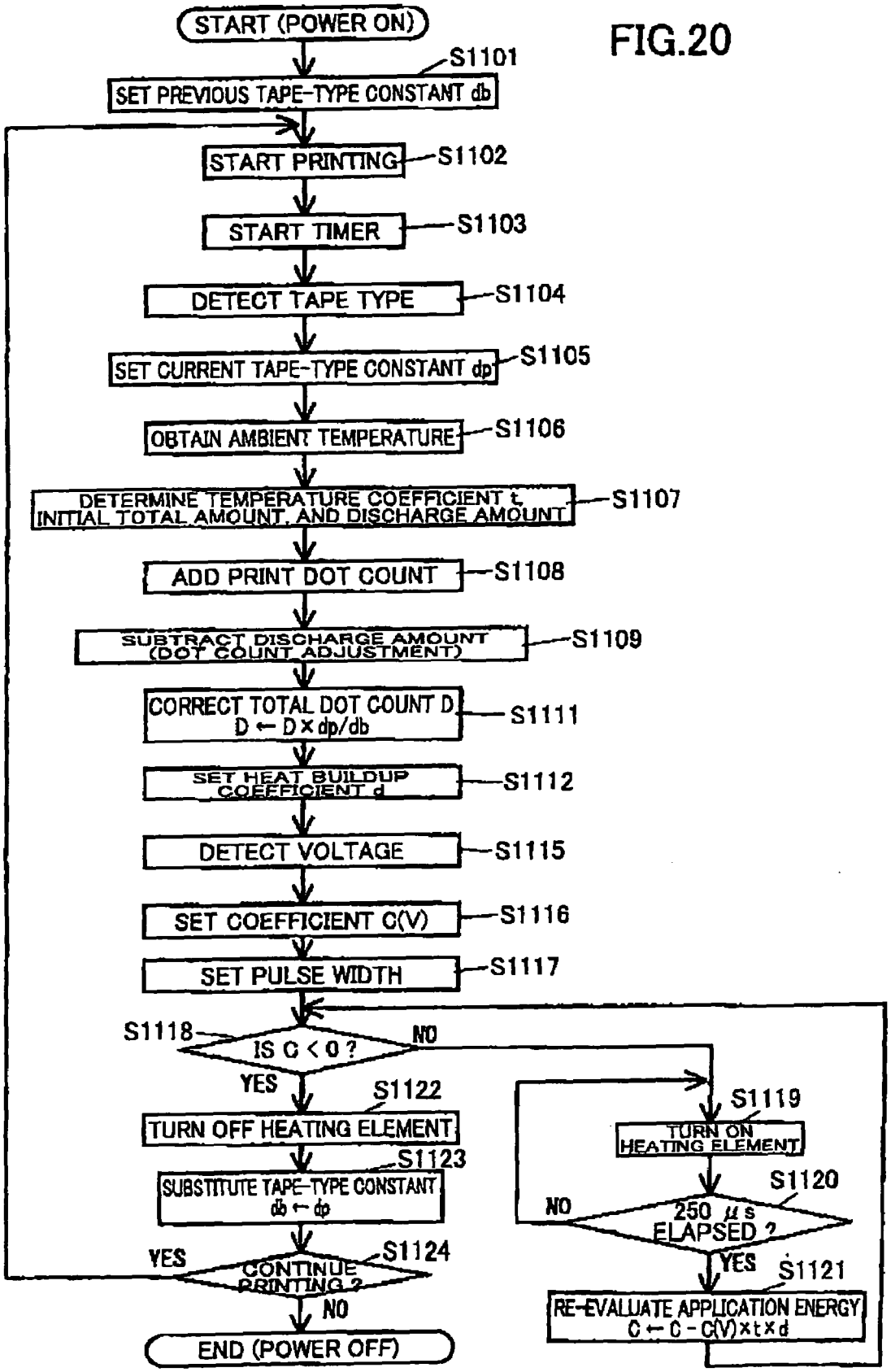
FIG. 20 is a flowchart showing the steps of heat buildup control processing to be executed by the tape printing device according to a fifth embodiment of the disclosure.

The tape printing operation according to a fifth embodiment will be described while referring to FIGS. 19 and 20. The fifth embodiment is similar to the fourth embodiment in that the heat buildup information is held appropriately by correcting the total dot count D. However, the correction is performed by using coefficients for each tape type in the calculations, instead of the means of determining whether the tape type has been changed.

As shown in FIG. 19, a tape-type constant table 65 is configured of a tape type 651 and a constant 652 corresponding to the tape type 651. With the present embodiment, the tape type that is used is one of laminated tape, non-laminated (receptor) tape, and transfer tape. The corresponding constant 652 is 1 for laminated tape, 0.9 for non-laminated tape, and 1.2 for transfer tape. These constant values are parameters that can be modified to any numerical value, depending on the ratio of energy to be applied to the heating elements R1 to Rn of the thermal head 9 with respect to each type of tape. In the present embodiment, the print energy to be required for one dot in each tape type is approximately 1.1 mJ for laminated tape, approximately 1.3 mJ for non-laminated tape, and approximately 0.7 mJ for transfer tape. Accordingly, the constant 652 becomes smaller as the energy requirement of the tape type increases.

A tape printing operation according to the fifth embodiment will be described while referring to the flowchart shown in FIG. 20.

When the power is turned on and the processing of the tape printing device 1 starts, in S11 the CPU 21 sets an initial value in a previous tape-type constant db and stores the value in the tape-type memory 276. The previous tape-type constant db is substituted for the constant set in the previous processing in which the setting is based on the tape type that is detected in S1104, as will be described later. However, since the processing in S1101 is the initialization processing immediately after power-on, the constant 1.0 is read out from the tape-type constant table 65 and substituted as the initial value to correspond to laminated tape, which is considered to be the most frequently used tape type.

In S1102 printing starts in accordance with a direction from the user. In S1103 a timer is started together with the start of printing. In S1104 the CPU 21 detects the type of tape of the tape cassette 35 that is installed in the tape printing device 1 based on signals from the tape-type detection sensors.

In S1105 the CPU 21 substitutes a constant corresponding to the currently installed tape type detected in S1104, into a current tape-type constant dp. If non-laminated tape has been detected, for example, a value of 0.9 is substituted in accordance with the tape-type constant table 65.

In S1106 the CPU 21 obtains the ambient temperature from the thermistor 13. In S1107 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1108 the CPU 21 adds the dot count for one line portion to be printed from now onward to the total amount determined in S1107, to calculate the total dot count D. Since the dot count for one line portion is stored in the line print dot count memory 273 of the RAM 27, that value is used. In S1109 a value equal to the discharge amount determined in S1107 multiplied by the time elapsed since the start of printing is subtracted from the total dot count D calculated in S1108, to adjust the dot count. The processing of S1108 and S1109 calculates the total dot count D by adding the number of dots to be printed from now onward to the total amount determined in S1107, then subtracting a value obtained by multiplying the discharge amount determined in S1107 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the print dot count.

In S1111 the CPU 21 corrects the total dot count D that was adjusted in S1109, based on the tape-type constant db that indicates the previous tape type and a current tape-type constant dp that indicates the current tape type. The correction is done with a formula D=D×dp/db. If the previous tape-type constant db is 1.0 (laminated tape) and the current tape-type constant dp is 0.9 (receptor tape), for example, the total dot count after the correction is 0.9 times the total dot count D obtained in S1109. The tape-type constant depends on the energy requirement of the tape type, so that the configuration is such that the constant decreases as the energy requirement of the tape type increases. Since the change of tape type in this example is from a laminated tape that is a type of tape with a small energy requirement to a receptor tape that is a type of tape with a large energy requirement, therefore, the value of the total dot count D that is heat buildup information is smaller, and thus print blurring due to excessive heat buildup control can be prevented from occurring. If the current tape-type constant is the same as the previous tape-type constant, no correction of the total dot count D is done so that the value dp/db becomes 1, enabling correction of the total dot count with a simple configuration without a need to determine whether the previous tape type and the current tape type are the same.

In S1112 the CPU 21 sets the heat buildup coefficient d based on the difference between the current total dot count D that was corrected in S1111 and a reference dot count (the initial value of the total amount that was set in S1107) and the ambient temperature. The heat buildup coefficient d is determined in accordance with the heat buildup coefficient table 62 stored in the parameter storage area 275. During the first round of processing, the difference between the current total dot count D and the reference dot count is less than 50000, so the heat buildup coefficient d is set to 1 regardless of the ambient temperature.

In S1115 the CPU 21 detects the voltage, and in S1116 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied to the heating elements, as will be described later.

In S1117 the CPU 21 sets the pulse width (ON time) to be applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1118 the CPU 21 determines whether the application control coefficient C has become less than zero. If the application control coefficient C is greater than or equal to zero (S1118: NO), in S1119 drive pulses are applied to turn the heating elements on. In S1120 the CPU 21 determines whether 250 microseconds have elapsed. The application of the drive pulses continues (Sll9) until 250 microseconds have elapsed (S1120: NO). When 250 microseconds have elapsed (S1120: YES), in S1121 the CPU 21 re-calculates the application control coefficient C and determines the amount of energy that should be applied subsequently. The re-evaluation of the application energy is in accordance with a formula C←C−C(V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1118, and the CPU 21 again determines whether the application control coefficient C after the calculation of S1121 has become less than zero. When the application control coefficient C becomes less than zero (S1118: YES), in S1122 the heating elements are turned off for a predetermined time to cool the thermal head 9. In S1123 the CPU 21 substitutes the current tape-type constant dp into the previous tape-type constant db in order to prepare for the next round of the processing routine. In S1124 the CPU 21 determines whether printing is continued and the process returns to S1102 if printing is continued (S1124: YES) or ends the processing if printing is not continued (S1124: NO).

With the tape printing device 1 of the fifth embodiment, a constant corresponding to the tape type is used in the correction of the total dot count, as described above, so that the CPU 21 can execute heat buildup control in which the magnitude of the heat buildup is reflected appropriately by the magnitude of the print energy corresponding to the tape type. Since a constant corresponding to the tape type is used, it is not necessary to determine whether the previous tape type and the current tape type are different.

Figure 22:
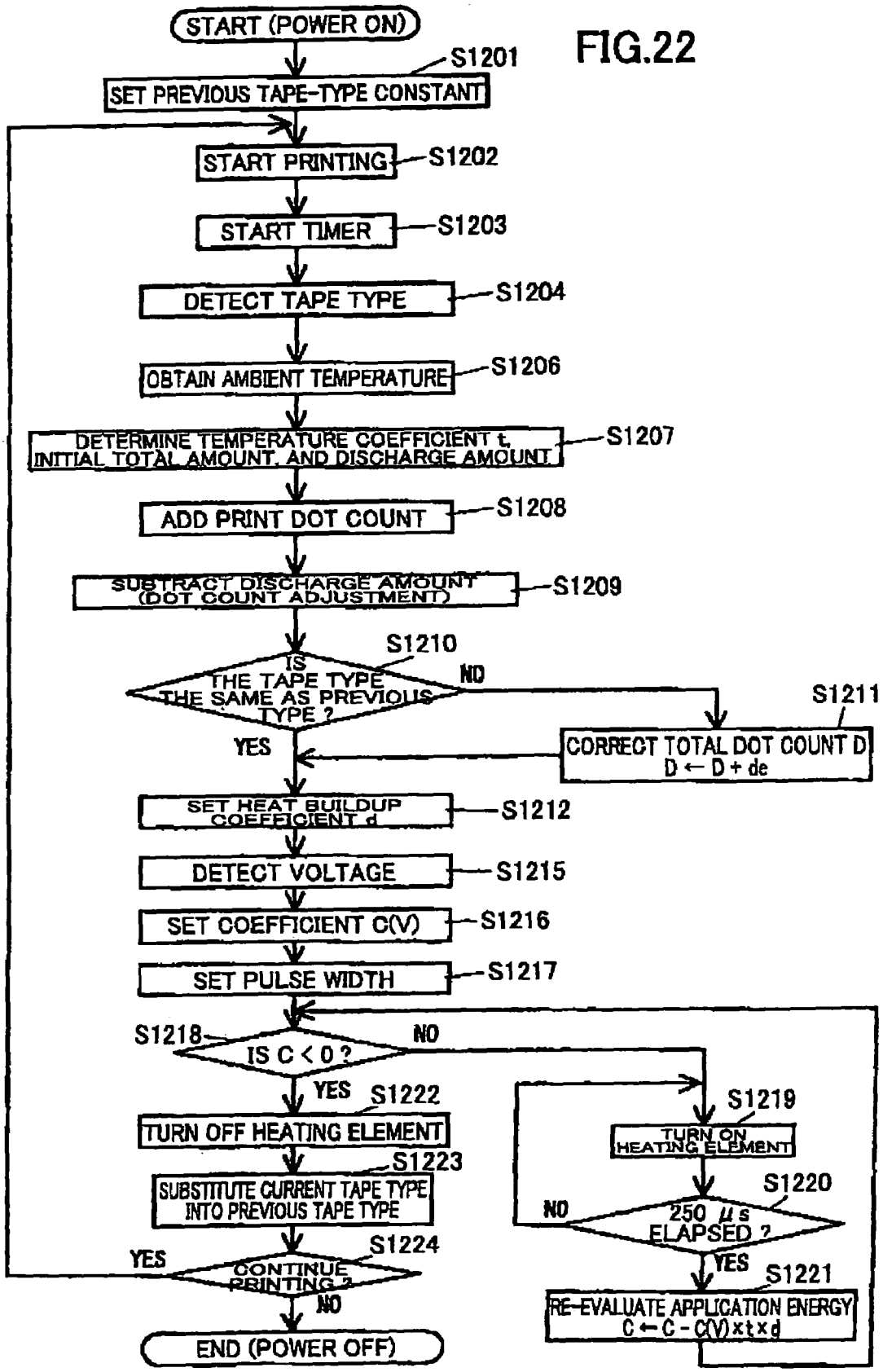
FIG. 22 is a flowchart showing the steps of heat buildup control processing to be executed by the tape printing device according to a sixth embodiment of the disclosure.

Next, the tape printing operation according to a sixth embodiment will be described while referring to FIGS. 21 and 22. The sixth embodiment is similar to the fourth embodiment in that the heat buildup information is held appropriately by correcting the total dot count D, but the correction is performed by adding or subtracting a predetermined number instead of the correction by multiplying the total dot count D by a correction coefficient.

As shown in FIG. 21, a dot count correction value table 66 includes an excess dot count 661 and a dot count correction value de. The excess dot count 661 is the amount by which the current total dot count exceeds the reference value that is the total amount obtained from the dot count parameter table 61 (FIG. 5). The dot count correction value de is determined in correspondence with a combination 662 of the previous tape type and the current tape type. The dot count correction value de can be a positive value or a negative value, and is added to or subtracted from the total dot count D. The dot count correction value de depends on the energy requirement of the tape type. Thus the dot count correction value de is a positive value if the change is from a tape type with a large energy requirement to a tape type with a small energy requirement, or a negative value if the change is from a tape type with a small energy requirement to a tape type with a large energy requirement. Also, the absolute value of the dot count correction value de increases as the excess dot count becomes larger (as heat buildup proceeds).

A tape printing operation according to the sixth embodiment will be described while referring to the flowchart shown in FIG. 22. When the power is turned on and the processing of the tape printing device 1 starts, in S1201 the CPU 21 sets an initial value for the previous tape type and stores the value in the tape-type memory 276. The tape type detected in S1204 will eventually be substituted as the previous tape type in each repeat of the routine, but since this is initialization processing immediately after power-on, laminated tape is set as the initial value in S1201, because the laminated tape is considered to be the most frequently used type of tape.

In S1202 printing starts in accordance with a direction from the user. In S1203 the count of a timer is started together with the start of printing. In S1204 the CPU 21 detects the type of tape within the tape cassette 35 that is installed in the tape printing device 1 based on signals from the tape-type detection sensors, and stores the tape type in the tape-type memory 276.

In S1206 the CPU 21 obtains the ambient temperature from the thermistor 13. In S1207 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1208 the CPU 21 adds the dot count for one line portion to be printed from now onward to the total amount determined in S1207, to calculate the total dot count D. Since the dot count for one line portion is stored in the line print dot count memory 273 of the RAM 27, that value is used. In S1209 a value equal to the discharge amount determined in S1207 multiplied by the time elapsed since the start of printing is subtracted from the total dot count D calculated in S1208, to adjust the dot count. The processing of S1208 and S1209 calculates the total dot count D by adding the number of dots to be printed from now onward to the total amount determined in S1207, then subtracting a value obtained by multiplying the discharge amount determined in S1207 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the print dot count.

In S1210 the CPU 21 determines whether the tape type that has been detected this time (the current time) is the same as the previous tape type that was stored in the tape-type memory 276. If the current tape type is the same as the previous tape type (S1210: YES), there is no change to the required print energy and thus no correction is necessary and the process proceeds to S1212.

If the current tape type differs from the previous tape type (S1210: NO), the CPU 21 corrects the total dot count that was adjusted in S1209 in accordance with the dot count correction value table 66. The correction is done with a formula D=D+de. For example, if the previous tape type is laminated tape and the current tape type is receptor (non-laminated) tape and the excess dot count is within the range of 50000 to 99999, the correction value de is −5000 and the total dot count after the correction is obtained by subtracting 5000 from the value obtained by S1209. The dot count correction value de depends on the energy requirement of the tape type. Thus the dot count correction value de is a positive value if the change is from a tape type with a large energy requirement to a tape type with a small energy requirement or a negative value if the change is from a tape type with a small energy requirement to a tape type with a large energy requirement. Further, the absolute value of the dot count correction value de increases as the excess dot count becomes larger (as heat buildup proceeds). Since the change of tape type in this example is from a laminated tape that is a type of tape with a small energy requirement to a receptor tape that is a type of tape with a large energy requirement, the value of the total dot count D that is heat buildup information is smaller, and thus print blurring due to excessive heat buildup control can be prevented from occurring.

In S1212 the CPU 21 sets the heat buildup coefficient d based on an excess dot count and the ambient temperature that was obtained in S1206. The excess dot count is the difference between the current total dot count D that was corrected in S1211 and a reference dot count (the initial value of the total amount that was set in S1207). The heat buildup coefficient d is determined in accordance with the heat buildup coefficient table 62 stored in the parameter storage area 275. During the first round of processing, the difference between the current total dot count D and the reference dot count is less than 50000, so the heat buildup coefficient d is set to 1 regardless of the ambient temperature.

In S1215 the CPU 21 detects the voltage, and in S1216 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1217 the CPU 21 sets the pulse width (ON time) to be applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1218 the CPU 21 determines whether the application control coefficient C has become less than zero. If the application control coefficient C is greater than or equal to zero (S1218: NO), in S1219 drive pulses are applied to turn the heating elements on. In S1220 the CPU 21 determines whether 250 microseconds have elapsed. The application of the drive pulses continues (S1219) until 250 microseconds have elapsed. When 250 microseconds have elapsed (S1220: YES), in S1221 the CPU 21 re-calculates the application control coefficient to determine whether the application of drive pulses should continue, and determines the amount of energy that should be applied subsequently. The re-evaluation of the application energy is in accordance with a formula C←C−C(V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1218, and the CPU 21 again determines whether the application control coefficient C after the calculation of S1221 has become less than zero. When the application control coefficient C becomes less than zero (S1218: YES), in S1222 the heating elements are turned off for a predetermined time to cool the thermal head 9. In S1223 the CPU 21 substitutes the current tape type into the previous tape type in order to prepare for the next round of the processing routine. In the above-mentioned example, laminated tape is substituted by non-laminated tape. In the next execution of the routine, the previous tape type is processed as non-laminated tape. In S1224 the CPU 21 determines whether printing is continued and the process returns to S1202 if printing is continued (S1224: YES) or ends the processing if printing is not continued (S1224: NO).

As described above, since the tape printing device 1 according to the sixth embodiment stores the previous tape type and, if the current tape type differs from the previous tape type, the CPU 21 performs correction by adding or subtracting the dot count correction value de to or from the total dot count, which reflects the heat buildup information. Thus the magnitude of the heat buildup is reflected appropriately by the magnitude of the print energy corresponding to the tape type. Thus the CPU 21 can execute heat buildup control which enables an appropriate maintenance of print quality even when the tape type has been changed.

Next, the tape printing operation according to a seventh embodiment will be described while referring to FIGS. 23 and 24. The seventh embodiment is similar to the sixth embodiment in that the correction is performed by adding or subtracting a predetermined number to or from the total dot count D, but the correction is performed by using a correction constant for each tape type instead of using means of determining whether the tape type has been changed.

As shown in FIG. 23, a dot count correction constant table 67 includes an excess dot count 671 and a dot correction constant dr that is determined in correspondence with a tape type 672. The excess dot count 671 is the amount by which the current total dot count exceeds the reference value that is the total amount obtained from the dot count parameter table 61. The value of the dot correction constant dr depends on the energy requirement of the tape type. Thus the dot correction constant dr has a large value for a tape type with a large energy requirement or a small value for a tape type with a small energy requirement. Therefore, the absolute value of the dot correction constant dr increases as the excess dot count 671 becomes larger (as heat buildup proceeds).

Figure 24:
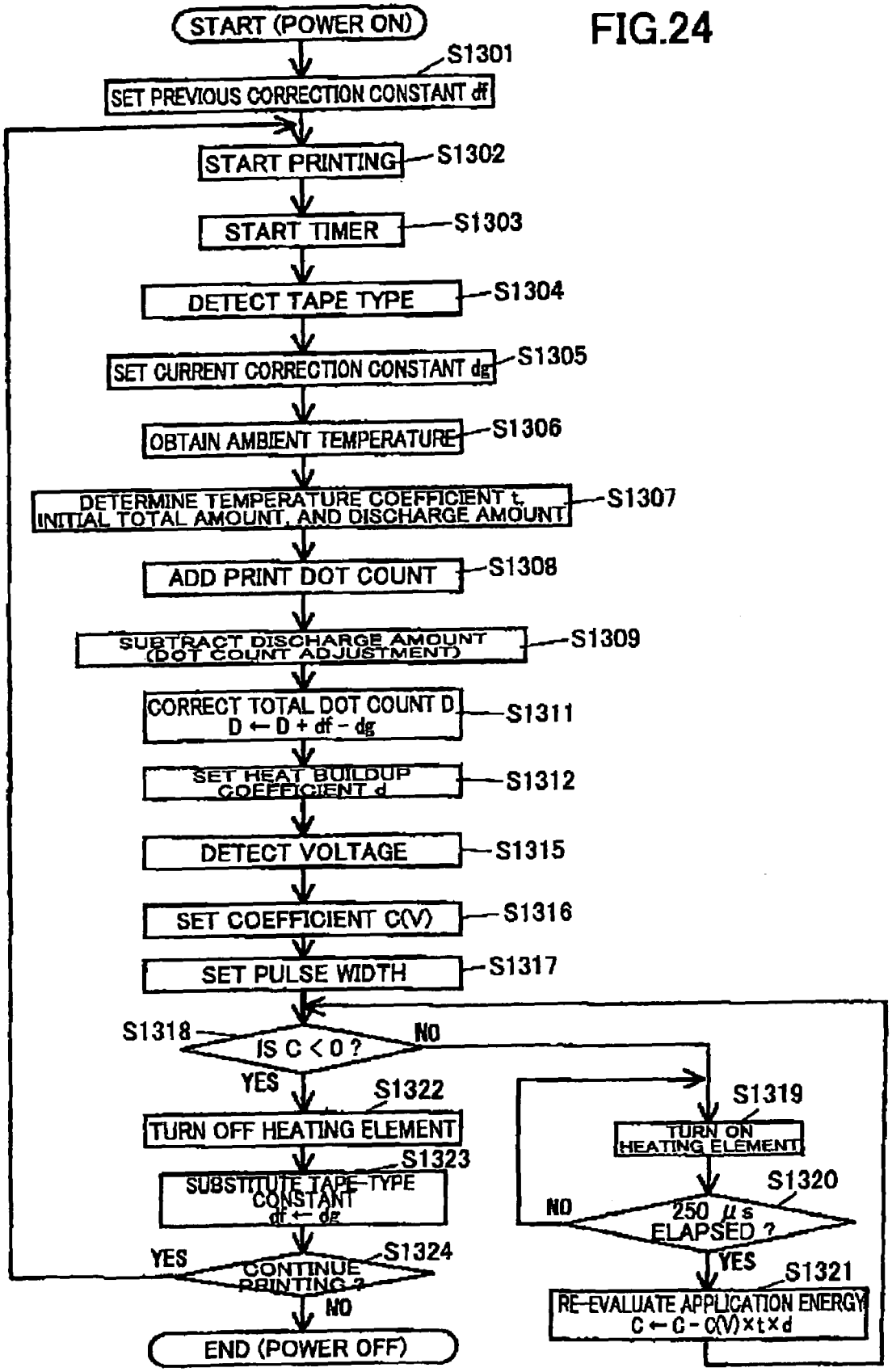
FIG. 24 is a flowchart showing the steps of heat buildup control processing to be executed by the tape printing device according to a seventh embodiment of the disclosure.

As shown in FIG. 24, when the power is turned on and the processing of the tape printing device 1 starts, in S1301 the CPU 21 sets an initial value for a previous correction constant df. As described later, in S1323 a current correction constant dg, which is set based on the tape type detected in S1304, is substituted into the previous correction constant df. However, since this is initialization processing immediately after power-on, laminated tape is considered to be the most frequently used type of tape and thus the constant 0 corresponding to the excess dot count of less than 50000 for laminated tape is read out from the dot count correction constant table 67 and is substituted as the initial value.

In S1302 printing starts in accordance with a direction from the user. In S1303 the count of a timer is started together with the start of printing. In S1304 the CPU 21 detects the type of tape of the tape cassette 35 that is installed in the tape printing device 1 based on signals from the tape-type detection sensors.

In S1305 the CPU 21 substitutes the dot correction constant dr corresponding to the currently installed tape type, which was detected in S1304, into the current correction constant dg. If non-laminated tape was detected, for example, the excess dot count is still below 50000 so a value of 0 is substituted into the current correction constant dg, in accordance with the dot count correction constant table 67.

In S1306 the CPU 21 obtains the ambient temperature from the thermistor 13. In S1307 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1308 the CPU 21 adds the dot count for one line portion to be printed from now onward to the total amount determined in S1307, to calculate the total dot count D. Since the dot count for one line portion is stored in the line print dot count memory 273 of the RAM 27, that value is used. In S1309 a value equal to the discharge amount determined in S1307 multiplied by the time elapsed since the start of printing is subtracted from the total dot count D calculated in S1308, to adjust the dot count. The processing of S1308 and S1309 calculates the total dot count D by adding the number of dots to be printed from now onward to the total amount determined in S1307, then subtracting a value obtained by multiplying the discharge amount determined in S1307 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the print dot count.

In S1311 the CPU 21 corrects the total dot count D that was adjusted in S1309, based on the previous tape-type constant df and the current tape-type constant dg. The correction is done with a formula D=D+df−dg. For example, if the excess dot counts are in a range between 50000 and 99999 and the previous tape-type constant df is 10000 (laminated tape) and the current tape-type constant dg is 15000 (receptor tape), the total dot count after the correction is the total dot count D obtained in S1309 minus 5000. The correction constant dr depends on the energy requirement of the tape type, and its value is smaller for tape types with small energy requirements. Since the change of tape type in this example is from a laminated tape that is a type of tape with a small energy requirement to a receptor tape that is a type of tape with a large energy requirement, the value of the total dot count D that is heat buildup information becomes smaller, and thus print blurring due to excessive heat buildup control can be prevented from occurring. If the current tape-type constant dg is the same as the previous tape-type constant df, no correction of the total dot count is performed because a difference between the tape-type constants (df−dg) becomes zero. Accordingly, the total dot count can be corrected with a simple configuration, without determining whether the previous tape type and the current tape type are the same.

In S1312 the CPU 21 sets the heat buildup coefficient d, based on the difference between the current total dot count D that was corrected in S1311 and a reference dot count (the initial value of the total amount that was set in S1307) and the ambient temperature. The heat buildup coefficient d is determined in accordance with the beat buildup coefficient table 62 stored in the parameter storage area 275. During the first round of processing, the difference between the current total dot count D and the reference dot count is less than 50000, so the heat buildup coefficient d is set to 1 regardless of the ambient temperature.

In S1315 the CPU 21 detects the voltage, and in S1316 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1317 the CPU 21 sets the pulse width (ON time) applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1318 the CPU 21 determines whether the application control coefficient C has become less than zero. If the application control coefficient C is greater than or equal to zero (S1318: NO), in S1319 drive pulses are applied to turn the heating elements on. In S1320 the CPU 21 determines whether 250 microseconds have elapsed. The application of the drive pulses continues (Sl319) until 250 microseconds have elapsed (s1320; NO). When 250 microseconds have elapsed (S1320: YES), in S1321 the CPU 21 re-calculates the application control coefficient C to determine whether the application of drive pulses should continue, and determines the amount of energy that should be applied subsequently. The re-evaluation of the application energy is in accordance with a formula C←C−C(V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1318, and the CPU 21 again determines whether the application control coefficient C after the calculation of S1321 has become less than zero. When the application control coefficient C becomes less than zero (S1318: YES), in S1322 the heating elements are turned off for a predetermined time to cool the thermal head 9. In S1323 the current tape-type constant dg is substituted into the previous tape-type constant df in order to prepare for the next execution of the processing routine. In S1324 the CPU 21 determines whether printing is continued and the process returns to S1302 if printing is continued (S1324: YES) or ends the processing if printing is not continued (S1324: NO).

As described above, with the tape printing device 1 according to the seventh embodiment, a constant corresponding to the tape type is used in the correction of the heat buildup coefficient. Accordingly, the magnitude of the heat buildup is reflected appropriately by the magnitude of the print energy corresponding to the tape type. Thus the CPU 21 can execute heat buildup control which maintains an appropriate print quality even when the tape type has been changed.

Next, the tape printing operation according to an eighth embodiment will be described while referring to FIGS. 17 and 25. In the eighth embodiment, the heat buildup coefficient d which is used when calculating energy applied to the heating elements is corrected, instead of correcting the total dot count D.

Figure 25:
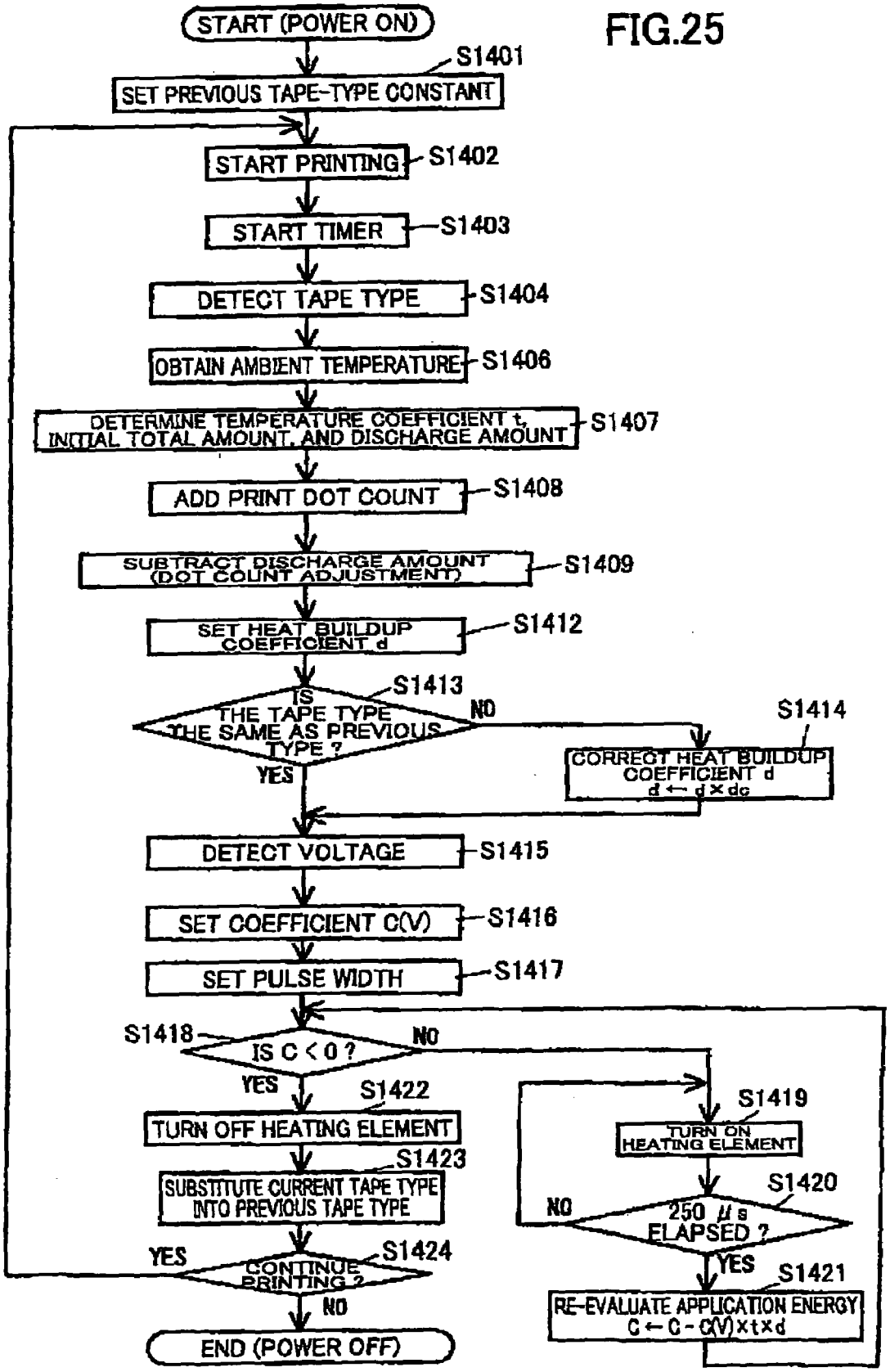
FIG. 25 is a flowchart showing the steps of heat buildup control processing to be executed by the tape printing device according to an eighth embodiment of the disclosure.

As shown in FIG. 25, when the power is turned on and the processing of the tape printing device 1 starts, in S1401 the CPU 21 sets an initial value for the previous tape type and stores the value in the tape-type memory 276. The tape type detected in S1404 will eventually be substituted into the previous tape type in each repeat of the routine, as will be described later, but since this is initialization processing immediately after power-on, laminated tape is set as the initial value in S1401, because the laminated tape is considered to be the most frequently used type of tape.

In S1402 printing starts in accordance with a direction from the user. In S1403 the count of a timer is started together with the start of printing. In S1404 the CPU 21 detects the type of tape within the tape cassette 35 that is installed in the tape printing device 1 based on signals from the tape-type detection sensors, and stores the tape type in the tape-type memory 276.

In S1406 the CPU 21 obtains the ambient temperature from the thermistor 13. In S1407 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1408 the CPU 21 adds the dot count for one line portion to be printed from now onward to the total amount determined in S1407, to calculate the total dot count D. Since the dot count for one line portion is stored in the line print dot count memory 273 of the RAM 27, that value is used. In S1409 a value equal to the discharge amount determined in S1407 multiplied by the time elapsed since the start of printing is subtracted from the total dot count D calculated in S1408, to adjust the dot count. The processing of S1408 and S1409 calculates the total dot count D by adding the number of dots to be printed from now onward to the total amount determined in S1407, then subtracting a value obtained by multiplying the discharge amount determined in S1407 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the total dot count.

In S1412 the CPU 21 sets the heat buildup coefficient d based on the difference between the current total dot count D and the reference dot count and the ambient temperature. The heat buildup coefficient d is determined in accordance with the heat buildup coefficient table 62 stored in the parameter storage area 275.

In S1413 the CPU 21 determines whether the tape type that has been detected this time (the current time) is the same as the previous tape type that was stored in the tape-type memory 276. If the current tape type is the same as the previous tape type (S1413; YES), there is no change to the required print energy and thus no correction is necessary and the process proceeds to S1415.

If the current tape type differs from the previous tape type (S1413: NO), in S1414 the CPU 21 corrects the heat buildup coefficient d that was adjusted in S1412, in accordance with the correction coefficient table 64. The correction is done with a formula d=d×dc. If the previous tape type was laminated tape and the current tape type is receptor tape, for example, the correction coefficient dc becomes 0.9 so that the heat buildup coefficient d after the correction is 0.9 times the value that was obtained in S1412. The correction coefficient dc depends on the energy requirement of the tape type, so that if the change is from a tape type with a large energy requirement to a tape type with a small energy requirement, the coefficient will become larger. On the other hand, if the change is from a tape type with a small energy requirement to a tape type with a large energy requirement, the coefficient will become smaller. Since the change of tape type in this example is from a laminated tape that is a type of tape with a small energy requirement to a receptor tape that is a type of tape with a large energy requirement, the value of the heat buildup coefficient d that is used in the calculations of energy to apply (described later) becomes smaller. Thus, print blurring due to excessive heat buildup control can be prevented from occurring.

In S1415 the CPU 21 detects the voltage, and in S1416 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1417 the CPU 21 sets the pulse width (ON time) applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1418 the CPU 21 determines whether the application control coefficient C has become less than zero. If the application control coefficient C is greater than or equal to zero (S1418: NO), in S1419 drive pulses are applied to turn the heating elements on. In S1420 the CPU 21 determines whether 250 microseconds have elapsed. The application of the drive pulses continues (S1419) until 250 microseconds have elapsed (S1420: NO). When 250 microseconds have elapsed (S1420: YES), in S1421 the CPU 21 re-calculates the application control coefficient C to determine whether the application of drive pulses should continue, and determines the amount of energy that should be applied subsequently. The re-evaluation of the application energy is in accordance with a formula $C \leftarrow C - C(V) \times t \times d$. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1418, and the CPU 21 again determines whether the application control coefficient C after the calculation of S1421 has become less than zero. When the application control coefficient C becomes less than zero (S1418: YES), in S1422 the heating elements are turned off for a predetermined time to cool the thermal head 9. In S1423 the CPU 21 substitutes the current tape type into the previous tape type in order to prepare for the next round of the processing routine. In S1424 the CPU 21 determines whether printing is continued and the process returns to S1402 if printing is continued (S1424: YES) or ends the processing if printing is not continued (S1424: NO).

As described above, since the tape printing device 1 according to the eighth embodiment stores the previous tape type and, if the current tape type differs from the previous tape type, the CPU 21 corrects the heat buildup coefficient which reflects the heat buildup information. Thus the magnitude of the heat buildup is reflected appropriately by the magnitude of the print energy corresponding to the tape type. Thus the CPU 21 can execute heat buildup control which maintains an appropriate print quality even when the tape type has been changed.

Next, the tape printing operation according to a ninth embodiment will be described while referring to FIGS. 19 and 26. The ninth embodiment is similar to the eighth embodiment in that the heat buildup coefficient d is corrected, but the correction is performed by using a correction constant for each tape type, instead of using means of determining whether the tape type has been changed.

Figure 26:
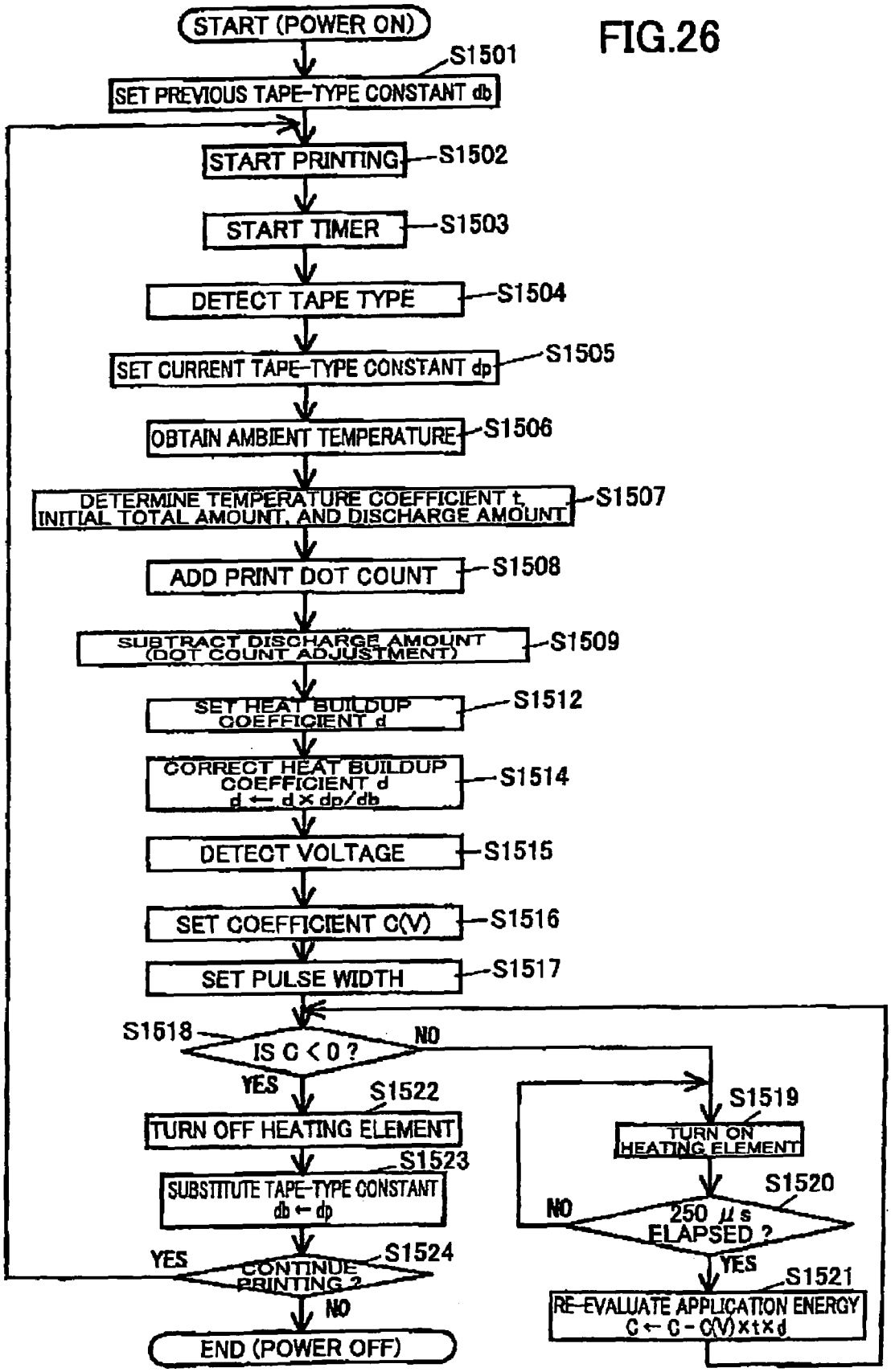
FIG. 26 is a flowchart showing the steps of heat buildup control processing to be executed by the tape printing device according to a ninth embodiment of the disclosure.

As shown in FIG. 26, when the power is turned on and the processing of the tape printing device 1 starts, in S1501 the CPU 21 sets an initial value in the previous the tape-type constant db. As described later, in S1523 the current tape-type constant dp, which is set based on the tape type detected in S1504, is substituted into the previous tape-type constant db. However, since the processing in S1501 is the initialization processing immediately after power-on, a constant 1.0 is substituted as the initial value to correspond to laminated tape (FIG. 19), which is considered to be the most frequently used tape type.

In S1502 printing starts in accordance with a direction from the user. In S1503 the count of a timer is started together with the start of printing. In S1504 the CPU 21 detects the type of the tape by signals from the tape-type detection sensors.

In S1505 the CPU 21 substitutes a constant corresponding to the currently installed tape type, detected in S1504, into the current tape-type constant dp. If non-laminated tape has been detected, for example, a value of 0.9 is substituted in accordance with the tape-type constant table 65.

In S1506 the CPU 21 obtains the ambient temperature from the thermistor 13. In S1507 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values corresponding to the ambient temperature are substituted into the total amount and discharge amount, in accordance with the dot count parameter table 61 that is stored in the parameter storage area 275.

In S1508 the CPU 21 adds the dot count for one line portion to be printed from now onward to the total amount determined in S1507, to calculate the total dot count D. In S1509 a value equal to the discharge amount determined in S1507 multiplied by the time elapsed since the start of printing is subtracted from the total dot count D calculated in S1508, to adjust the dot count. The processing of S1508 and S1509 calculates the total dot count D by adding the number of dots to be printed from now onward to the total amount determined in S1507, then subtracting a value obtained by multiplying the discharge amount determined in S1507 by the elapsed time since the start of printing (total dot count=total amount+print dot count−(discharge amount×elapsed time)).

In S1512 the CPU 21 sets the heat buildup coefficient d based on the difference between the current total dot count D and the reference dot count and the ambient temperature. The heat buildup coefficient d is determined in accordance with the heat buildup coefficient table 62 that is stored in the parameter storage area 275.

In S1514 the CPU 21 corrects the heat buildup coefficient d obtained in S1512 based on the previous tape-type constant db that indicates the previous tape type and the current tape-type constant dp that indicates the current tape type. The correction is done with a formula d=d×dp /db. If d=1.0, db=1.0, and dp=0.9, for example, the corrected value of the heat buildup coefficient d becomes 0.9.

In S1515 the CPU 21 detects the voltage, and in S1516 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1517 the CPU 21 sets the pulse width (ON time) applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1518 the CPU 21 determines whether the application control coefficient C has become less than zero. If the application control coefficient C is greater than or equal to zero (S1518: NO), in S1519 drive pulses are applied to turn the heating elements on. In S1520 the CPU 21 determines whether 250 microseconds have elapsed. The application of the drive pulses continues (S1519) until 250 microseconds have elapsed (S1520: NO). When 250 microseconds have elapsed (S1520: YES), in S1521 the CPU 21 re-calculates the application control coefficient C to determine whether the application of drive pulses should continue, and determines the amount of energy that should be applied subsequently. The re-evaluation of the application energy is in accordance with a formula C←C−C(V)×t×d. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

Subsequently, the process returns to S1518, and the CPU 21 again determines whether the application control coefficient C after the calculation of S1521 has become less than zero. When the application control coefficient C becomes less than zero (S1518: YES), in S1522 the heating elements are turned off for a predetermined time to cool the thermal head 9. In S1523 the CPU 21 substitutes the current tape-type constant dp into the previous tape-type constant is db in order to prepare for the next round of the processing routine. In S1524 the CPU 21 determines whether printing is continued and the process returns to S1502 if printing is continued (S1524: YES) or ends the processing if printing is not continued (S1524: NO).

As described above, with the tape printing device 1 according to the ninth embodiment, a constant corresponding to the tape type is used in the correction of the heat buildup coefficient. Accordingly, the magnitude of the heat buildup is reflected appropriately by the magnitude of the print energy corresponding to the tape type. Thus the CPU 21 can execute heat buildup control which maintains an appropriate print quality even when the tape type has been changed.

Next, a tape printing operation according to a tenth embodiment will be described while referring to FIG. 27. With the tenth embodiment, print blurring due to over-control is avoided by resetting the total dot count D, which is the heat buildup information, when the tape type has been changed.

When the power is turned on and the processing of the tape printing device 1 starts, in S1601 the CPU 21 sets an initial value for the previous tape type and stores that value in the tape-type memory 276. The tape type detected in S1604 will eventually be substituted as the previous tape type in each repeat of the routine, as will be described later, but since this is initialization processing immediately after power-on, laminated tape is set as the initial value in S1601, because the laminated tape is considered to be the most frequently used type of tape.

In S1602 printing starts in accordance with a direction from the user. In S1603 a timer is started together with the start of printing. In S1604 the CPU 21 detects the type of tape within the tape cassette 35 that is installed in the tape printing device 1 based on signals from the tape-type detection sensors, and stores the tape type in the tape-type memory 276.

In S1606 the CPU 21 obtains the ambient temperature from the thermistor 13. In S1607 the CPU 21 determines the temperature coefficient t, the initial total amount (reference dot count), and the discharge amount, based on the thus-obtained ambient temperature. The temperature coefficient t is calculated from a formula such as t=a/(temperature A/D value)+b (where a and b are fixed values, and the temperature A/D value is an A/D conversion of the ambient temperature), and is used during the determination of the energy to be applied to the heating elements, as will be described later. Values that correspond to the ambient temperature are substituted into the total amount and discharge amount, in accordance with the dot count parameter table 61 that is stored in the parameter storage area 275. The total amount and the discharge amount are stored in the total print dot count memory 274 of the RAM 27.

In S1608 the CPU 21 adds the dot count for one line portion to be printed from now onward to the total amount determined in S1607, to calculate the total dot count D. Since the dot count for one line portion is stored in the line print dot count memory 273 of the RAM 27, that value is used. In S1609 a value equal to the discharge amount determined in S1607 multiplied by the time elapsed since the start of printing is subtracted from the total dot count D calculated in S1608, to adjust the dot count. The processing of S1608 and S1609 obtains the total dot count D by adding the number of dots to be printed from now onward to the total amount determined in S1607, then subtracting a value obtained by multiplying the discharge amount determined in S1607 by the elapsed time since the start of printing (total dot count=total amount+print dot count−(discharge amount×elapsed time)). Thus the heat buildup status of the thermal head 9 can be expressed as a number of dots by adding the print dot count then performing adjustment by converting the amount of thermal radiation into a dot count and subtracting the value from the total dot count.

In S1610 the CPU 21 determines whether the tape type that has been detected this time (the current time) is the same as the previous tape type that was stored in the tape-type memory 276. If the current tape type is the same as the previous tape type (S1610: YES), there is no change to the required print energy and thus no correction is necessary and the process proceeds to S1612.

If the current tape type differs from the previous tape type (S1610: NO), in S1611 the CPU 21 substitutes zero into the total dot count D that was adjusted in S1609, to reset the total dot count D. Since this processing causes a reset of the total dot count D that is the heat buildup information, print blurring due to excessive heat buildup control can be prevented from occurring. If the current tape type is the same as the previous tape type, no correction is performed and thus excessive control can be avoided.

In S1612 the CPU 21 sets the heat buildup coefficient d, based on difference between the current total dot count D that was corrected in S1611 and the reference dot count (the initial value of the total amount that was set in S1607) and the ambient temperature. The heat buildup coefficient d is determined in accordance with the heat buildup coefficient table 62 stored in the parameter storage area 275. Since the current total dot count D has been reset to zero in S1611, the excess dot count is also zero which is less than 50000. Thus heat buildup coefficient d is set to 1 regardless of the ambient temperature.

In S1615 the CPU 21 detects the voltage, and in S1616 sets the voltage change coefficient C(V) based on the thus-detected voltage. The determination of the voltage change coefficient C(V) is based on the voltage change coefficient table 63 stored in the parameter storage area 275. The voltage change coefficient C(V) is used when setting the energy to be applied, as will be described later.

In S1617 the CPU 21 sets the pulse width (ON time) to be applied to each heating element by substituting a predetermined value into the application control coefficient C. The value that is substituted into the application control coefficient C is a predetermined fixed value. Each time a predetermined time period elapses, values corresponding to the ambient temperature, voltage, and heat buildup status are subtracted from the predetermined fixed value, using a calculation equation that will be described later, and energy is applied to the heating elements (electricity is passed therethrough) until the application control coefficient C reaches zero. In the present embodiment, a value of 55400 is substituted into the application control coefficient C, for example.

In S1618 the CPU 21 determines whether the application control coefficient C has become less than zero. If the application control coefficient C is greater than or equal to zero (S1618: NO), in S1619 drive pulses are applied to turn the heating elements on. In S1620 the CPU 21 determines whether 250 microseconds have elapsed. The application of the drive pulses continues (S1619) until 250 microseconds have elapsed (S1620: NO). When 250 microseconds have elapsed (S1620: YES), in S1621 the CPU 21 re-calculates the application control coefficient C to determine whether the application of drive pulses should continue, and determines the amount of energy that should be applied subsequently. The re-evaluation of the application energy is in accordance with a formula $C \leftarrow C - C(V) \times t \times d$. The voltage change coefficient C(V) increases as the voltage increases, the temperature coefficient t increases as the ambient temperature increases, and the value of the heat buildup coefficient d increases as the excess dot count and ambient temperature increases. Thus a value that is derived from all of these elements multiplied together will increase when the ambient temperature rises and the thermal head 9 stores heat as the printing continues. Since the value obtained by subtracting the multiplication result from the application control coefficient C is taken as the new value of C, the application control coefficient C decreases faster when the heat buildup proceeds. In other words, since the application control coefficient C approaches zero faster, the ON time of each heating element is shortened, and the occurrence of print fattening can be avoided.

The processing then returns to S1618. If the application control coefficient C becomes less than zero (S1618: YES), in S1622 the CPU 21 turns the heating elements off for a predetermined time to cool the thermal head 9. In S1623 the CPU 21 substitutes the current tape type into the previous tape type in order to prepare for the next round of the processing routine. In S1624 the CPU 21 determines whether printing is continued. The flow returns to S1602 if printing is continued (S1624: YES) or ends the processing if printing is not continued (S1624: NO).

As described above, the tape printing device 1 according to the tenth embodiment stores the previous tape type and, if the current tape type differs from the previous tape type, resets the heat buildup information so that the total dot count D becomes zero. If the heat buildup information is not reset when the current tape type has been changed from the previous tape type, the heat buildup information stored at that point may not be appropriate anymore, and the print energy may become inappropriate (that is, excessively small or excessively large). With the present embodiment, however, it is possible to avoid the problem that the print energy becomes inappropriate after the tape type has been changed. Thus, an appropriate print quality can be maintained even after the tape type has been changed.

The thermal printer disclosed in Japanese patent-application publication No. 2001-191574 uses an accumulated print dot count to control an amount of the heat buildup, and adjusts the accumulated print dot count depending on the tape type. This is because the amount of the heat buildup is small after continuous printing with a tape type having a small print energy requirement, and is large after continuous printing with a tape type having a large print energy requirement. Since the adjustment is performed only at power-on, this conventional thermal printer cannot cope with a change in tape types that require different print energy, resulting in deterioration in the print quality such as print blurring or fattening. Such problem can be avoided with the tape printing device 1 according to the above-described fourth to tenth embodiments.

While the disclosure has been described in detail with reference to the specific embodiment thereof, it would be apparent to those skilled in the art that various changes and modifications may be made therein without departing from the spirit of the disclosure.

For example, in the above-described embodiments, the tape printing device 1 has the keyboard 6, where text that has been input from the keyboard 6 and is printed on tape. However, the tape printing device 1 may be connected to an external device such as a personal computer and the tape printing device 1 may receive print data from the external device and prints the data.

Further, in the above-described embodiments, the ambient temperature is measured by the thermistor 13 installed in the tape printing device 1. However, external measurement means may be provided outside the tape printing device 1, and the external measurement means may measure the ambient temperature adjacent to the tape printing device 1 and send the ambient temperature information to the tape printing device 1.

What is claimed is:

1. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a voltage measurement portion that measures a head voltage applied to the thermal head;

a total-dot counting portion that adds a number of dots which are printed from a reference time point, thereby obtaining a total dot count;

an adjustment portion that adjusts the total dot count based on a predetermined adjustment dot count corresponding to an ambient temperature;

a heat-buildup-coefficient storing portion that stores a heat buildup coefficient corresponding both to the ambient temperature and to an excess dot count, the excess dot count being a difference between the total dot count after adjustment by the adjustment portion and a predetermined reference dot count;

a pulse-width setting portion that sets the width of the drive voltage pulse based on the head voltage and the heat buildup coefficient; and a pulse-width correction portion that corrects the width of the drive voltage pulse based on the head voltage measured by the voltage measurement portion.

2. The thermal printer according to claim 1, further comprising a printing-medium detection portion that detects a printing-medium type, wherein the pulse-width correction portion corrects the width of the drive voltage pulse based on the printing-medium type detected by the printing-medium detection portion.

3. The thermal printer according to claim 1, wherein the pulse-width correction portion includes a heat-buildup-coefficient correction portion that corrects the heat buildup coefficient based on the head voltage; and wherein the pulse-width correction portion corrects the width of the drive voltage pulse based on the heat buildup coefficient that has been corrected by the heat-buildup-coefficient correction portion.

4. The thermal printer according to claim 3, wherein the heat-buildup-coefficient correction portion corrects the heat buildup coefficient to become smaller as the head voltage becomes higher.

5. The thermal printer according to claim 1, wherein the pulse application portion includes:

a first pulse application portion that selectively applies a first drive voltage pulse to the heating elements, the first drive voltage pulse having a first width; and a second pulse application portion that applies a second drive voltage pulse for assisting the first pulse application portion, the second drive voltage pulse having a second width; and wherein the pulse-width setting portion includes:

a first pulse-width setting portion that sets the first width based on the head voltage and the heat buildup coefficient; and a second pulse-width setting portion that sets the second width based on the head voltage, the heat buildup coefficient, and a predetermined correction coefficient.

6. The thermal printer according to claim 5, wherein the predetermined correction coefficient has a value which becomes greater as the first width becomes larger.

7. The thermal printer according to claim 5, wherein the predetermined correction coefficient has a fixed value.

8. The thermal printer according to claim 1, further comprising a power source that supplies the thermal head with electrical power, wherein the voltage measurement portion measures the head voltage at predetermined time intervals;

wherein the pulse-width setting portion sets the width of the drive voltage pulse based on a parameter corresponding to the head voltage; and wherein the voltage measurement portion performs an initial measurement after the pulse application portion has started applying the drive voltage pulse.

9. The thermal printer according to claim 8, further comprising:

a voltage-value storage portion that stores a voltage value measured by the voltage measurement portion;

a voltage-value comparison portion that compares a previous voltage value stored in the voltage-value storage portion with a current voltage value measured by the voltage measurement portion; and a parameter setting portion that sets the parameter based on a comparison result of the voltage-value comparison portion.

10. The thermal printer according to claim 9, wherein, based on the comparison result, the parameter setting portion sets the parameter to a value same as a previous parameter if the current voltage value is the same as the previous voltage value, and sets the parameter by adding a predetermined value to the previous parameter if the current voltage value is greater than the previous voltage value, and sets the parameter by subtracting a predetermined value from the previous parameter if the current voltage value is smaller than the previous voltage value.

11. The thermal printer according to claim 1, further comprising:

a printing-medium detection portion that detects a printing-medium type;

a printing-medium storage portion that stores the printing-medium type detected by the printing-medium detection portion; and a printing-medium monitor portion that monitors a current printing-medium type detected by the printing-medium detection portion and a previous printing-medium type that was detected previously and is stored in the printing-medium storage portion, wherein the pulse-width correction portion corrects the width of the drive voltage pulse, when the printing-medium monitor portion has determined that the current printing-medium type is different from the previous printing-medium type.

12. The thermal printer according to claim 11, wherein the pulse-width correction portion corrects the width of the drive voltage pulse by multiplying a predetermined ratio by the total dot count after the adjustment, the predetermined ratio corresponding to a combination of the current printing-medium type and the previous printing-medium type.

13. The thermal printer according to claim 11, wherein the pulse-width correction portion corrects the width of the drive voltage pulse either by adding a predetermined dot count to the total dot count after the adjustment or by subtracting the predetermined dot count from the total dot count after the adjustment, the predetermined dot count corresponding to a combination of the current printing-medium type and the previous printing-medium type.

14. The thermal printer according to claim 11, wherein the pulse-width correction portion corrects the width of the drive voltage pulse by multiplying a predetermined ratio by the heat buildup coefficient, the predetermined ratio corresponding to a combination of the current printing-medium type and the previous printing-medium type.

15. The thermal printer according to claim 11, wherein the pulse-width correction portion corrects the width of the drive voltage pulse by resetting the total dot count after the adjustment to zero.

16. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a voltage measurement portion that measures a head voltage applied to the thermal head;

a printing-medium detection portion that detects a printing-medium type;

a total-dot counting portion that adds a number of dots which are printed from a reference time point, thereby obtaining a total dot count;

an adjustment portion that adjusts the total dot count based on a predetermined adjustment dot count corresponding to an ambient temperature;

a heat-buildup-coefficient storing portion that stores a heat buildup coefficient corresponding both to the ambient temperature and to an excess dot count, the excess dot count being a difference between the total dot count after adjustment by the adjustment portion and a predetermined reference dot count;

a pulse-width setting portion that sets the width of the drive voltage pulse based on the head voltage and the heat buildup coefficient; and a pulse-width correction portion that corrects the width of the drive voltage pulse based on the printing-medium type detected by the printing-medium detection portion.

17. The thermal printer according to claim 16, wherein the pulse-width correction portion includes a heat-buildup-coefficient correction portion that corrects the heat buildup coefficient based on the printing-medium type detected by the printing-medium detection portion; and wherein the pulse-width correction portion corrects the width of the drive voltage pulse based on the heat buildup coefficient that has been corrected by the heat-buildup-coefficient correction portion.

18. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a power source having a voltage and that supplies the thermal head with electrical power;

a voltage measurement portion that measures the voltage of the power source at predetermined time intervals; and a pulse-width setting portion that sets the width of the drive voltage pulse based on a parameter corresponding to the voltage measured by the voltage measurement portion, wherein the voltage measurement portion performs an initial measurement after the pulse application portion has started applying the drive voltage pulse.

19. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a printing-medium detection portion that detects a printing-medium type;

a printing-medium storage portion that stores the printing-medium type detected by the printing-medium detection portion;

a printing-medium monitor portion that monitors a current printing-medium type detected by the printing-medium detection portion and a previous printing-medium type that was detected previously and is stored in the printing-medium storage portion;

a total-dot counting portion that adds a number of dots which are printed from a reference time point, thereby obtaining a total dot count;

an adjustment portion that adjusts the total dot count based on a predetermined adjustment dot count corresponding to an ambient temperature;

a pulse-width setting portion that sets the width of the drive voltage pulse based on a difference between the total dot count after adjustment by the adjustment portion and a predetermined reference dot count; and a pulse-width correction portion that corrects the width of the drive voltage pulse, when the printing-medium monitor portion has determined that the current printing-medium type is different from the previous printing-medium type.

20. A thermal printer comprising:

a thermal head having a plurality of heating elements and movable relative to a printing medium for printing dots on the printing medium;

a heat-buildup-coefficient memory that stores a heat buildup coefficient;

a pulse application portion that applies a drive voltage pulse selectively to the heating elements, the drive voltage pulse having a width;

a voltage measurement portion that measures a head voltage applied to the thermal head; and a controller that adds a number of dots which are printed from a reference time point for obtaining a total dot count, adjusts the total dot count based on a predetermined adjustment dot count corresponding to an ambient temperature, sets the width of the drive voltage pulse based on the head voltage and the heat buildup coefficient, and corrects the width of the drive voltage pulse based on the head voltage measured by the voltage measurement portion, the heat buildup coefficient corresponding both to the ambient temperature and to an excess dot count that is a difference between the total dot count after adjustment and a predetermined reference dot count.

21. The thermal printer according to claim 20, further comprising a printing-medium detector that detects a printing-medium type, wherein the controller corrects the width of the drive voltage pulse based on the printing-medium type detected by the printing-medium detector.

22. The thermal printer according to claim 20, wherein the controller corrects the heat buildup coefficient based on the head voltage; and wherein the controller corrects the width of the drive voltage pulse based on the corrected heat buildup coefficient.

23. The thermal printer according to claim 22, wherein the controller corrects the heat buildup coefficient to become smaller as the head voltage becomes higher.

24. The thermal printer according to claim 20, wherein the controller controls the pulse application portion to selectively apply a first drive voltage pulse to the heating elements and controls the pulse application portion to apply a second drive voltage pulse for assisting the first drive voltage pulse, the first drive voltage pulse having a first width and the second drive voltage pulse having a second width; and wherein the controller sets the first width based on the head voltage and the heat buildup coefficient, and sets the second width based on the head voltage, the heat buildup coefficient, and a predetermined correction coefficient.

25. The thermal printer according to claim 24, wherein the predetermined correction coefficient has a value which becomes greater as the first width becomes larger.

26. The thermal printer according to claim 24, wherein the predetermined correction coefficient has a fixed value.

27. The thermal printer according to claim 20, further comprising a power source that supplies the thermal head with electrical power, wherein the voltage measurement portion measures the head voltage at predetermined time intervals;

wherein the controller sets the width of the drive voltage pulse based on a parameter corresponding to the head voltage; and wherein the controller controls the voltage measurement portion to perform an initial measurement after the pulse application portion has started applying the drive voltage pulse.

28. The thermal printer according to claim 27, further comprising a voltage-value memory that stores a voltage value measured by the voltage measurement portion, wherein the controller compares a previous voltage value stored in the voltage-value memory with a current voltage value measured by the voltage measurement portion, and sets the parameter based on a comparison result between the previous voltage value and the current voltage value.

29. The thermal printer according to claim 28, wherein, based on the comparison result, the controller sets the parameter to a value same as a previous parameter if the current voltage value is the same as the previous voltage value, and sets the parameter by adding a predetermined value to the previous parameter if the current voltage value is greater than the previous voltage value, and sets the parameter by subtracting a predetermined value from the previous parameter if the current voltage value is smaller than the previous voltage value.

30. The thermal printer according to claim 20, further comprising:

a printing-medium detector that detects a printing-medium type; and a printing-medium memory that stores the printing-medium type detected by the printing-medium detector, wherein the controller monitors a current printing-medium type detected by the printing-medium detector and a previous printing-medium type that was detected previously and is stored in the printing-medium memory; and wherein the controller corrects the width of the drive voltage pulse upon determining that the current printing-medium type is different from the previous printing-medium type.

31. The thermal printer according to claim 30, wherein the controller corrects the width of the drive voltage pulse by multiplying a predetermined ratio by the total dot count after the adjustment, the predetermined ratio corresponding to a combination of the current printing-medium type and the previous printing-medium type.

32. The thermal printer according to claim 30, wherein the controller corrects the width of the drive voltage pulse either by adding a predetermined dot count to the total dot count after the adjustment or by subtracting the predetermined dot count from the total dot count after the adjustment, the predetermined dot count corresponding to a combination of the current printing-medium type and the previous printing-medium type.

33. The thermal printer according to claim 30, wherein the controller corrects the width of the drive voltage pulse by multiplying a predetermined ratio by the heat buildup coefficient, the predetermined ratio corresponding to a combination of the current printing-medium type and the previous printing-medium type.

34. The thermal printer according to claim 30, wherein the controller corrects the width of the drive voltage pulse by resetting the total dot count after the adjustment to zero.

35. A thermal printer comprising:

a thermal head having a plurality of heating elements and movable relative to a printing medium for printing dots on the printing medium;

a heat-buildup-coefficient memory that stores a heat buildup coefficient;

a pulse application portion that applies a drive voltage pulse selectively to the heating elements, the drive voltage pulse having a width;

a voltage measurement portion that measures a head voltage applied to the thermal head;

a printing-medium detector that detects a printing-medium type; and a controller that adds a number of dots which are printed from a reference time point for obtaining a total dot count, adjusts the total dot count based on a predetermined adjustment dot count corresponding to an ambient temperature, sets the width of the drive voltage pulse based on the head voltage and the heat buildup coefficient, and corrects the width of the drive voltage pulse based on the printing-medium type detected by the printing-medium detector, the heat buildup coefficient corresponding both to the ambient temperature and to an excess dot count that is a difference between the total dot count after adjustment and a predetermined reference dot count.

36. The thermal printer according to claim 35, wherein the controller corrects the heat buildup coefficient based on the printing-medium type detected by the printing-medium detector; and wherein the controller corrects the width of the drive voltage pulse based on the corrected heat buildup coefficient.

37. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a power source having a voltage and that supplies the thermal head with electrical power;

a voltage measurement portion that measures the voltage of the power source at predetermined time intervals; and a controller that sets the width of the drive voltage pulse based on a parameter corresponding to the voltage measured by the voltage measurement portion, wherein the controller controls the voltage measurement portion to perform an initial measurement after is the pulse application portion has started applying the drive voltage pulse.

38. A thermal printer comprising:

a thermal head having a plurality of heating elements and movable relative to a printing medium for printing dots on the printing medium;

a pulse application portion that applies a drive voltage pulse selectively to the heating elements, the drive voltage pulse having a width;

a printing-medium detector that detects a printing-medium type;

a printing-medium memory that stores the printing-medium type detected by the printing-medium detector; and a controller that monitors a current printing-medium type detected by the printing-medium detector and a previous printing-medium type that was detected previously and is stored in the printing-medium memory, adds a number of dots which are printed from a reference time point for obtaining a total dot count, adjusts the total dot count based on a predetermined adjustment dot count corresponding to an ambient temperature, sets the width of the drive voltage pulse based on a difference between the total dot count after adjustment and a predetermined reference dot count, and corrects the width of the drive voltage pulse upon determining that the current printing-medium type is different from the previous printing-medium type.

39. A method of controlling heat buildup in a thermal printer including a thermal head and a heat-buildup-coefficient storage portion, the thermal head having a plurality of heating elements and being movable relative to a printing medium for printing dots on the printing medium, the method comprising:

applying a drive voltage pulse selectively to the heating elements, the drive voltage pulse having a pulse width;

measuring a head voltage applied to the thermal head;

adding a number of dots which are printed from a reference time point for obtaining a total dot count;

adjusting the total dot count based on a predetermined adjustment dot count corresponding to an ambient temperature;

setting the pulse width of the drive voltage pulse based on the head voltage and a heat buildup coefficient stored in the heat-buildup-coefficient storage portion, the heat buildup coefficient corresponding both to the ambient temperature and to an excess dot count, the excess dot count being a difference between the total dot count after adjustment in the step of adjusting the total dot count and a predetermined reference dot count; and correcting the pulse width of the drive voltage pulse based on the head voltage measured in the step of measuring the head voltage.

40. The method according to claim 39, further comprising detecting a printing-medium type, wherein the step of correcting the pulse width includes correcting the pulse width of the drive voltage pulse based on the printing-medium type detected in the step of detecting the printing-medium type.

41. The method according to claim 39, wherein the step of correcting the pulse width includes correcting the heat buildup coefficient based on the head voltage; and wherein the step of correcting the pulse width includes correcting the pulse width of the drive voltage pulse based on the heat buildup coefficient that has been corrected in the step of correcting the heat buildup coefficient.

42. The method according to claim 41, wherein the step of correcting the heat buildup coefficient includes correcting the heat buildup coefficient to become smaller as the head voltage becomes higher.

43. The method according to claim 39, wherein the step of applying the drive voltage pulse includes:

selectively applying a first drive voltage pulse to the heating elements, the first drive voltage pulse having a first width; and applying a second drive voltage pulse for assisting the first drive voltage pulse, the second drive voltage pulse having a second width; and wherein the step of setting the pulse width includes:

setting the first width based on the head voltage and the heat buildup coefficient; and setting the second width based on the head voltage, the heat buildup coefficient, and a predetermined correction coefficient.

44. The method according to claim 43, wherein the predetermined correction coefficient has a value which becomes greater as the first width becomes larger.

45. The method according to claim 43, wherein the predetermined correction coefficient has a fixed value.

46. The method according to claim 39, wherein the thermal printer further includes a power source that supplies the thermal head with electrical power;

wherein the step of measuring the head voltage includes measuring the head voltage at predetermined time intervals;

wherein the step of setting the pulse width includes setting the pulse width of the drive voltage pulse based on a parameter corresponding to the head voltage; and wherein the step of measuring the head voltage includes performing an initial measurement after a start of applying the drive voltage pulse.

47. The method according to claim 46, further comprising:

storing a voltage value measured in the step of measuring the head voltage;

comparing a previous voltage value stored in the step of storing the voltage value with a current voltage value measured in the step of measuring the head voltage; and setting the parameter based on a comparison result of the step of comparing the voltage values.

48. The method according to claim 47, wherein the step of setting the parameter includes, based on the comparison result, setting the parameter to a value same as a previous parameter if the current voltage value is the same as the previous voltage value, and setting the parameter by adding a predetermined value to the previous parameter if the current voltage value is greater than the previous voltage value, and setting the parameter by subtracting a predetermined value from the previous parameter if the current voltage value is smaller than the previous voltage value.

49. The method according to claim 39, further comprising:

detecting a printing-medium type;

storing the printing-medium type detected in the step of detecting the printing-medium type; and monitoring a current printing-medium type detected in the step of detecting the printing-medium type and a previous printing-medium type that was detected previously and is stored in the step of storing the printing-medium type, wherein the step of correcting the pulse width includes correcting the pulse width of the drive voltage pulse, upon determining, in the step of the monitoring the printing-medium type, that the current printing-medium type is different from the previous printing-medium type.

50. The method according to claim 49, wherein the step of correcting the pulse width includes correcting the pulse width of the drive voltage pulse by multiplying a predetermined ratio by the total dot count after the adjustment, the predetermined ratio corresponding to a combination of the current printing-medium type and the previous printing-medium type.

51. The method according to claim 49, wherein the step of correcting the pulse width includes correcting the pulse width of the drive voltage pulse either by adding a predetermined dot count to the total dot count after the adjustment or by subtracting the predetermined dot count from the total dot count after the adjustment, the predetermined dot count corresponding to a combination of the current printing-medium type and the previous printing-medium type.

52. The method according to claim 49, wherein the step of correcting the pulse width includes correcting the pulse width of the drive voltage pulse by multiplying a predetermined ratio by the heat buildup coefficient, the predetermined ratio corresponding to a combination of the current printing-medium type and the previous printing-medium type.

53. The method according to claim 49, wherein the step of correcting the pulse width includes correcting the pulse width of the drive voltage pulse by resetting the total dot count after the adjustment to zero.

54. A method of controlling heat buildup in a thermal printer including a thermal head and a heat-buildup-coefficient storage portion, the thermal head having a plurality of heating elements and being movable relative to a printing medium for printing dots on the printing medium, the method comprising:

applying a drive voltage pulse selectively to the heating elements, the drive voltage pulse having a pulse width;

measuring a head voltage applied to the thermal head;

detecting a printing-medium type;

adding a number of dots which are printed from a reference time point for obtaining a total dot count;

adjusting the total dot count based on a predetermined adjustment dot count corresponding to an ambient temperature;

setting the pulse width of the drive voltage pulse based on the head voltage and a heat buildup coefficient stored in the heat-buildup-coefficient storage portion, the heat buildup coefficient corresponding both to the ambient temperature and to an excess dot count, the excess dot count being a difference between the total dot count after adjustment in the step of adjusting the total dot count and a predetermined reference dot count; and correcting the pulse width of the drive voltage pulse based on the printing-medium type detected in the step of detecting the printing-medium type.

55. The method according to claim 54, wherein the step of correcting the pulse width includes correcting the heat buildup coefficient based on the printing-medium type detected in the step of detecting the printing-medium type; and wherein the step of correcting the pulse width includes correcting the pulse width of the drive voltage pulse based on the heat buildup coefficient that has been corrected in the step of correcting the heat buildup coefficient.

56. A method of controlling heat buildup in a thermal printer including a thermal head and a power source, the thermal head having a plurality of heating elements and being movable relative to a printing medium for printing dots on the printing medium, the power source having a voltage and supplying the thermal head with electrical power, the method comprising:

applying a drive voltage pulse selectively to the heating elements, the drive voltage pulse having a pulse width;

measuring the voltage of the power source at predetermined time intervals; and setting the pulse width of the drive voltage pulse based on a parameter corresponding to the voltage measured in the step of measuring the voltage, wherein the step of measuring the voltage includes performing an initial measurement after a start of applying the drive voltage pulse.

57. A method of controlling heat buildup in a thermal printer including a thermal head, the thermal head having a plurality of heating elements and being movable relative to a printing medium for printing dots on the printing medium, the method comprising:

applying a drive voltage pulse selectively to the heating elements, the drive voltage pulse having a pulse width;

detecting a printing-medium type;

storing the printing-medium type detected in the step of detecting the printing-medium type;

monitoring a current printing-medium type detected in the step of detecting the printing-medium type and a previous printing-medium type that was detected previously and is stored in the step of storing the printing-medium type;

adding a number of dots which are printed from a reference time point for obtaining a total dot count;

adjusting the total dot count based on a predetermined adjustment dot count corresponding to an ambient temperature;

setting the pulse width of the drive voltage pulse based on a difference between the total dot count after adjustment in the step of adjusting the total dot count and a predetermined reference dot count; and correcting the pulse width of the drive voltage pulse, upon determining, in the step of monitoring the printing-medium type, that the current printing-medium type is different from the previous printing-medium type.

* * * * *